US012680425B2

(12) United States Patent
Anthony et al.

(10) Patent No.: US 12,680,425 B2
(45) Date of Patent: Jul. 14, 2026

(54) DOWNHOLE PERFORATING TOOL WITH PROPELLANT CHARGE AND METHOD OF USING SAME

(71) Applicant: GR Energy Services Management, LP, Sugar Land, TX (US)

(72) Inventors: James William Anthony, Missouri City, TX (US); Cameron Michael Bryant, Sugar Land, TX (US); Vadim Akhmadikin, Sugar Land, TX (US)

(73) Assignee: GR Energy Services Management, LP, Sugar Land, TX (US)

( * ) Notice: Subject to any disclaimer, the term of this patent is extended or adjusted under 35 U.S.C. 154(b) by 0 days.

(21) Appl. No.: 18/600,713

(22) Filed: Mar. 9, 2024

(65) Prior Publication Data

US 2024/0229618 A1 Jul. 11, 2024

Related U.S. Application Data

(63) Continuation-in-part of application No. 17/585,446, filed on Jan. 26, 2022, now Pat. No. 11,994,008, (Continued)

(51) Int. Cl.
*E21B 43/117* (2006.01)
*E21B 43/119* (2006.01)

(52) U.S. Cl.
CPC ..... *E21B 43/117* (2013.01); *E21B 43/119* (2013.01)

(58) Field of Classification Search
CPC .... E21B 43/116; E21B 43/117; E21B 43/118; E21B 43/119; E21B 43/1185
See application file for complete search history.

(56) References Cited

U.S. PATENT DOCUMENTS 2,409,811 A 10/1946 Taylor et al.
2,595,615 A 5/1952 Sweetman
(Continued)

FOREIGN PATENT DOCUMENTS

CA 2997084 A1 8/2019
CA 3065272 A1 6/2020
(Continued)

OTHER PUBLICATIONS

Albert et al., New Perforating Switch Technology Advances Safety and Reliability for Horizontal Completions, SPE/AAPG/SEG Unconventional Resources Technology Conference, San Antonio, Texas, Jul. 20-22, 2015, pp. 7.
(Continued)

*Primary Examiner* — David Carroll
(74) *Attorney, Agent, or Firm* — JL Salazar

(57) ABSTRACT

A charge assembly includes a charge tube, shaped charges, and propellant charges. The charge tube is positionable in a downhole perforating tool. The shaped charges and the propellant charges are receivably supported in the charge tube. Each of the shaped charges includes a charge jacket and a charge material. The charge material has a detonation rate of greater than one microsecond. Each of the propellant charges includes a propellant jacket and a propellant material. The propellant charges have a detonation rate of less than one microsecond. An uphole portion of the propellant charges are positioned uphole from the shaped charges and a downhole portion of the propellant charges are positioned downhole from the shaped charges. The shaped charges are positioned between the uphole and the downhole portion. The shaped and the propellant charges are electrically connectable to a detonator for activation thereby.

20 Claims, 47 Drawing Sheets

Related U.S. Application Data which is a continuation-in-part of application No. 17/366,884, filed on Jul. 2, 2021, now Pat. No. 11,898,425, which is a continuation of application No. 16/676,246, filed on Nov. 6, 2019, now Pat. No. 11,078,763, which is a continuation of application No. 16/537,347, filed on Aug. 9, 2019, now Pat. No. 10,858,919.

(60) Provisional application No. 63/450,963, filed on Mar. 9, 2023, provisional application No. 63/141,975, filed on Jan. 26, 2021, provisional application No. 62/717,320, filed on Aug. 10, 2018.

(56) References Cited

U.S. PATENT DOCUMENTS 2,705,159 A 3/1955 Pfau
2,883,932 A 4/1959 Caldwell
3,024,843 A 3/1962 Vaughan
3,062,292 A 11/1962 Lowrey et al.
3,067,679 A 12/1962 Caldwell et al.
3,107,611 A 10/1963 Caldwell et al.
3,211,222 A 10/1965 Myers
3,246,707 A 4/1966 Bell
3,713,393 A 1/1973 O'Connor et al.
3,966,236 A 6/1976 Vann
4,011,815 A * 3/1977 Garcia ..... E21B 43/117 175/4.51
4,457,383 A 7/1984 Boop
4,497,224 A 2/1985 Jurgens
4,598,775 A 7/1986 Vann et al.
4,688,640 A 8/1987 Pritchard, Jr.
4,842,093 A 6/1989 Lerche et al.
4,886,126 A 12/1989 Yates, Jr.
5,027,708 A * 7/1991 Gonzalez ..... E21B 43/1185 102/202.1
5,042,594 A 8/1991 Gonzalez et al.
5,088,413 A 2/1992 Huber et al.
5,242,201 A 9/1993 Beeman
5,347,929 A 9/1994 Lerche et al.
5,505,134 A 4/1996 Brooks et al.
5,509,356 A 4/1996 Renfro
5,756,926 A 5/1998 Bonbrake et al.
5,971,072 A 10/1999 Huber et al.
5,984,006 A 11/1999 Read et al.
6,095,583 A 8/2000 Beeman et al.
6,148,263 A 11/2000 Brooks et al.
6,283,227 B1 9/2001 Lerche et al.
6,383,108 B1 5/2002 Yoo
6,386,108 B1 5/2002 Brooks et al.
6,431,269 B1 8/2002 Post et al.
6,450,541 B1 9/2002 Bakke
6,520,089 B1 2/2003 Avanci et al.
6,598,682 B2 7/2003 Johnson et al.
6,604,584 B2 8/2003 Lerche et al.
6,752,083 B1 6/2004 Lerche et al.
6,896,059 B2 5/2005 Brooks et al.
6,938,689 B2 9/2005 Farrant et al.
7,007,756 B2 3/2006 Lerche et al.
7,116,542 B2 10/2006 Lerche et al.
7,198,101 B2 4/2007 McGarian et al.
7,336,474 B2 2/2008 Lerche et al.
7,347,278 B2 3/2008 Lerche et al.
7,381,957 B2 6/2008 Medley et al.
7,383,882 B2 6/2008 Lerche et al.
7,409,987 B2 8/2008 Fjelde
7,461,580 B2 12/2008 Bell et al.
7,485,851 B2 2/2009 Medley et al.
7,485,865 B2 2/2009 Medley et al.
7,505,244 B2 3/2009 Lerche et al.
7,520,323 B2 4/2009 Lerche et al.
7,549,373 B2 6/2009 Brooks et al.
7,565,930 B2 7/2009 Seekford
7,690,429 B2 4/2010 Creel et al.
7,762,351 B2 7/2010 Vidal
7,810,569 B2 10/2010 Hill et al.
8,056,632 B2 11/2011 Goodman
8,091,477 B2 1/2012 Brooks et al.
8,230,788 B2 7/2012 Brooks et al.
8,267,012 B2 9/2012 Peeters et al.
8,576,090 B2 11/2013 Lerche et al.
8,689,868 B2 4/2014 Lerche et al.
8,884,778 B2 11/2014 Lerche et al.
8,960,093 B2 2/2015 Preiss et al.
9,140,088 B2 9/2015 Brooks
9,145,763 B1 9/2015 Sites, Jr.
9,371,709 B2 6/2016 Brooks
9,382,783 B2 7/2016 Langford et al.
9,394,767 B2 7/2016 Brooks et al.
9,459,080 B2 10/2016 Collins et al.
9,494,021 B2 11/2016 Parks et al.
9,581,422 B2 2/2017 Preiss et al.
9,605,937 B2 3/2017 Eitschberger et al.
9,677,373 B2 6/2017 Harris
9,702,680 B2 7/2017 Parks et al.
9,719,339 B2 8/2017 Richard et al.
9,784,549 B2 10/2017 Eitschberger
9,810,035 B1 11/2017 Carr et al.
9,822,596 B2 11/2017 Clemens et al.
9,822,618 B2 11/2017 Eitschberger
9,851,191 B2 12/2017 Lerche et al.
9,903,185 B2 2/2018 Ursi et al.
9,915,513 B1 3/2018 Zemla et al.
9,951,589 B2 4/2018 Wilson
10,036,236 B1 7/2018 Sullivan et al.
10,066,921 B2 9/2018 Eitschberger
10,188,990 B2 1/2019 Burmeister et al.
10,309,199 B2 6/2019 Eitschberger
10,309,952 B2 6/2019 Rudnik et al.
10,352,136 B2 * 7/2019 Goyeneche ..... E21B 43/117
10,352,674 B2 7/2019 Eitschberger
10,365,078 B2 7/2019 Eitschberger
10,365,079 B2 7/2019 Harrington et al.
10,429,161 B2 10/2019 Parks et al.
10,507,433 B2 12/2019 Eitschberger et al.
10,557,693 B2 2/2020 Lerche et al.
10,648,300 B2 5/2020 Collins et al.
10,689,931 B2 6/2020 Mickey et al.
10,760,384 B2 9/2020 Schmidt et al.
10,794,122 B2 10/2020 Kitchen et al.
10,816,311 B2 10/2020 Zemla et al.
10,844,678 B2 11/2020 Mickey et al.
10,858,919 B2 12/2020 Anthony et al.
10,890,036 B2 1/2021 Kosel et al.
10,941,625 B2 3/2021 Mickey
11,066,886 B2 7/2021 Mickey
11,073,005 B2 7/2021 Schmidt et al.
11,078,763 B2 8/2021 Anthony et al.
11,371,305 B2 6/2022 Mickey et al.
2003/0047358 A1 3/2003 Bonkowski
2003/0196806 A1 10/2003 Hromas et al.
2004/0134667 A1 7/2004 Brewer et al.
2004/0216866 A1 * 11/2004 Barlow ..... E21B 43/119 166/55
2006/0060355 A1 3/2006 Bell et al.
2006/0070739 A1 4/2006 Brooks et al.
2008/0149338 A1 6/2008 Goodman et al.
2008/0264289 A1 10/2008 Tiernan et al.
2010/0258292 A1 10/2010 Tiernan et al.
2010/0286800 A1 11/2010 Lerche et al.
2011/0090091 A1 4/2011 Lerche et al.
2012/0199352 A1 8/2012 Lanclos et al.
2012/0247769 A1 * 10/2012 Schacherer ..... E21B 43/117 166/63
2012/0247771 A1 10/2012 Black et al.
2012/0298361 A1 11/2012 Sampson
2013/0008669 A1 1/2013 Deere et al.
2013/0042780 A1 2/2013 Brooks et al.
2013/0153205 A1 6/2013 Borgfeld et al.
2013/0220613 A1 8/2013 Brooks et al.
2013/0337635 A1 12/2013 Yamawaku et al.
2014/0033939 A1 2/2014 Priess et al.
2014/0151018 A1 6/2014 Lerche et al.

(56) References Cited

U.S. PATENT DOCUMENTS

| | | | |
|---|---|---|---|
| 2015/0292306 | A1 | 10/2015 | Collins et al. |
| 2015/0292849 | A1 | 10/2015 | Lerche et al. |
| 2015/0308795 | A1 | 10/2015 | Collins et al. |
| 2015/0322742 | A1 | 11/2015 | Brooks |
| 2015/0330192 | A1 | 11/2015 | Rogman et al. |
| 2015/0337635 | A1 | 11/2015 | Langford et al. |
| 2015/0345916 | A1 | 12/2015 | Sokolove et al. |
| 2015/0345922 | A1 | 12/2015 | Lanclos et al. |
| 2016/0061572 | A1 | 3/2016 | Eitschberger et al. |
| 2016/0115753 | A1 | 4/2016 | Frazier et al. |
| 2016/0138394 | A1 | 5/2016 | Brooks et al. |
| 2016/0168961 | A1 | 6/2016 | Parks et al. |
| 2016/0281477 | A1 | 9/2016 | Langford et al. |
| 2016/0356132 | A1 | 12/2016 | Burmeister et al. |
| 2017/0030693 | A1 | 2/2017 | Preiss et al. |
| 2017/0074078 | A1 | 3/2017 | Eitschberger |
| 2017/0089678 | A1 | 3/2017 | Bergmann |
| 2017/0119016 | A1 | 5/2017 | Cook et al. |
| 2017/0121236 | A1 | 5/2017 | Bradley et al. |
| 2017/0122083 | A1 | 5/2017 | Wilson |
| 2017/0122086 | A1 | 5/2017 | Sheng |
| 2017/0191328 | A1 | 7/2017 | Sokolove et al. |
| 2017/0198559 | A1 | 7/2017 | Golian et al. |
| 2017/0199015 | A1 | 7/2017 | Collins et al. |
| 2017/0199016 | A1 | 7/2017 | Collins et al. |
| 2017/0211363 | A1 | 7/2017 | Bradley et al. |
| 2017/0275976 | A1 | 9/2017 | Collins et al. |
| 2017/0314373 | A9 | 11/2017 | Bradley et al. |
| 2017/0370194 | A1 | 12/2017 | Lopez et al. |
| 2018/0038208 | A1 | 2/2018 | Eitschberger |
| 2018/0080298 | A1 | 3/2018 | Covalt et al. |
| 2018/0087330 | A1 | 3/2018 | Bradley et al. |
| 2018/0094910 | A1 | 4/2018 | Ashton et al. |
| 2018/0106121 | A1 | 4/2018 | Griffin et al. |
| 2018/0112500 | A1 | 4/2018 | Collins et al. |
| 2018/0119529 | A1 | 5/2018 | Goyeneche |
| 2018/0216445 | A1 | 8/2018 | Collins et al. |
| 2018/0224260 | A1 | 8/2018 | Zemla et al. |
| 2018/0256724 | A1 | 9/2018 | Knipe et al. |
| 2018/0258724 | A1 | 9/2018 | Massey et al. |
| 2018/0299239 | A1 | 10/2018 | Eitschberger et al. |
| 2018/0318770 | A1 | 11/2018 | Eitschberger et al. |
| 2018/0347324 | A1 | 12/2018 | Langford et al. |
| 2018/0347325 | A1* | 12/2018 | Goyeneche ..... E21B 43/119 |
| 2019/0048693 | A1 | 2/2019 | Henke et al. |
| 2019/0085685 | A1 | 3/2019 | McBride |
| 2019/0086189 | A1 | 3/2019 | Eitschberger et al. |
| 2019/0106969 | A1 | 4/2019 | Sullivan et al. |
| 2019/0127290 | A1 | 5/2019 | Löhken et al. |
| 2019/0153827 | A1 | 5/2019 | Goyeneche |
| 2019/0162056 | A1 | 5/2019 | Sansing |
| 2019/0162057 | A1 | 5/2019 | Ashton et al. |
| 2019/0178045 | A1 | 6/2019 | Frazier et al. |
| 2019/0195054 | A1 | 6/2019 | Bradley et al. |
| 2019/0219375 | A1 | 7/2019 | Parks et al. |
| 2019/0234189 | A1 | 8/2019 | Preiss |
| 2019/0242209 | A1 | 8/2019 | Anthony et al. |
| 2019/0242222 | A1 | 8/2019 | Eitschberger |
| 2019/0257158 | A1 | 8/2019 | Langford et al. |
| 2019/0309609 | A1 | 10/2019 | Hardesty et al. |
| 2019/0330947 | A1 | 10/2019 | Mulhern et al. |
| 2019/0368293 | A1 | 12/2019 | Covalt et al. |
| 2019/0376775 | A1 | 12/2019 | Preiss et al. |
| 2020/0024935 | A1 | 1/2020 | Eitschberger et al. |
| 2020/0032626 | A1 | 1/2020 | Parks et al. |
| 2020/0072029 | A1 | 3/2020 | Anthony et al. |
| 2020/0182025 | A1 | 6/2020 | Brady |
| 2020/0190927 | A1 | 6/2020 | Mickey et al. |
| 2020/0190928 | A1 | 6/2020 | King et al. |
| 2020/0199983 | A1 | 6/2020 | Preiss et al. |
| 2020/0200516 | A1 | 6/2020 | Zemla et al. |
| 2020/0256168 | A1 | 8/2020 | Knight et al. |
| 2021/0332678 | A1 | 10/2021 | Anthony et al. |

FOREIGN PATENT DOCUMENTS

| | | | |
|---|---|---|---|
| CN | 203742568 | U | 7/2014 |
| CN | 111322024 | A | 6/2020 |
| DE | 102006039096 | | 1/2008 |
| EP | 601880 | A2 | 6/1994 |
| GB | 2367574 | B | 2/2003 |
| GB | 2405423 | A | 3/2005 |
| GB | 2395969 | B | 11/2005 |
| GB | 2411222 | B | 11/2006 |
| WO | 1979000704 | A1 | 9/1979 |
| WO | 0116456 | A1 | 3/2001 |
| WO | 2014055061 | A1 | 4/2014 |
| WO | 2015179787 | A1 | 11/2015 |
| WO | 2016186611 | A1 | 11/2016 |
| WO | 2018112153 | A1 | 6/2018 |
| WO | 2022067212 | A1 | 3/2022 |

OTHER PUBLICATIONS

Allied Horizontal Wireline Services, Optimizing Fracturing Through Perforation, 2018, pp. 1-24.

Corelab, Addressable Release Tool—(ART), downloaded from the world wide web, dated at least as early as the filing date of the present application, pp. 1-2.

Dynaenergetics, DynaStage Perforating Gun System - Improve Wellsite Efficiency with a Truly Modular Design, downloaded from the world wide web, dated at least as early as Aug. 10, 2018, pp. 1-2.

Dynaenergetics, DynaStage Perforating Gun System, downloaded from the world wide web, dated at least as early as Aug. 10, 2018, pp. 1-2.

Dynaenergetics, Gun Assembly, downloaded from the world wide web, dated at least as early as Aug. 10, 2018, p. 1.

Guardian, Addressable Release Tool Operations and Maintenance Manual, downloaded from the world wide web, dated at least as early as Oct. 5, 2011, pp. 1-210.

Hunting, 2014 Gun System and Accessories Catalog, downloaded from the world wide web, dated 2014, pp. 1-33.

Hunting, H-1 Perforating Gun System—H-1 Gun String—TCP and Gun String—Wireline, downloaded from the world wide web, dated at least as early as Aug. 10, 2018, pp. 1-2.

Hunting, H-1 Perforating Gun System—Titan Division Perforating Systems, downloaded from the world wide web, dated at least as early as Aug. 10, 2018, pp. 1-2.

Hunting, Marketing White Paper: H-1 Perforating Gun System, downloaded from the world wide web, dated Jan. 2017, pp. 1-5.

Schlumberger, Asfs Addressable-Switch Firing System, downloaded from the world wide web, dated at least as early as Aug. 10, 2018, p. 1.

Schlumberger, Fractal Flex, downloaded from the world wide web, dated at least as early as Aug. 10, 2018, p. 1.

Hunting, H-1 Perforating Gun System—H-1 Gun String—TCP, downloaded from the world wide web, dated at least as early as Aug. 10, 2018, p. 1.

* cited by examiner

DOWNHOLE PERFORATING TOOL WITH PROPELLANT CHARGE AND METHOD OF USING SAME

CROSS-REFERENCE TO RELATED APPLICATIONS

This application claims the benefit of U.S. Patent Application No. 63/450,963 filed on Mar. 9, 2023, the entire contents of which is hereby incorporated by reference herein. The application is also a continuation in part of U.S. application Ser. No. 17/585,446 filed on Jan. 28, 2022, which is a continuation in part of U.S. Non-Provisional application Ser. No. 17/366,884 filed on Jul. 2, 2021, which is a continuation of U.S. Non-Provisional application Ser. No. 16/676,246 filed on Nov. 6, 2019, which is a continuation-in-part of U.S. Non-Provisional application Ser. No. 16/537,347 filed on Aug. 9, 2019, which claims the benefit of U.S. Provisional Application No. 62/717,320, filed on Aug. 10, 2018, the entire contents of which are hereby incorporated by reference herein.

BACKGROUND

The present disclosure relates generally to oilfield technology. More specifically, the present disclosure relates to techniques for perforating downhole.

Wells are drilled into subsurface formations to reach subsurface targets, such as valuable hydrocarbons. Drilling equipment is positioned at the surface and drilling tools are advanced into the subsurface formation to form wellbores. Once drilled, casing may be inserted into the wellbore and cemented into place to complete the well. Once the well is completed, production tubing may be deployed through the casing and into the wellbore to produce fluid to the surface for capture.

Stimulation techniques have been developed to facilitate the production of fluid from the subterranean formation and into the wellbore. For example, some stimulation tools may be used for injecting and/or pumping fracturing fluids into the subterranean formation to form and/or expand fractures therethrough. Examples of injection tools are provided in U.S. Pat. No. 9,719,339, the entire contents of which is hereby incorporated by reference herein to the extent not inconsistent with the present disclosure.

In some cases, perforations may be formed along the wall of the wellbore and/or casing for passing the fracturing fluids therethrough. Some stimulation tools may be deployed into the wellbore to create perforations along a wall of the wellbore and into the subterranean formation. Examples of such tools are provided in Patent/Application Nos. EP0601880 and U.S. Pat. Nos. 5,347,929; 5,042,594; 5,088,413; 9,605,937; 6,752,083; 6,752,083; 7,565,930; 7,810,569; U.S. Ser. No. 10/760,384; U.S. Ser. No. 11/073,005; US20060070739; and US20170314373, the entire contents of which are hereby incorporated by reference herein. The perforations may be created by firing charges from the stimulation tool into the wall of the wellbore. See, for example, Patent/Application Nos. U.S. Pat. Nos. 3,713,393; 5,509,356; 9,145,769; US20080264289; US20100258292; US20120199352; US20170211363; US20170275976; US20170089678; and US20180216445, the entire contents of which are hereby incorporated by reference herein.

Despite the advancements in perforation and stimulation technology, there remains a need for techniques for more efficient and effective perforating. The present disclosure is directed at providing such needs.

SUMMARY

In at least one aspect, the present disclosure relates to a charge assembly of a downhole perforating tool positionable in a wellbore penetrating a subterranean formation. The charge assembly comprises a charge tube, shaped charges, and propellant charges. The charge tube is positionable in a downhole perforating tool. The shaped charges and the propellant charges are receivably supported in the charge tube. Each of the shaped charges comprises a charge jacket and a charge material positioned in the charge jacket. The charge material has a detonation rate of greater than one microsecond. Each of the propellant charges comprises a propellant jacket and a propellant material positioned in the propellant jacket. The propellant charges have a detonation rate of less than one microsecond. An uphole portion of the propellant charges are positioned uphole from the shaped charges and a downhole portion of the propellant charges are positioned downhole from the shaped charges. The shaped charges are positioned between the uphole and the downhole portion. The shaped and the propellant charges are electrically connectable to a detonator for activation thereby.

In another aspect, the disclosure relates to a downhole perforating tool for perforating a wellbore penetrating a subterranean formation. The downhole perforating tool comprises charge assembly, and a detonator assembly. The charge assembly comprises a charge tube, shaped charges, and propellant charges. The charge tube is positionable in a downhole perforating tool. The shaped charges and the propellant charges are receivably supported in the charge tube. Each of the shaped charges comprises a charge jacket and a charge material positioned in the charge jacket. The charge material has a detonation rate of greater than one microsecond. Each of the propellant charges comprises a propellant jacket and a propellant material positioned in the propellant jacket. The propellant charges have a detonation rate of less than one microsecond. An uphole portion of the propellant charges are positioned uphole from the shaped charges and a downhole portion of the propellant charges are positioned downhole from the shaped charges. The shaped charges are positioned between the uphole and the downhole portion. The shaped and the propellant charges are electrically connectable to a detonator for activation thereby. The detonator assembly comprising a detonator housing positionable in the downhole perforating tool. The detonator is positioned in the detonator housing.

In yet another aspect, the disclosure relates to a method of perforating a wellbore. The method comprises positioning a downhole perforating tool with a charge assembly as in claim 1 in the wellbore; forming perforations by detonating the shaped charges; and forming fractures along the perforations by detonating the propellant charges.

Finally, in yet another aspect, the disclosure relates to a method of assembling a perforating tool. The method comprises providing shaped charges, propellant charges, a charge tube, and a detonator; assembling a charge assembly; inserting the charge assembly into a perforating housing; and operatively connecting the charge assembly to the detonator. The charge assembly is assembled by receivably positioning the shaped charges in the charge tube; receivably positioning an uphole portion of the propellant charges in the charge tube a distance uphole from the shaped charges; and receivably positioning a downhole portion of the propellant charges in the charge tube a distance downhole from the shaped charges;

In at least one aspect, the present disclosure relates to a detonation assembly for a perforating unit of a downhole tool positionable in a wellbore penetrating a subterranean formation. The perforating unit comprises an outer housing connectable to the downhole tool. The detonation assembly comprises a detonator assembly and a charge assembly. The detonator assembly is positioned in the outer housing. The detonator assembly comprises a bulkhead connected to the outer housing; a charge connector connected to the bulkhead, the charge connection having a connection end; a detonator carried by the charge connector; and a trigger coupled to the detonator and to a remote actuator. The charge assembly is insertable into the outer housing. The charge assembly comprises a charge tube to support shaped charges therein; a charge feedthru at one end of the charge tube; and a receiver at an opposite end of the charge tube, the receiver having a receptacle shaped to matingly receive the connection end of the charge connector and to engage the trigger whereby, upon insertion of the charge assembly into the outer housing, the receiver is oriented and communicatively secured to the detonator assembly.

In another aspect, the disclosure relates to a perforating unit of a downhole tool positionable in a wellbore penetrating a subterranean formation. The perforating unit comprises an outer housing and a detonation assembly. The detonation assembly is positionable in the outer housing. The detonation assembly comprises a detonator assembly and a charge assembly. The detonator assembly is positioned in the outer housing. The detonator assembly comprises a bulkhead connected to the outer housing; a charge connector connected to the bulkhead, the charge connection having a connection end; a detonator carried by the charge connector; and a trigger coupled to the detonator and to a remote actuator. The charge assembly is insertable into the outer housing. The charge assembly comprises a charge tube to support shaped charges therein; a charge feedthru at one end of the charge tube; and a receiver at an opposite end of the charge tube. The receiver has a receptacle shaped to matingly receive the connection end of the charge connector and to engage the trigger whereby, upon insertion of the charge assembly into the outer housing, the receiver is oriented and communicatively secured to the detonator assembly.

Finally, in another aspect, the disclosure relates to a method of assembling a downhole perforating tool. The method comprises assembling the detonation assembly, connecting the outer housing to the downhole tool, and establishing a communication link between the detonator and a surface receiver. The detonation assembly may be assembled by: connecting the bulkhead of the detonator assembly to the outer housing; and connecting the detonator assembly to the charge assembly by inserting the charge assembly in the outer housing while receiving the connection end of the charge connector into the receiver.

In at least one aspect, the present disclosure relates to a detonator assembly for a perforating unit of a downhole tool positionable in a wellbore penetrating a subterranean formation. The detonator assembly comprises a detonator housing positionable in the perforating unit; a first and second connectors positioned at each end of the detonator housing, the second connector positionable adjacent a charge assembly; a detonator positioned in the detonation housing; and a trigger positioned in the detonator housing. The trigger comprises a detonation switch and a detonator contact. The detonation switch is communicatively coupled between a remote actuator and the detonator contact. The detonator contact is positionable in the second connection, and has spring-loaded arms extending through openings in the second connection to urge electrical contact with the charge assembly whereby an electrical connection is maintained between the detonator and the charge assembly.

The first connector is connectable to another perforating unit of the downhole tool. The first connector comprises a bulkhead and a feedthru. The first connector is electrically connected to the detonation switch. The bulkhead is electrically connected to the detonator switch by a spring-loaded pin. The bulkhead is electrically connectable to the feedthru and the feedthru is electrically connectable to another perforating unit of the downhole tool. The second connector comprises an insert portion insertable into an opening of the detonation housing and an offset portion extending from the insert portion receivably positionable into a mated receptacle in a charge assembly of the perforating unit.

The openings in the second connector are positioned along a flat surface of the offset portion. The flat surface is positionable against a corresponding flat surface of the mated receptacle of the charge assembly. The detonator contact comprises a spring portion and a support portion, the support portion having a curved portion shaped to receive the detonator and a flat portion extending therefrom, the spring portion having spring-loaded arms in the flat portion thereof. The spring-loaded arms have an engagement portion coupled to the flat portion and engageable with a charge assembly of the perforating unit and a tip extending from the engagement portion for connection to the detonation switch. The trigger further comprises a plug and switch contacts. The first connector comprises a bulkhead and a feedthru.

In another aspect, the disclosure relates to a downhole tool positionable in a wellbore penetrating a subterranean formation. The downhole tool comprises a tool housing positionable in the wellbore and at least one perforating unit positionable in the tool housing. Each of the perforating units comprises a perforating housing; a charge assembly positioned in the perforating housing; and a detonator assembly positioned in the perforating housing. The charge assembling has a charge chamber with shaped charges releasably supported therein. The detonator assembly comprises a detonator housing positionable in the perforating unit; a first and second connectors positioned at each end of the detonator housing, the second connector positionable adjacent a charge assembly; a detonator positioned in the detonation housing; and a trigger positioned in the detonator housing. The trigger comprises a detonation switch and a detonator contact. The detonation switch is communicatively coupled between a remote actuator and the detonator contact. The detonator contact is positionable in the second connection, and has spring-loaded arms extending through openings in the second connection to urge electrical contact with the charge assembly whereby an electrical connection is maintained between the detonator and the charge assembly.

The charge assembly comprises a charge tube, a receiver, and a charge feedthru. The charge feedthru is electrically connectable with the detonator assembly. The charge feedthru comprising a locking cap, plunger, retainer, and end plate. The detonator contact has an asymmetric end positionable in the receiver. The receiver comprises a detonation link defining a detonator receptacle in the receiver. The detonator receptacle shaped to matingly receive (i.e., mate with) the asymmetric end and the detonation link having a contact surface engageable with the electrical contacts. The downhole tool further comprises a retainer, a support sub, and/or a conveyance connector.

Finally, in another aspect, the disclosure relates to a method of assembling a downhole tool. The method comprises assembling a detonator assembly; assembling a charge assembly; providing a tool housing; positioning the charge assembly in the tool housing; positioning the detonator assembly in the tool housing; and electrically connecting the detonator assembly with the charge assembly.

In another aspect, the detonator assembly is for a perforating unit of a downhole tool positionable in a wellbore penetrating a subterranean formation, and the perforating unit also including a charge assembly. The detonator assembly comprises a detonator housing positionable within the perforating unit, the detonator housing having an uphole end and a downhole end; an uphole connection and a downhole connection positioned at the uphole end and the downhole end, respectively, of the detonator housing, the downhole connection positionable adjacent the charge assembly; a detonator positioned in the detonator housing; and a trigger positioned in the detonator housing. The trigger comprises a detonation switch and a detonator contact, the detonation switch communicatively coupled, when in use, between a remote actuator and the detonator contact, the detonator contact is positionable in the downhole connection, and has spring-loaded arms extending through openings in the downhole connection to urge electrical contact with the charge assembly whereby an electrical connection is maintained between the detonator and the charge assembly.

The uphole connector is connectable to a second perforating unit of the downhole tool, the uphole connector comprises a bulkhead and a feedthru, and the uphole connector is electrically connected to the detonation switch. The bulkhead is electrically connected to the detonator switch by a spring-loaded pin. The bulkhead is electrically connectable to the feedthru and the feedthru is electrically connectable to a third perforating unit of the downhole tool. The downhole connection comprises an insert portion insertable into an opening of the detonation housing and an asymmetrical portion extending from the insert portion, the asymmetrical portion receivably positionable into a mated receptacle in the charge assembly. The openings are positioned along a flat surface of the asymmetrical portion, the flat surface positionable against a corresponding flat surface of the mated receptacle of the charge assembly. The detonator contact comprises a spring portion and a support portion, the spring and support portions each having a curved portion shaped to receive the detonator and a flat portion extending therefrom, the spring portion having the spring-loaded arms in the flat portion thereof. The flat portions of each of the spring and support portions are positionable adjacent to each other, the spring-loaded arms having an engagement portion coupled to the flat portion and engageable with the flat surface of the charge assembly and a support tip extending from the engagement portion for engagement with the flat portion of the support portion whereby the engagement portion is urged against the flat surface of the charge assembly. The trigger further comprises a plug and contacts electrically connectable between the detonator switch and the detonator contact. The uphole connector comprises a bulkhead and a feedthru, the bulkhead having a slotted lock, the feedthru having a mated pin engageable with the slotted lock.

In another aspect, the disclosure relates to a downhole tool positionable in a wellbore penetrating a subterranean formation. The downhole tool comprises a tool housing positionable in the wellbore; and at least one perforating unit positionable in the housing. Each of the at least one perforating units comprises a perforating housing; a charge assembly positioned in the perforating housing, the charge assembly having a charge chamber with shaped charges releasably supported in the charge chamber; and a detonator assembly positioned in the perforating housing. The detonator assembly comprises a detonator housing having an uphole end and a downhole end and positionable in the perforating housing; an uphole connection and a downhole connection positioned at the uphole end and the downhole end, respectively, of the detonator housing, the downhole connection positionable adjacent the charge assembly; a detonator positioned in the detonator housing; and a trigger positioned in the detonator housing. The trigger comprises a detonation switch and a detonator contact, the detonation switch communicatively coupled, when in use, between a remote actuator and the detonator contact. The detonator contact is positionable in the downhole connection, and has spring-loaded arms extending through openings in the downhole connection to urge electrical contact with the charge assembly whereby an electrical connection is maintained between the detonator and the charge assembly.

The charge assembly comprises a charge tube, a receiver, and a charge feedthru. The charge feedthru is electrically connectable with the detonator feedthru, the charge feedthru comprising a locking cap, plunger, retainer, and end plate. The detonator contact has an asymmetric end positionable in the receiver, the receiver comprising a detonation link defining a detonator receptacle in the receiver, the detonator receptacle shaped to matingly receive the asymmetric end and the detonation link having a contact surface engageable with the electrical contacts. The downhole tool further comprises a retainer, a support sub, and/or a conveyance connector.

Finally, in another aspect, the disclosure relates to a method of assembling a downhole tool. The method comprises assembling a detonator assembly; assembling a charge assembly; providing a tool housing; positioning the charge assembly in the tool housing; positioning the detonator assembly in the tool housing; and electrically connecting the detonator assembly with the charge assembly.

The method further comprises positioning a second perforating unit in the tool housing and connecting the uphole connector to the second perforating unit. The uphole connector comprises a bulkhead and a feedthru, and the method further comprises electrically connecting the uphole connector to the detonation switch.

This Summary is not intended to be limiting and should be read in light of the entire disclosure including text, claims and figures herein.

BRIEF DESCRIPTION OF THE DRAWINGS

So that the above recited features and advantages of the present disclosure can be understood in detail, a more particular description of the invention, briefly summarized above, may be had by reference to the embodiments thereof that are illustrated in the appended drawings. The appended drawings illustrate example embodiments and are, therefore, not to be considered limiting of its scope. The figures are not necessarily to scale and certain features, and certain views of the figures may be shown exaggerated in scale or in schematic in the interest of clarity and conciseness.

DETAILED DESCRIPTION

The description that follows includes exemplary apparatus, methods, techniques, and/or instruction sequences that embody techniques of the present subject matter. However, it is understood that the described embodiments may be practiced without these specific details.

This disclosure relates to a denotation assembly of a downhole perforating tool positionable in a wellbore at a wellsite. The perforating tool is provided with one or more perforating units, each perforating unit including an outer housing and a detonation assembly. The detonation assembly includes a charge assembly and a detonator assembly secured in the outer housing. The perforating units have quick-locking features to facilitate assembly and operation of the perforating tool and its detonator.

The charge and detonator assemblies are provided with quick-locking features for quick, one-way, redundant, and secure assembly and operation. For example, the charge and detonator assemblies may have one-way pin and guide (e.g., slot) locking mechanisms (with or without additional locks) for securing the components in place. In another example, the charge and detonator assemblies may have components shaped for one-way insertion into and/or connection with adjacent components to assure proper positioning and fit of the components.

In yet another example, the charge and detonator assemblies may have locking contacts with push-in place dual spring activation and redundant contact surfaces for maintaining a communication connection with the detonator and/or between the detonator assembly and the charge assembly for the passage of signals therebetween. The communication links and/or connections may be or include various communication components, such as wires, cables, plates, contacts, switches, plugs, and/or other features, capable of passing electrical, power, and/or other signals.

The present disclosure seeks to provide features capable of providing one or more of the following, among others: means for signal communication (e.g., electrical connection), push in place assembly, spring loaded contact, redundant components and/or contacts, mechanisms to assure good electrical contact, reliable communication and/or operation, pre-assembly and/or offsite assembly capabilities, snap on electrical connections, quick connections and/or locks, no requirement for soldering and/or crimping contacts, reliability, time savings, low maintenance costs, etc.

Figure 1:
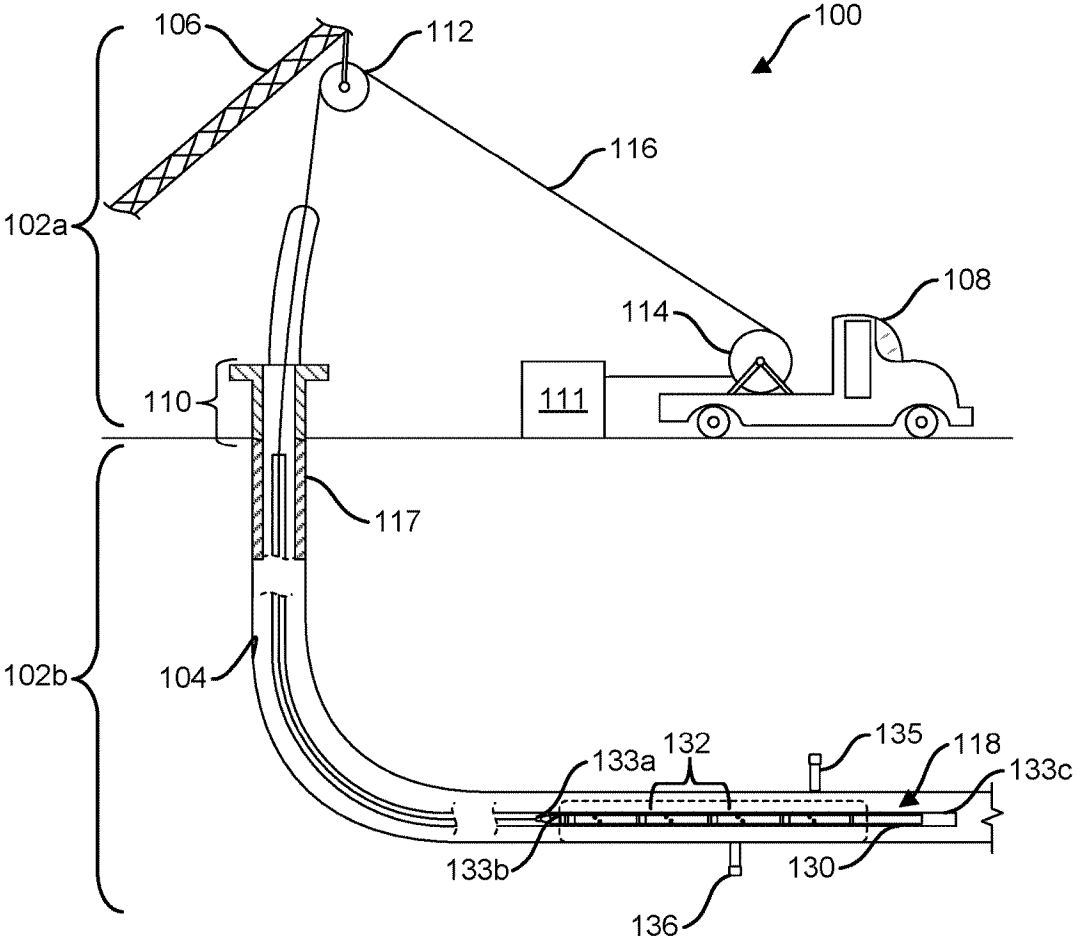
FIG. 1 is a schematic diagram depicting a wellsite with surface and downhole equipment, the downhole equipment comprising a downhole perforating tool having a quick-locking detonator assembly.

FIG. 1 is a schematic diagram depicting a wellsite 100 with surface equipment 102*a* and downhole equipment 102*b* positioned in a wellbore 104. The downhole equipment 102*b* comprises a downhole tool 118 with a perforating unit 132 having a quick-locking detonator assembly 133 or an integrated detonation assembly 1633 as is described further. The downhole tool 118 may be any downhole tool usable in the wellbore 104. When in combination with the perforating unit 132, the downhole tool 118 is referred to as a downhole perforating tool.

The wellsite 100 may be any wellsite positioned about a subterranean formation, such as an unconventional formation (e.g., shale) with a reservoir (e.g., oil, gas, water) therein. The surface equipment 102*a* includes a crane 106, a truck 108, a wellhead assembly 110, and a surface unit 111.

The crane 106 supports a pulley 112. The truck 108 supports a spool 114. A conveyance (e.g., wireline) 116 extends from the spool 114 over the pulley 112 and into the wellbore 104. The surface unit 111 is coupled to the conveyance 116 for communication therewith.

Figure 2:
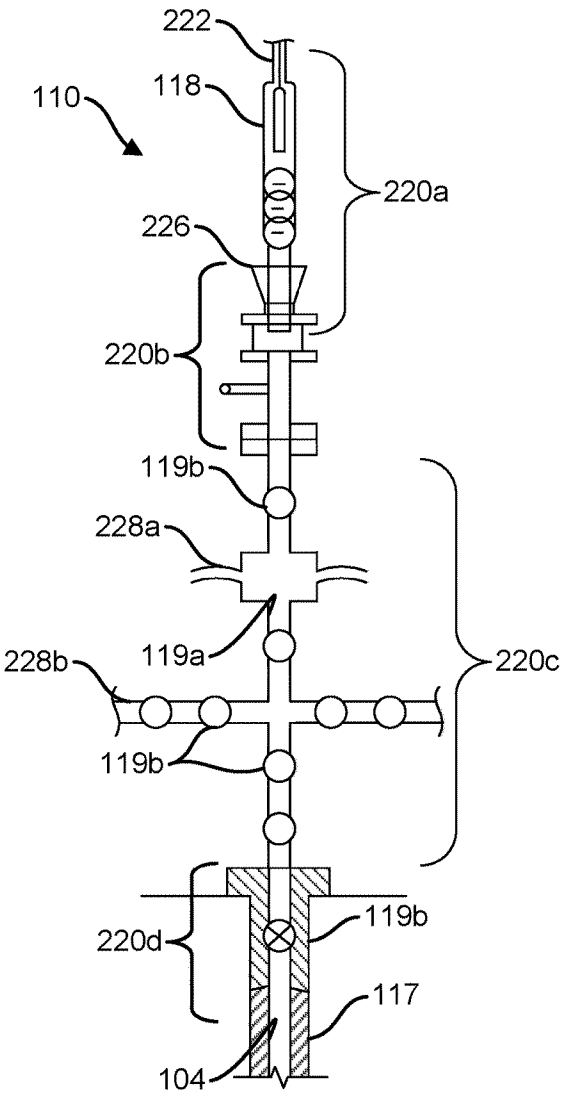
FIG. 2 is a schematic diagram depicting a portion of the surface equipment of FIG. 1 in greater detail.

The wellhead assembly 110 is disposed at a surface opening of the wellbore 104. An example wellhead assembly 110 is shown in FIG. 2. The wellhead assembly 110 includes a wireline lubricator 220*a*, a hydraulic disconnect 220*b*, a frac tree 220*c*, and a wellhead 220*d*. Portions of the wellhead assembly 110 are connectable to pressure control equipment (not shown) for the passage of fluids and/or to control pressures at the wellsite 100. A passage 119*a* extends through the wireline lubricator 220*a*, the hydraulic disconnect 220*b*, the frac tree 220*c*, and the wellhead 220*d* for fluid communication with the wellbore 104. Valves 119*b* are positioned about the wellhead assembly 110 to controllably restrict passage of fluid through portions thereof.

The wireline lubricator 220*a* is positioned at an upper end of the wellhead assembly 110 and is receivably supported in the hydraulic disconnect 220*b*. Seals 222 are positioned at an upper end of the wireline lubricator 220*a* for fluid isolation within the wellhead assembly 110. The wireline lubricator 220*a* may be detached from the wellhead assembly 110 and carried by the crane 106 for placement in the hydraulic disconnect 220*b*.

The hydraulic disconnect 220*b* includes a tulip 226 at an upper end to receive the wireline lubricator 220*a*. The hydraulic disconnect 220*b* is supported between the wireline lubricator 220*a* and the frac tree 220*c*. Once the wireline lubricator 220*a* is positioned in the tulip 226, the valves 119*b* on the hydraulic disconnect 220*b* may be opened to pass fluid therethrough or closed to isolate the passage therein. A lower end of hydraulic disconnect 220*b* is connectable to an upper end of the frac tree 220*c*. The frac tree 220*c* includes a goat head 228*a* and a cross member 228*b*. A lower end of the frac tree 220*c* is connectable to the wellhead 220*d*.

Referring back to FIG. 1, the downhole equipment 102*b* includes a casing 117 positioned in the wellbore 104 and the downhole tool 118 supported in the wellbore 104 by the conveyance 116. The casing 117 is a tubular member that lines the wellbore 104 and is connected to the wellhead 220*d*. Note that in some embodiments the casing 117 may be omitted (e.g., for openhole applications), or the casing 117 may be installed in only a portion of the wellbore 104.

The downhole tool 118 may be a downhole perforating tool or other downhole tool disposable in the wellbore 104 capable of carrying a perforating unit 132 for perforating the wellbore 104 as is described further herein.

Quick Locking Detonator Assembly

Figure 3:
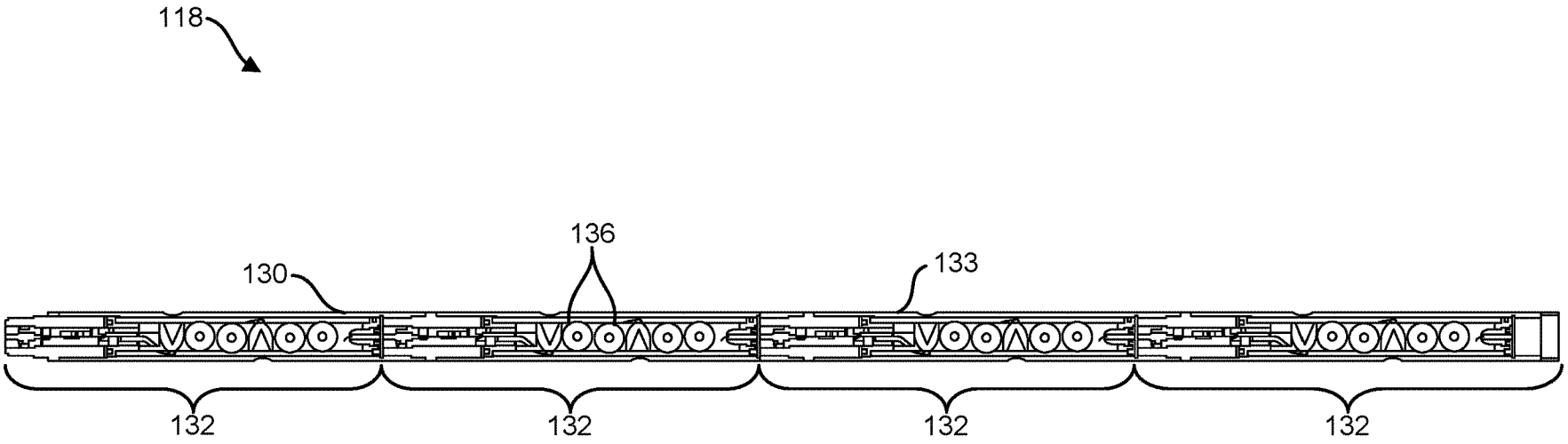
FIG. 3 is a longitudinal, cross-sectional view of a portion of the downhole perforating tool comprising a plurality of perforating units.

FIGS. 3-15 depict aspects of the quick locking detonation assembly 133 usable with the perforating units 132 of FIG. 1. Referring to FIGS. 1 and 3, the downhole tool 118 comprises a housing 130 with a series of the perforating units 132 therein. The housing 130 is a tubular member positionable in the wellbore 104 by the conveyance 116, and is shaped to receivably support each of the perforating units 132 therein. The perforating units 132 are connected together end to end in series. Threaded connections may be provided at each end of the perforating units 132 for connecting one or more perforating units 132 together. In the illustrated embodiment, there are four perforating units 132, but other embodiments may employ different numbers of perforating units 132. Some embodiments may use as few as one perforating unit 132.

The perforating units 132 are positioned in the housing 130 and carry the detonation assembly 133. The detonation assembly 133 carries shaped charges 136. The shaped charges 136 are explosive components that form a focused radially-oriented jet when activated. This jet makes a perforation 135 that extends through the wall of the wellbore 104 (and the casing 117 and cement if present) and into the subterranean formation surrounding the wellbore 104. The shaped charges 136 may be configured to create the perforations 135 for passage of fracturing (or injection) fluid into the formation for hydraulic fracturing therein.

The perforating units 132 may be communicatively connected to the surface unit 111 by the wireline 116 and/or by other means (e.g., wireline, electromagnetic, sonar, or other communication means). The perforating units 132 may be independently operated, or communicatively linked together for integrated operation therebetween. A communication link (e.g., wire or cable, not separately shown) may extend from the wireline 116 through the housing 130 and/or the perforating units 132. The perforating units 132 may be connected by the communication link for communication therebetween and/or for communication with the other components of the downhole tool 118.

The downhole tool 118 may be provided with various components, such as a conveyance connector 133*a*, a collar locator ("CCL") 133*b*, and a plug-setting tool 133*c*, all shown in FIG. 1. The conveyance connector 133*a* may be provided at a first end of the downhole tool 118 for connection to the wireline 116. The plug-setting tool 133*c* may secure the downhole tool 118 at specified depths along the wellbore 104.

The downhole tool 118 and/or one or more of the perforating units 132 may be coupled via a wired or wireless connection to the surface unit 111 as described above for operation therewith. The perforating unit(s) 132 may be activated by the surface unit 111 to selectively fire one or more of the shaped charges 136 to form the perforations 135 as schematically depicted in FIG. 1.

During operation, the downhole tool 118 may be carried in the wireline lubricator 220*a* via the wireline 116 to the wellsite 100 with the crane 106. Once the wireline lubricator 220*a* is secured in the tulip 226, the valve 119*b* of the hydraulic disconnect 220*b* may be opened to pump fluid to push the downhole tool 118 through the wellhead assembly 110 and into the wellbore 104. Fluid beneath the downhole tool 118 may be pumped back to the surface or exited out the wellbore 104 via pre-existing perforations (not shown) in the casing 117 to avoid the need for the fluid to return to the surface.

The CCL 133*b* may communicate an electrical signal up the wireline 116 to the surface unit 111 as it passes between adjacent segments of the casing 117. A position of the downhole tool 118 may be determined by counting these signals as the perforating system is pumped down the wellbore and by knowing the length of each segment of casing 117. However, other embodiments may use other techniques for determining the location of the CCL 133*b* in the wellbore 104.

When the bottom (i.e., downhole end) of the downhole tool 118 is at a desired position above the perforations 135 that are closest to the surface, pumping may be terminated. A coded communication signal may be sent down the wireline 116 to activate the plug-setting tool 133*c* to lock the downhole tool 118 in position. The signal may also be used to activate a switch in the perforating unit 132 to activate the perforating unit 132 to fire as is described further herein. Once fired, the plug-setting tool 133*c* may be activated to disconnect the downhole tool 118 and move the downhole tool 118 to another location, or out of the wellbore 104.

Figure 4A:
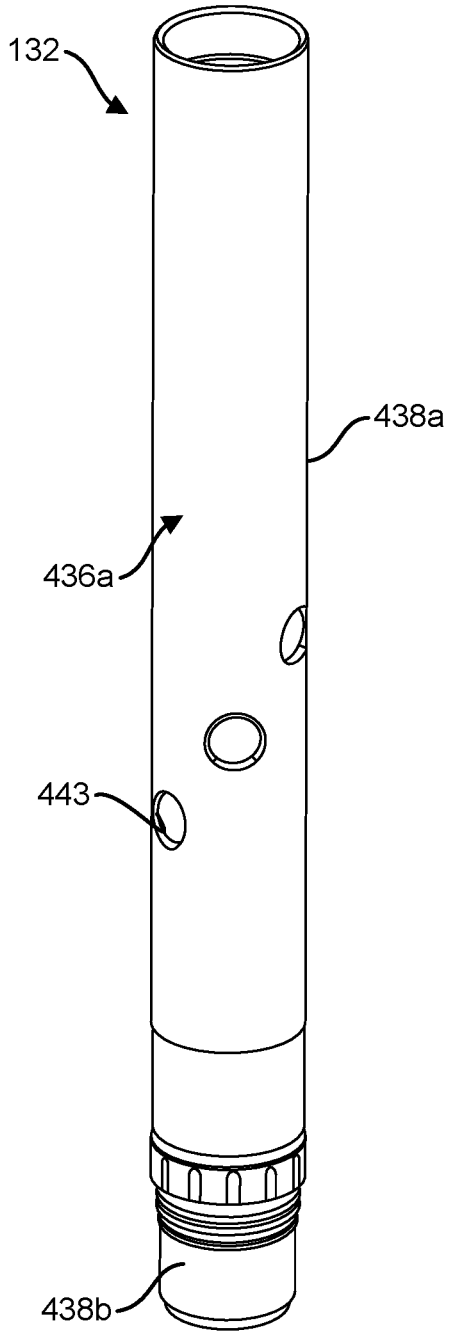
FIGS. 4A and 4B are perspective and longitudinal, cross-sectional views of one of the perforating units.
Figure 4B:
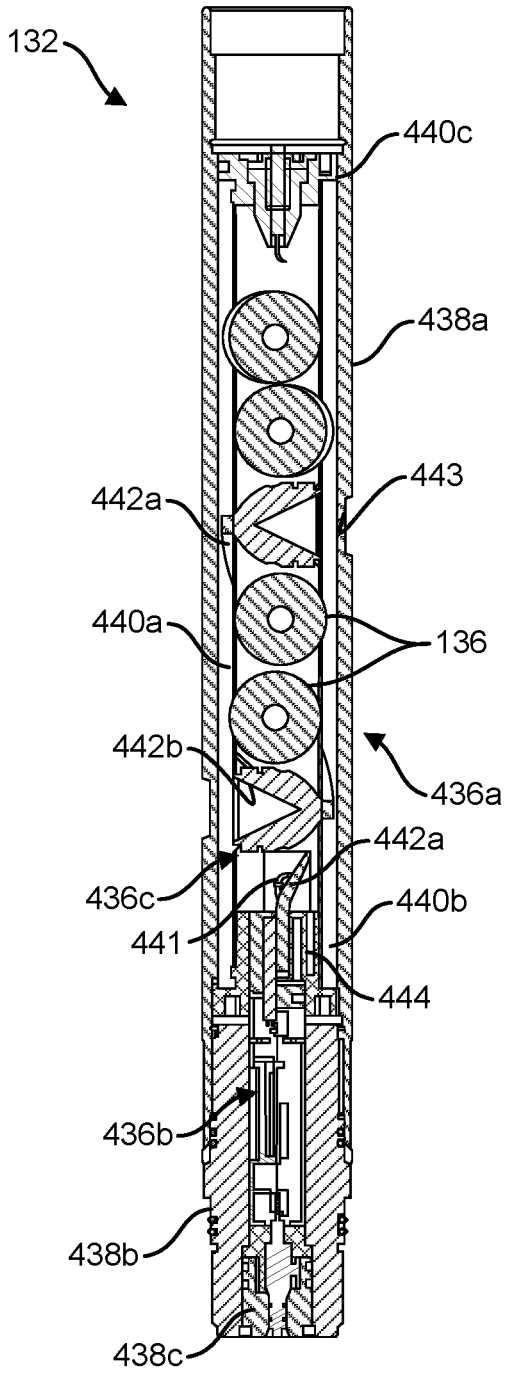
Figure 5:
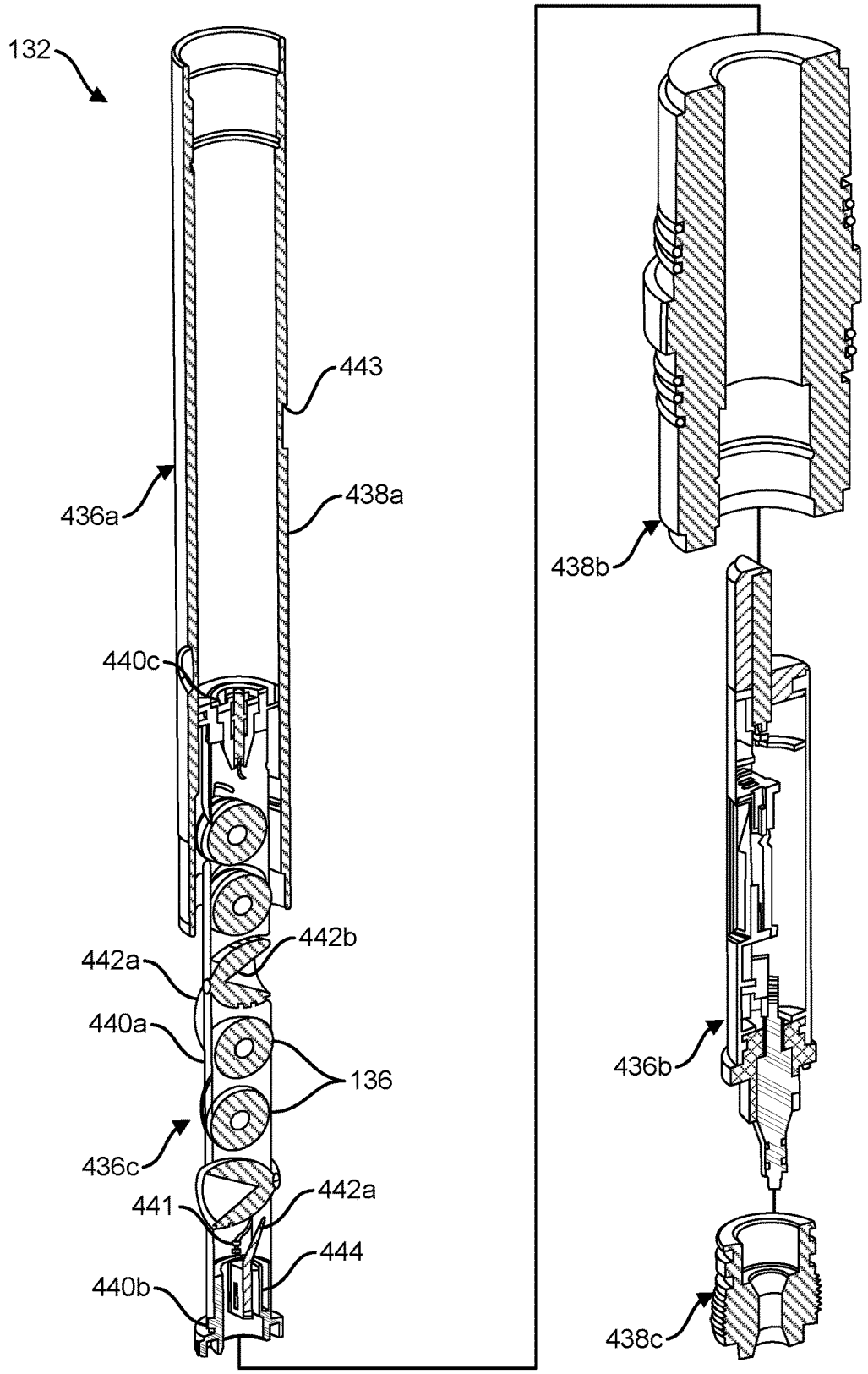
FIG. 5 is a cross-sectional, exploded view of the perforating unit.

FIGS. 4A-5 show one of the perforating units 132 in greater detail. FIGS. 4A and 4B show perspective and longitudinal, cross-sectional views of the perforating unit 132. FIG. 5 shows a cross-sectional, exploded view of the perforating unit 132. As shown in these views, the perforating unit 132 includes a perforating housing 436*a*, and the detonation assembly 133. The detonation assembly 133 includes a detonator assembly 436*b*, and a charge assembly 436*c*.

The perforating housing 436*a* includes an outer tube 438*a*, a support sub 438*b*, and a retainer 438*c*. The outer tube 438*a* is a tubular member slidingly receivable in the housing 130 (shown in FIG. 3). The outer tube 438*a* is shaped to receive the charge assembly 436*c* therein. The outer tube 438*a* has an end shaped to receive the support sub 438*b* and an opposite end shaped for connection to another perforating unit 132. The support sub 438*b* has an end insertable into the opposite end of the outer tube 438*a* and threadedly connected therewith. The support sub 438*b* also has another end extending from the outer tube 438*a* for connection to an adjacent perforating unit 132.

The support sub 438*b* is a tubular member shaped to support the retainer 438*c* and the detonator assembly 436*b*. The retainer 438*c* is positioned in an end of the support sub 438*b* to secure the detonator assembly 436*b* in the perforating housing 436*a*. The detonator assembly 436*b* is positioned in the support sub 438*b* and extends from the retainer 438*c* a distance into the charge assembly 436*c* for operative connection therewith as is described further herein.

Each of the perforating units 132 is provided with a communication link (e.g., wire) 441 extending therethrough for activating the detonator assembly 436*b* to fire the shaped charges 136. The communication link 441 may be a wire extending from the detonator assembly 436*b* through the charge tube 440*a* and to the charge feedthru 440*c*. The perforating units 132, where multiple perforating units 132 are employed, are connected in series with the communication link 441 coupled therebetween for selective activation of one or more of the perforating units 132. The communication link 441 of each perforating unit 132 may be coupled to an adjacent perforating unit 132 at each end of the perforation unit via the detonator assembly 436*b* at one end and the charge feedthru 440*c* at the other end for communication therewith. This connection may be repeated between the perforating units 132 to provide a series of connections for communication across the perforating units 132.

Figure 6A:
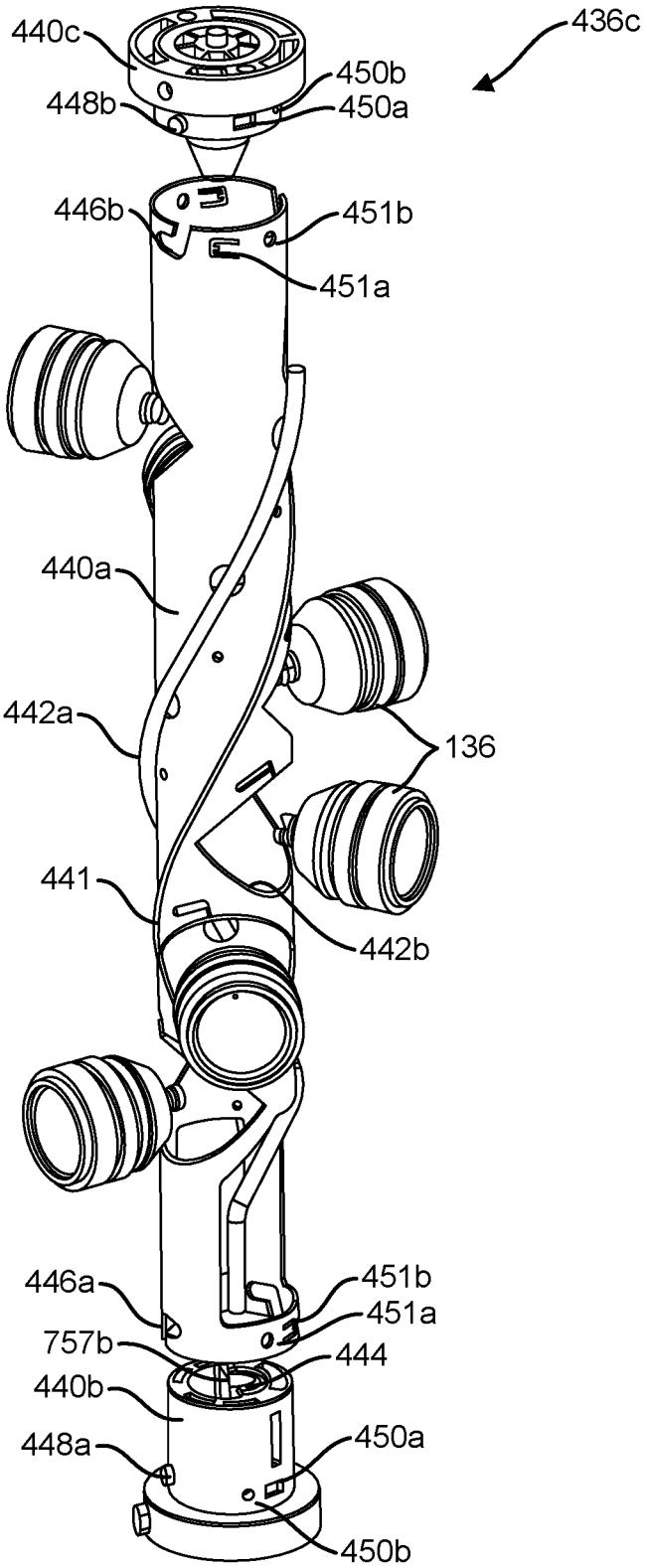
FIGS. 6A and 6B are exploded and partial cross-sectional views, respectively, of a charge assembly of the perforating unit.
Figure 6B:
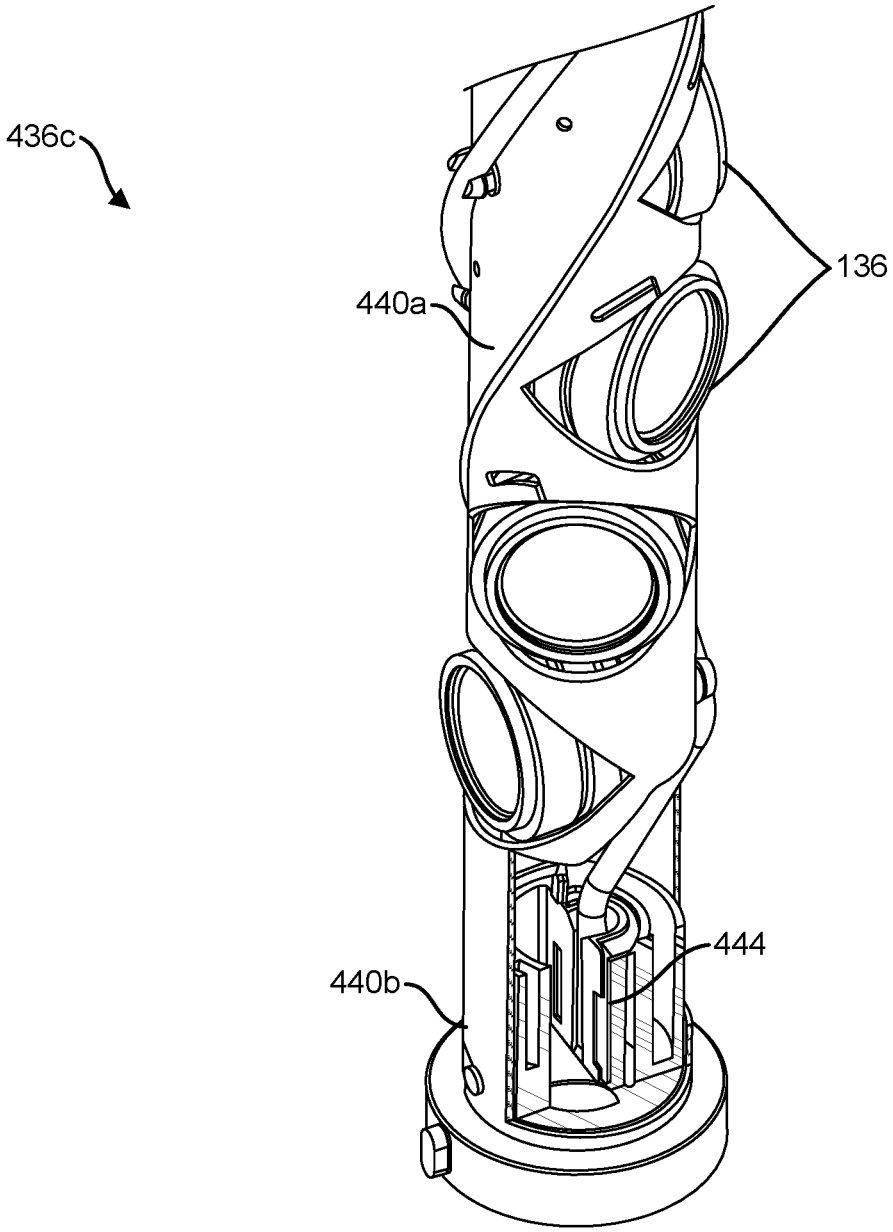
Figure 7:
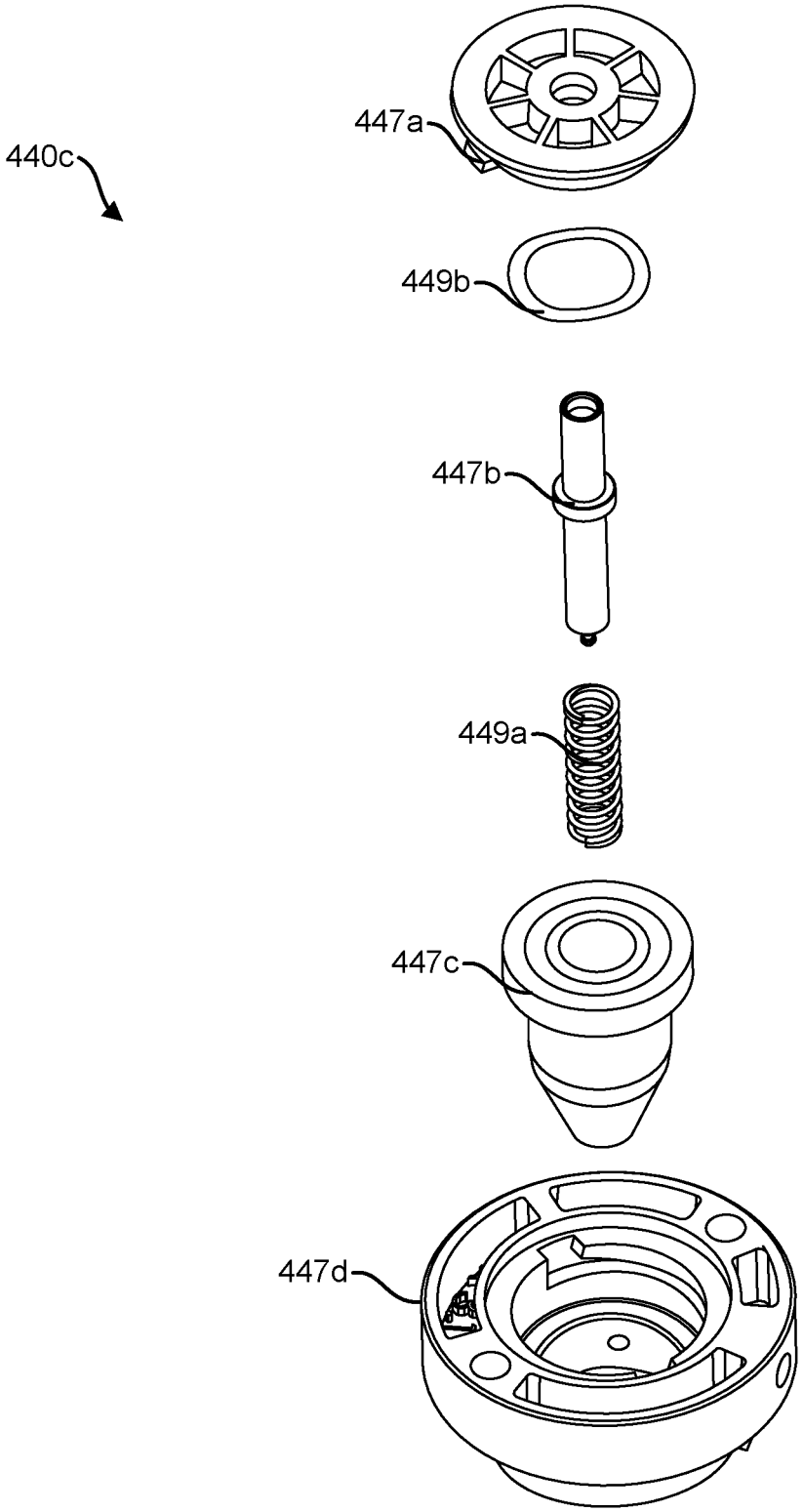
FIG. 7 is an exploded view of a charge feedthru of the charge assembly.

Referring to FIGS. 6A-6B, and 7 (as well as FIGS. 4B-5), features of the charge assembly 436*c* are shown. FIGS. 6A and 6B are exploded and partial cross-sectional views, respectively, of a charge assembly 436*c* of the perforating unit 132. FIG. 7 is an exploded view of a charge feedthru 440*c* of the charge assembly 436*c*.

The charge assembly 436*c* includes a charge tube 440*a*, a receiver 440*b* at one end of the charge tube 440*a*, and the charge feedthru 440*c* at an opposite end of the charge tube 440*a*. The charge tube 440*a* is slidingly receivable in the outer tube 438*a*. The charge tube 440*a* has the shaped charges 136 supported therein. The charge tube 440*a* also has a charge cable 442*a* and ports 442*b*.

The receiver 440*b* may be a flange shaped member receivable about an end of the charge tube 440*a* for connection to the support sub 438*b*. The receiver 440*b* may also be provided with a charge receptacle 444 shaped to receive the end of the detonator assembly 436*b* for connection therewith. The charge cable (or detonator cord) 442*a* is a fuse connected to the receiver 440*b*. The charge cable 442*a* extends from the receptacle 444 through the charge tube 440*a* and along a periphery of the charge tube 440*a* in a spiral configuration.

The charge cable 442*a* is connected to each of the shaped charges 136 in the charge tube 440*a* for activation thereof. The ports 442*b* extend through the charge tube 440*a*. The shaped charges 136 are positioned about the ports 442*b* to fire jets therethrough upon detonation. The ports 442*b* may be alignable with openings 443 in the perforating housing 436*a* for firing therethrough upon detonation.

The charge feedthru 440*c* is positionable at an opposite end of the charge tube 440*a* from the receiver 440*b*. As shown in greater detail in FIG. 7, the feedthru 440*c* includes a locking cap (or plate) 447*a*, plunger 447*b*, retainer 447*c*, and end plate 447*d*. The end plate 447*d* is seated on the locking cap 447*a*. The plunger 447*b* is supported on the locking cap 447*a* and extends through the end plate 447*d*. The plunger 447*b* is supported on the locking cap 447*a* and extends through the retainer 447*c*. Springs 449*a,b* may optionally be provided to support the plunger 447*b* in the retainer 447*c*.

As shown in FIGS. 4B and 6A, the charge tube 440*a*, the receiver 440*b*, and the feedthru 440*c* may have quick-locking features for lockingly connection in a desired position. In the example shown, the charge tube 440*a* is provided with guide slots 446*a,b* at each end shaped to matingly receive keys 448*a,b* positioned on the receiver 440*b* and the feedthru 440*c*, respectively.

When inserted into the end of the charge tube 440*a*, the key 448*a* of the receiver 440*b* is slidingly receivable into the guide slot 446*a*. The receiver 440*b* may be rotated so that the key 448*a* passes into the guide slot 446*a*, thereby positioning the receiver 440*b* in the desired position while also preventing unintentional retraction of the receiver 440*b* out of the charge tube 440*a*.

The charge tube 440*a* may also be provided with a locking tabs 451*a* and fastener holes 451*b* to secure the receiver 440*b* and feedthru 440*c* in position. The locking tabs 451*a* may be a cutout portion of the charge tube 440*a* corresponding to tab cavity 450*a* in the receiver 440*b* and the feedthru 440*c*. When the receiver 440*b*/the feedthru 440*c* are in position, the corresponding locking tab 451*a* may be pressed into the tab cavity 450*a* thereby further preventing movement of the receiver 440*b*/feedthru tube 440*c* about the charge tube 440*a*. Fasteners (not shown), such as pins, screws, bolts, etc., may be passed through fastener hole 451*b* and into a mated hole 450*b* in the receiver 440*b*/feedthru tube 440*c* to secure the receiver 440*b*/feedthru 440*c* to the charge tube 440*a*.

Figure 8A:
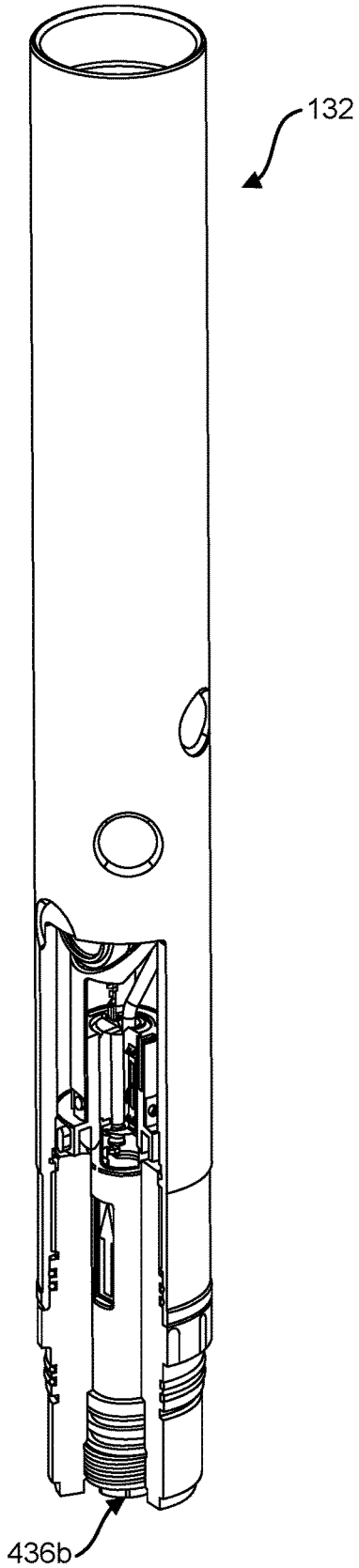
FIGS. 8A-8C are partial cross-sectional views of the perforating unit depicting a detonation assembly therein.
Figure 8B:
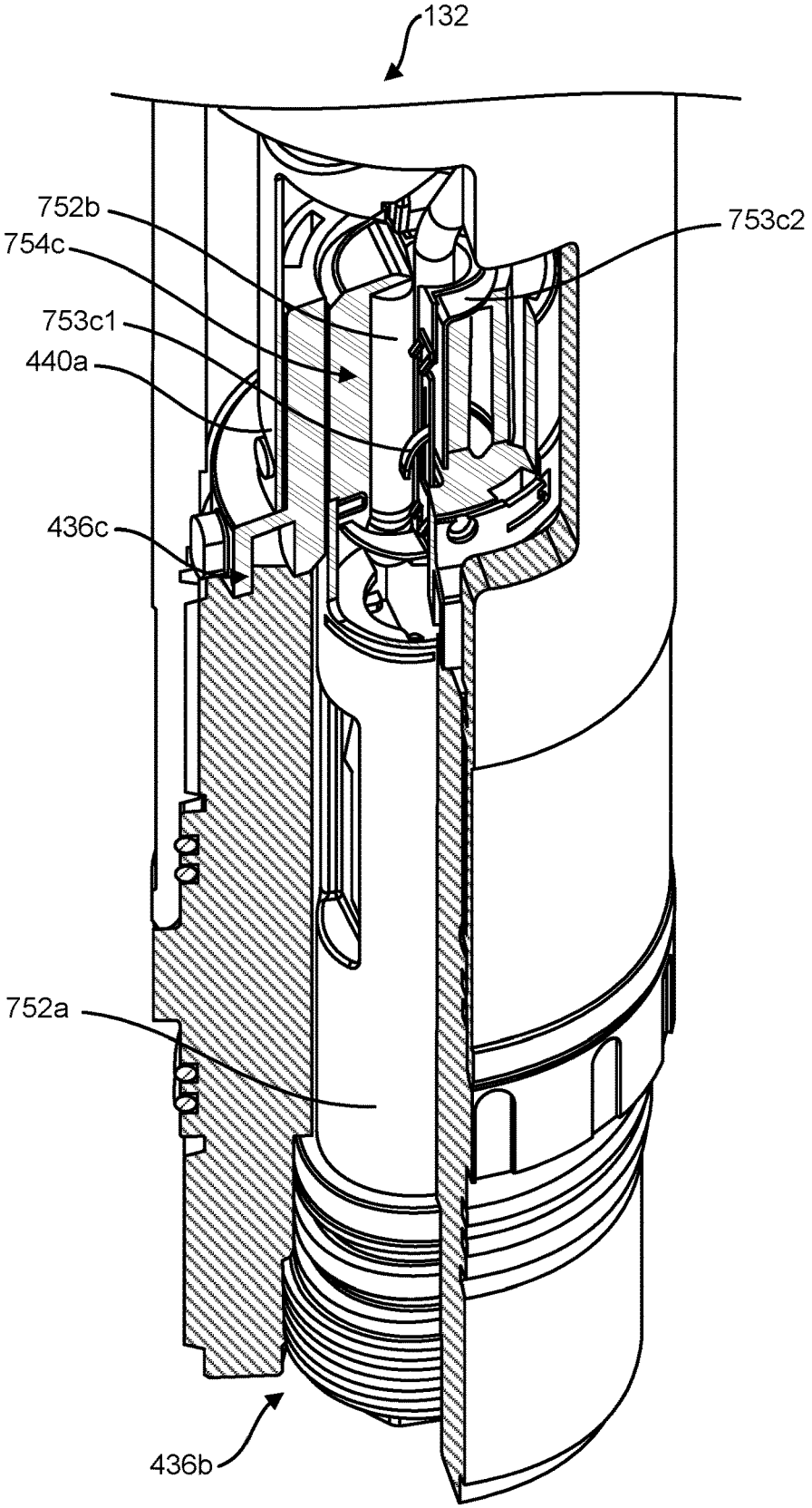
Figure 8C:
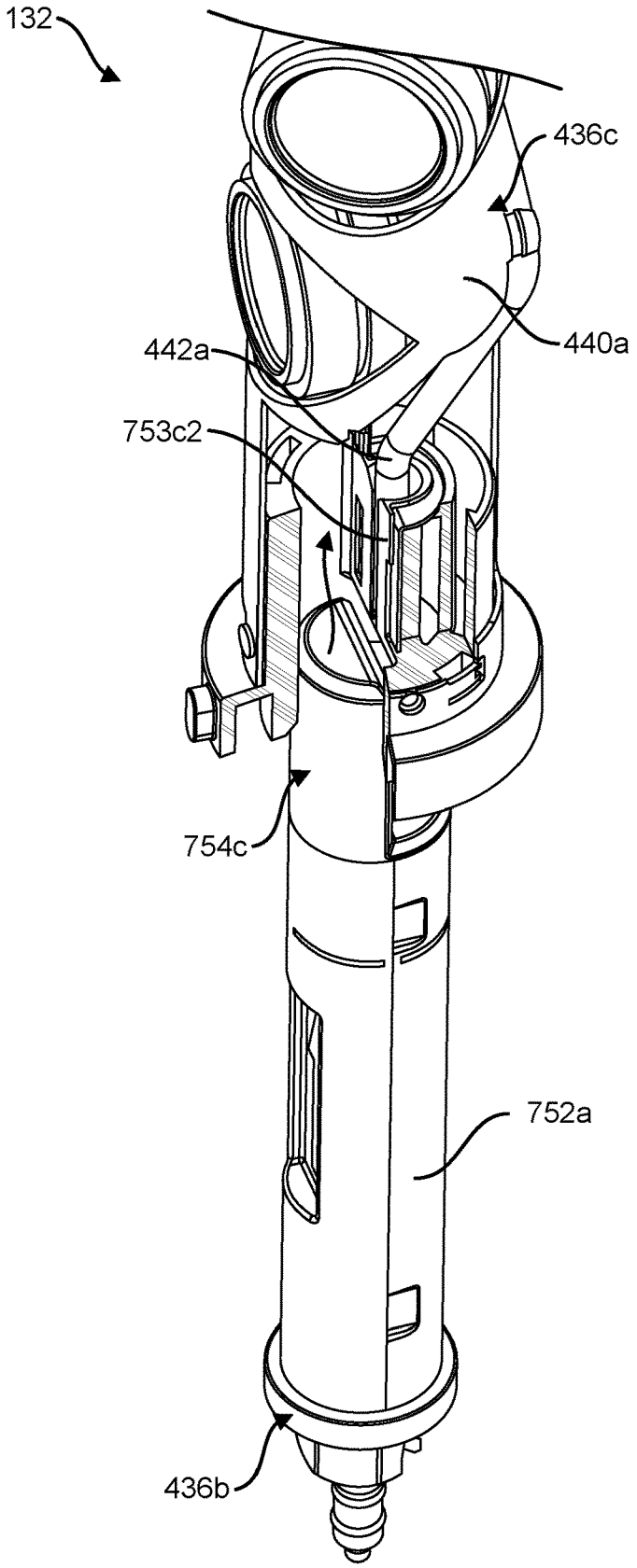
Figure 9:
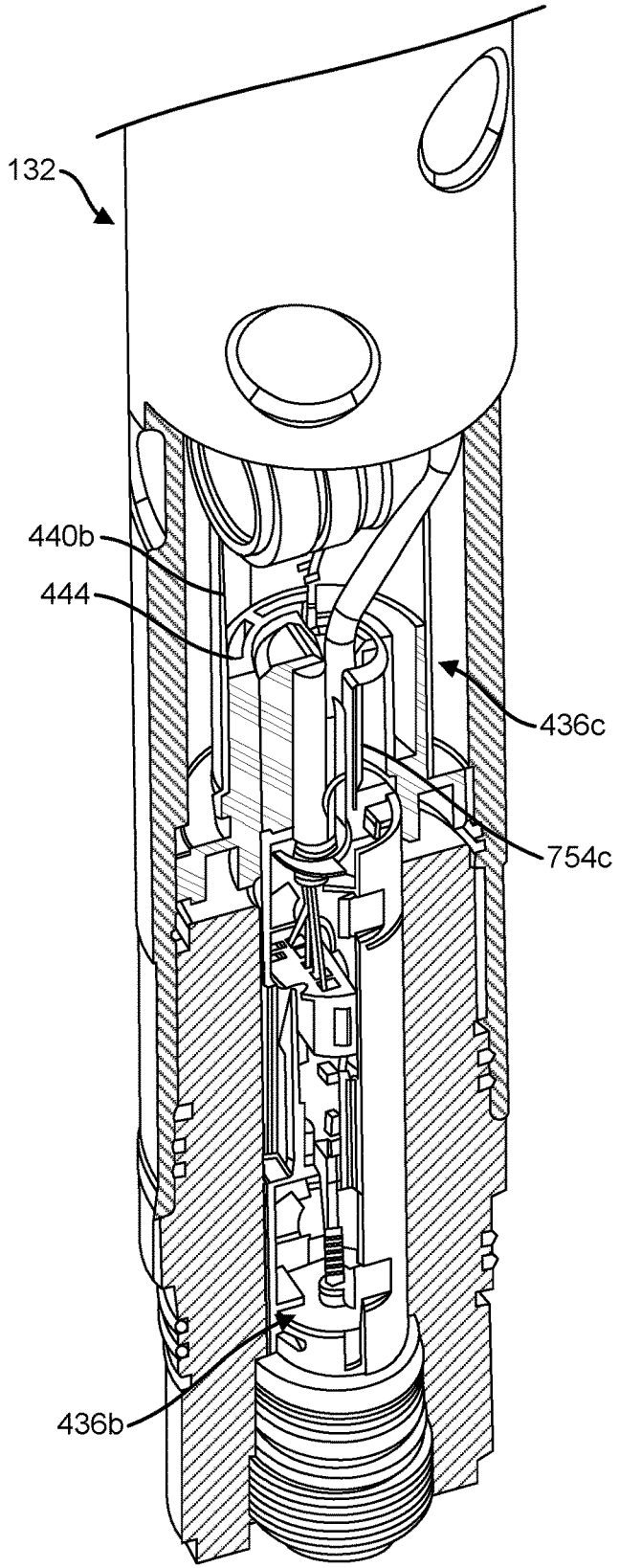
FIG. 9 is another partial cross-sectional view of a portion of the perforating unit and the detonator assembly therein.

As also shown in FIGS. 4B and 6A and in FIGS. 8A-9, the receiver 440*b* is shaped to matingly receive the detonator assembly 436*b*. FIGS. 8A-8C are partial cross-sectional views of the perforating unit 132 depicting a detonation assembly 133 therein. FIG. 9 is another partial cross-sectional view of a portion of the perforating unit 132 and the detonator assembly 133 therein.

As shown in these views, the detonator assembly 436*b* is insertable into the support sub 438*b* and into the end of the charge assembly 436*c*. The receptacle 444 of the receiver may be an offset (e.g., hemispherical) insert placed along an inner surface of the receiver 440*b* with features corresponding with the end of the detonator assembly 436*b*. The receptacle 444 may have, for example, a shape, surfaces, contacts, etc., for receivingly engaging the detonator assembly 436*b* to provide a secure fit for contact and communication therebetween as is described further herein.

Figure 10:
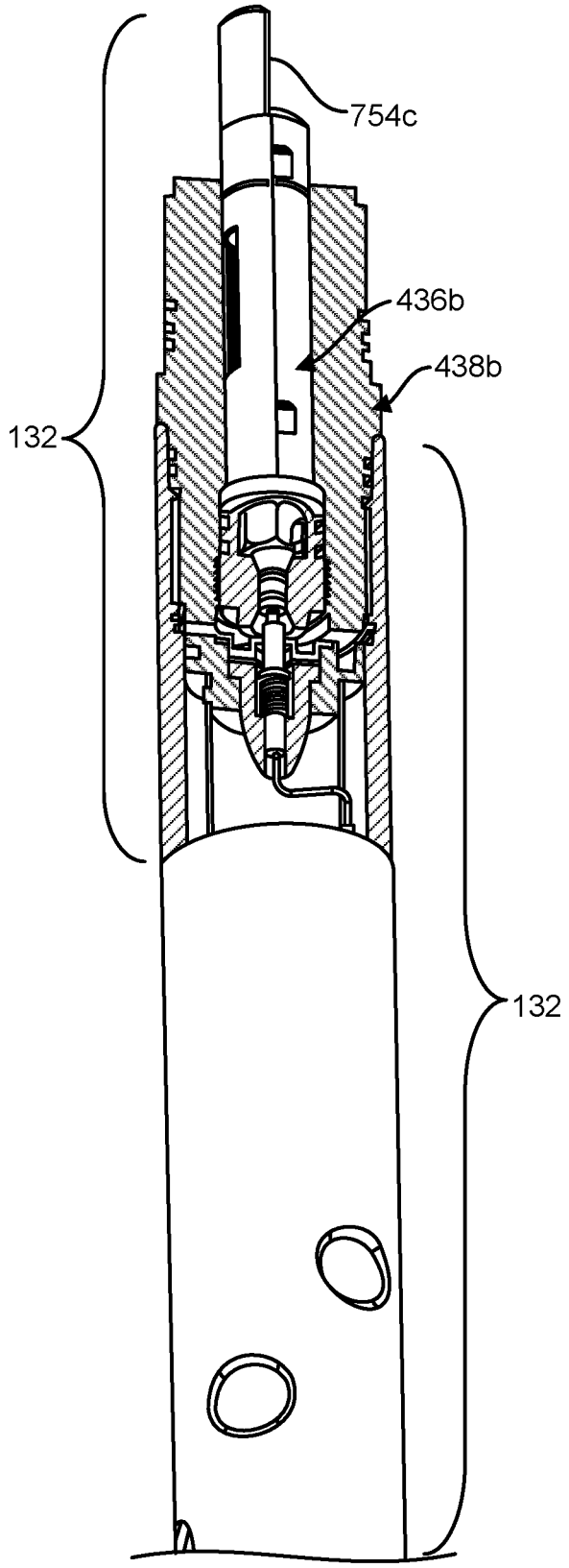
FIG. 10 is a partial cross-sectional view of a portion of the perforating unit connected to an adjacent perforating unit.
Figure 11A:
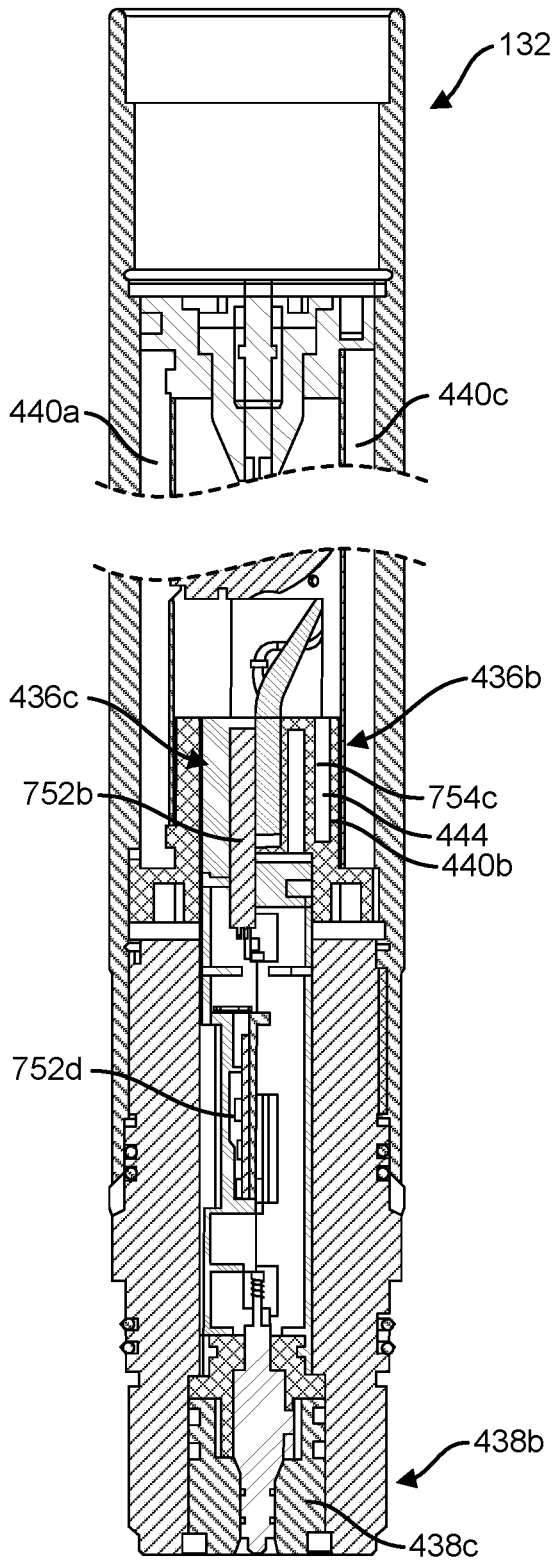
FIGS. 11A and 11B are longitudinal cross-sectional views of the detonator assembly in a seated and an unseated position, respectively, in the perforating unit.
Figure 11B:
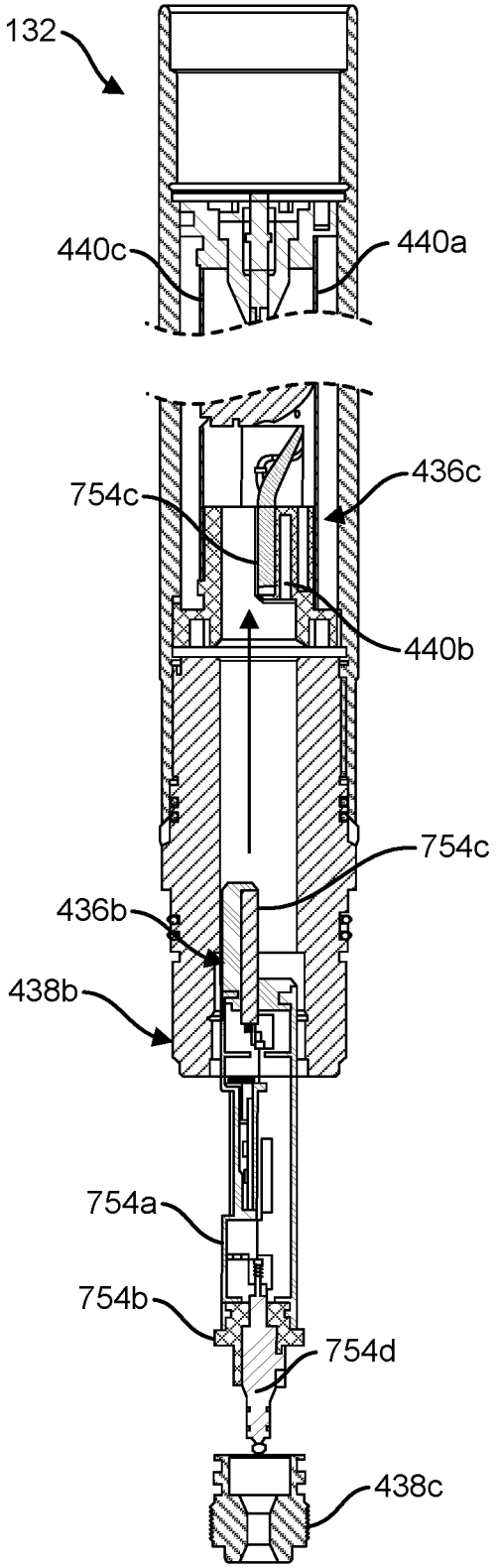
Figure 12:
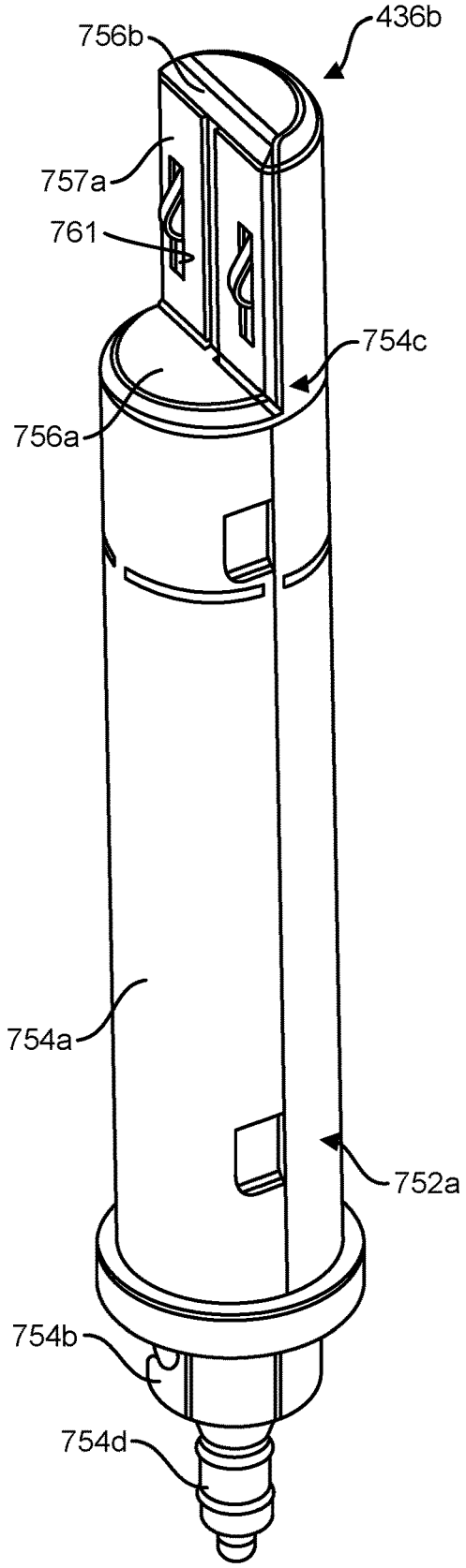
FIG. 12 is a perspective view of the detonator assembly.
Figure 13A:
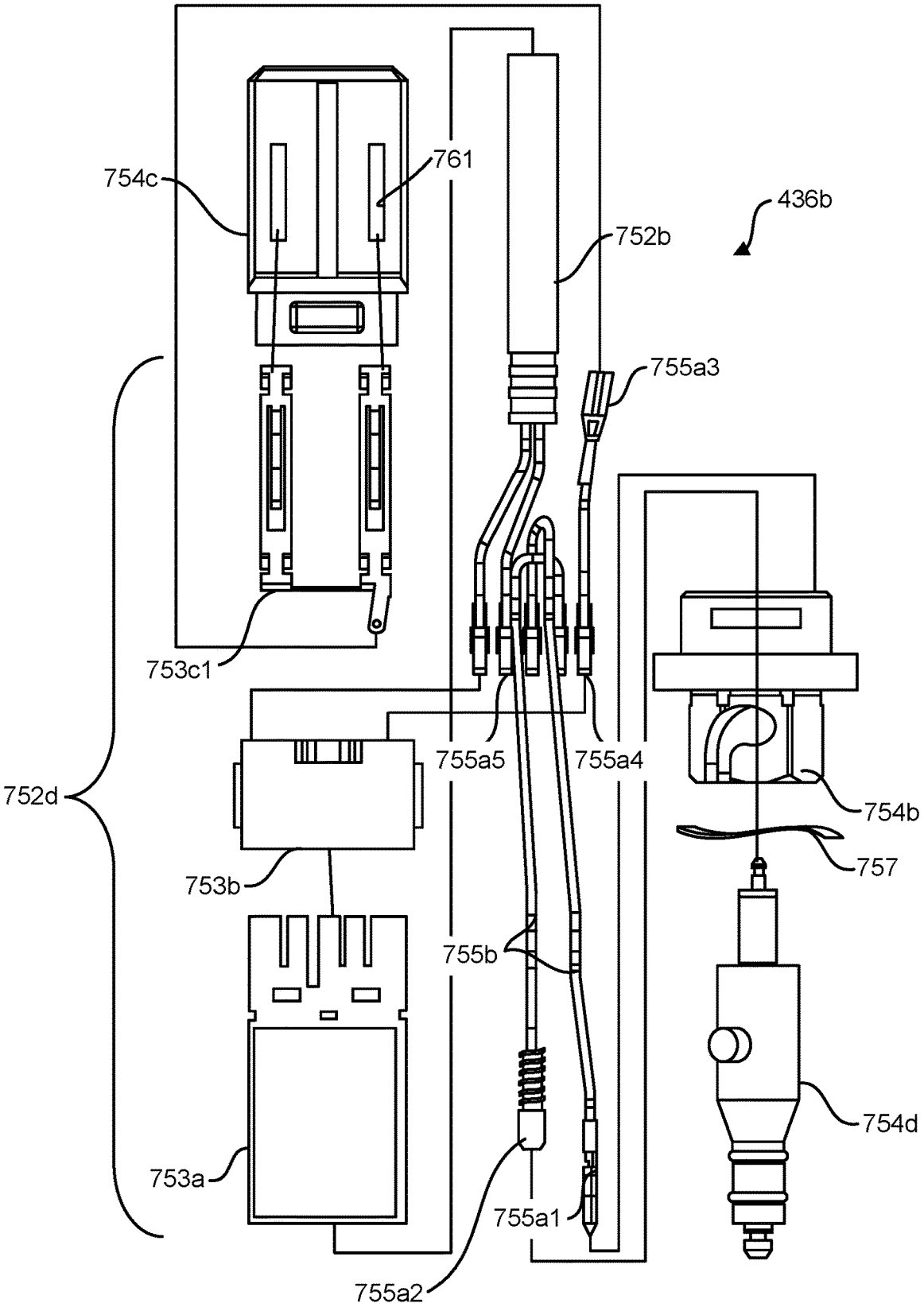
FIGS. 13A-13B are exploded views of the detonator assembly.
Figure 13B:
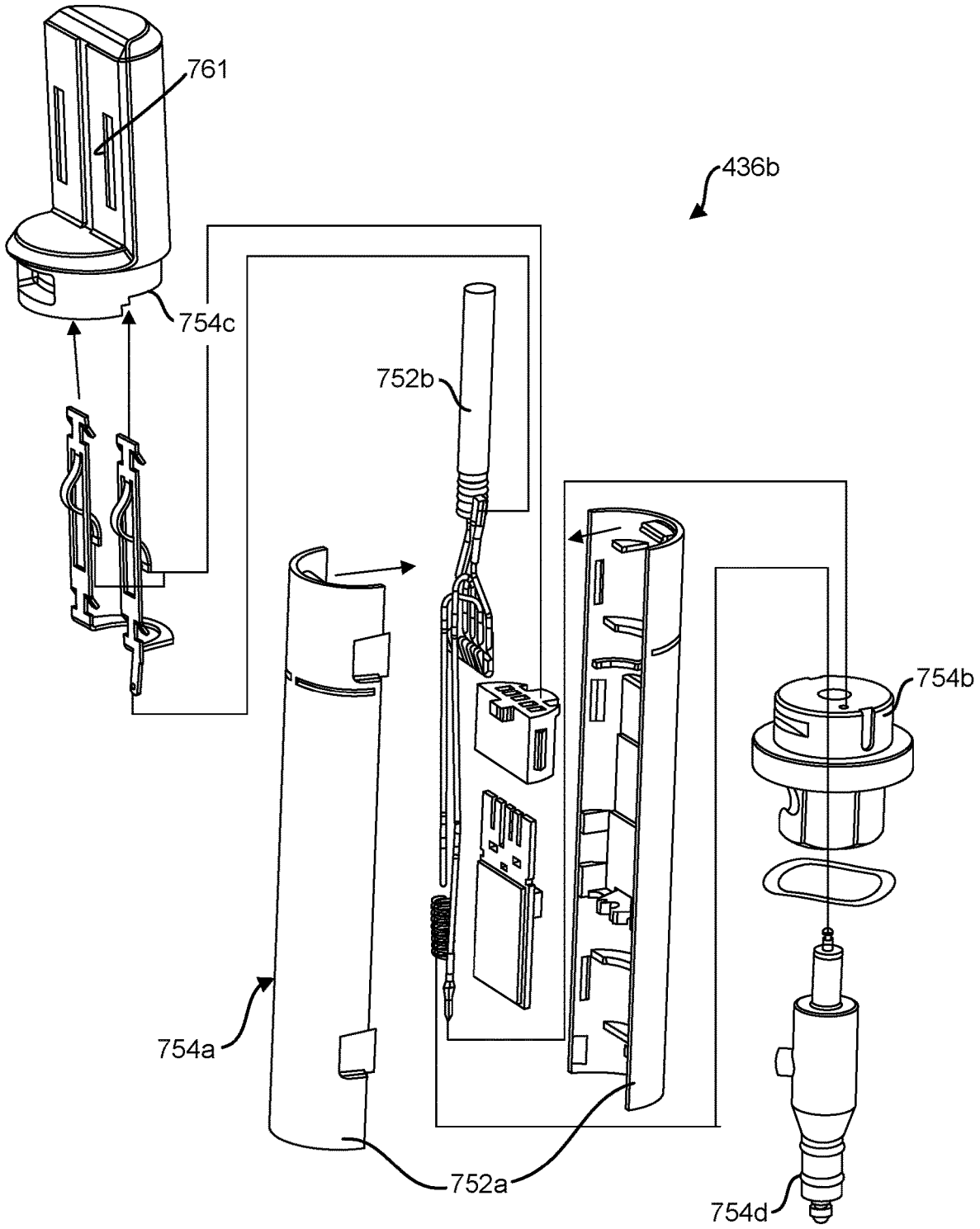

FIGS. 10 and 11A-13B show various views of the perforating unit 132 and the detonator assembly 436*b*. FIG. 10 is a partial cross-sectional view of the perforating unit 132 and the detonator assembly 436*b* therein. FIGS. 11A and 11B show cross-sectional views of the detonator assembly 436*b* in a seated and an unseated position, respectively. FIGS. 12, 13A, and 13B show the detonator assembly 436*b* outside of the perforating unit 132.

As shown in these views, the detonator assembly 436*b* includes a detonator housing 752*a*, a detonator 752*b*, and a switch assembly (or trigger) 752*d*. The detonator assembly 436*b* also includes a tube portions 754*a*, a bulkhead 754*b*, a second connector 754*c*, and a detonator feedthru 754*d*. The detonator housing 752*a* is slidably positionable in the support sub 438*b*. The detonator housing 752*a* may include one or more tube portions 754*a* connectable to form an enclosed chamber 759. The bulkhead 754*b* and the second connector 754*c* are positioned at opposite ends of the detonator housing 752*a* to close each end thereof.

The bulkhead 754*b* is positionable between the detonator housing 752*a* and the retainer 438*c*. A portion of the bulkhead 754*b* is insertable into and threadedly connected to an end of the detonator housing 752*a*. Another portion of the bulkhead 754*b* extends from the detonator housing 752*a* and is insertable into and threadedly connectable to the retainer 438*c*. The bulkhead 754*b* has a passage to receive the detonator feedthru 754*d* therethrough. The bulkhead 754*b* supports the detonator feedthru 754*d* about the end of the detonator assembly 436*b* to form a first connector for connection to the charge assembly 436*c* of an adjacent perforating unit 132.

The detonator feedthru 754*d* is connected by the switch assembly 752*d* to the detonator 752*b*. The switch assembly 752*d* includes a switch 753*a*, a plug 753*b*, and contact 753*c*1. The switch assembly 752*d* also includes connectors 755*a*1-*a*5 and cables 755*b*. The plug 753*b* is seated in the switch 753*a*. The connectors 755*a*1-*a*4 are connected to the switch plug 753*b* via cables 755*b*. The connectors 755*a*1-*a*3 are also connected to the detonator feedthru 754*d*, bulkhead 754*b*, contact 753*c*1, respectively. The connector 755*a*4 is also connected the switch plug 753*b* to the detonator 752*b*. The connectors 755*a*1-*a*4 may take various forms. In the examples shown, the connectors 755*a*1-*a*3 include a pin contact 755*a*1, a spring coupling 755*a*2, and a slotted receptacle 755*a*3 capable of mating with the components and connectable with the cables 755*b* for communication therebetween. The cables 755*b* are provided with connectors 755*a*5 for insertion into the switch plug 753*b*.

As shown in FIGS. 8A-8C, 9A-9B, and 11A-11B, the second connector 754*c* is positioned between the detonator housing 752*a* and the charge tube 440*a*. The second connector 754*c* has a cylindrical portion 756*a* positioned in an end of the detonator housing 752*a* and an insert (e.g., hemispherical) portion 756*b* extending from an end of the detonator housing 752*a*. The hemispherical portion 756*b* extends from the detonator housing 752*a* and is positionable into the charge tube 440*a* for communicative coupling with the receptacle 444 of the receiver 440*b*.

The cylindrical portion 756*a* is shaped to close an end of the detonator housing 752*a*. The hemispherical portion 756*b* is insertable through the support sub 438*b* and into the receiver 440*b*. The hemispherical portion 756*b* is shaped to matingly engage the contact receiver positioned in the charge tube 440*a*. The hemispherical portion 756*b* is also shaped for a one way fit into the charge tube 440*a* for positive alignment therein. The hemispherical portion 756*b* is also provided with a contact surface 757*a* positionable against a corresponding contact surface 757*b* of the receptacle 444.

Figure 14:
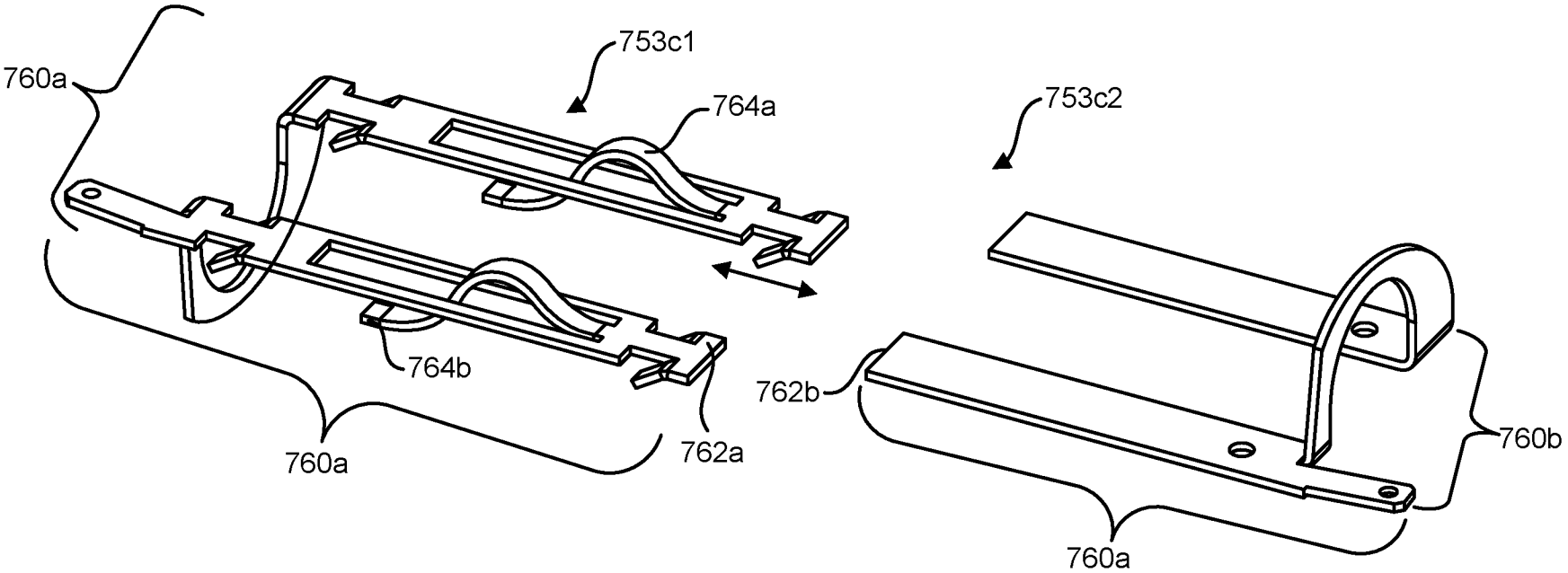
FIG. 14 is an exploded view of a detonator contact and a corresponding charge contact.

The contacts 753*c*1, c2 are shown in greater detail in FIG. 14. The detonation contacts 753*c*1, c2 may include a contact portion 760*a* and a support portion 760*b*. Both portions 760*b* have a curved portion shaped to receivingly engage an outer surface of the detonator 752*b*, with the flat contact portions 760*a* extending from the curved support portions 760*b*. The contact portions 760*a* of each of the contacts 753*c*1, c2 includes a pair of arms 762*a,b* positionable parallel to each other.

Each of the arms 762*a* have elongate cutout portions that are curved about the flat portion. The cutout portions include a curved portion 764*a* and tip portions 764*b*. The curved portions 764*a* are attached at one end from the flat portion and extend therefrom to rise a distance above the flat portion. The tip portions 764*b* extend from the curved portions through an opening defined by cutout of the arms 762*a*, and to a distance below the flat portion.

The contacts 753*c*1, c2 may be of a conductive material (e.g., metal). The arms 762*a* may be compressible against the arms 762*b* of the adjacent support arms 762*b*. When the curved arms 762*a* are compressed against the arms 762*b*, the curved arms 762*a* have a spring force that extends therefrom. The curved arms 762*a* are shaped to extend through openings 761 in the second connector 754*c*.

The detonator contact 753*c*1 is connected at one end to the switch assembly 752*d* and has another end extended into the second connector 754*c*. The detonator 752*b* is supported in the housing between the switch assembly 752*d* and the second connector 754*c*. The detonator 752*b* is supported in the housing 752*a* by the contact 753*c*1. The curved support portion 760*b* is shaped to receive an outer surface of the detonator 752*b*.

Figure 15A:
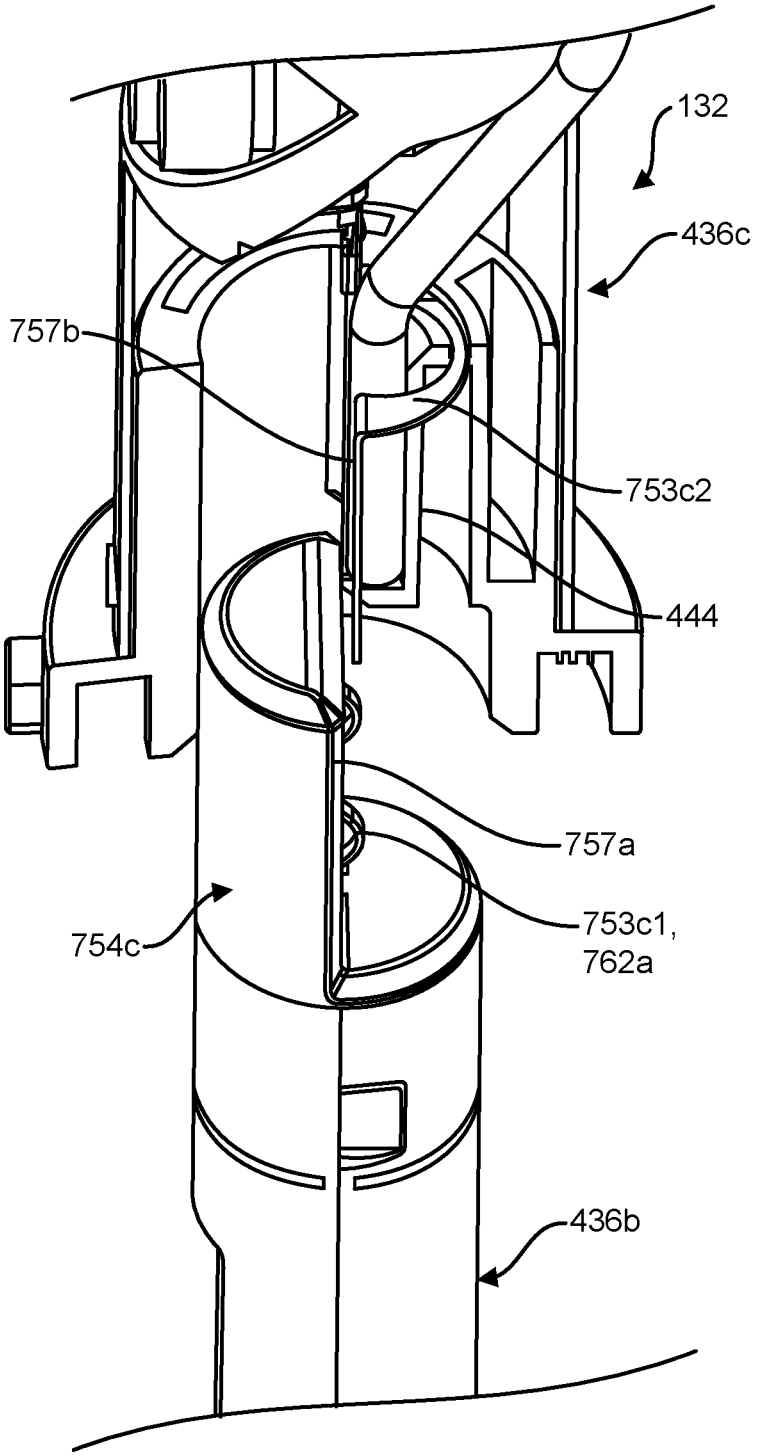
FIGS. 15A and 15B are partial cross-sectional views of the perforating unit with portions removed to show the detonator and charge contacts in a disengaged and an engaged position, respectively.
Figure 15B:
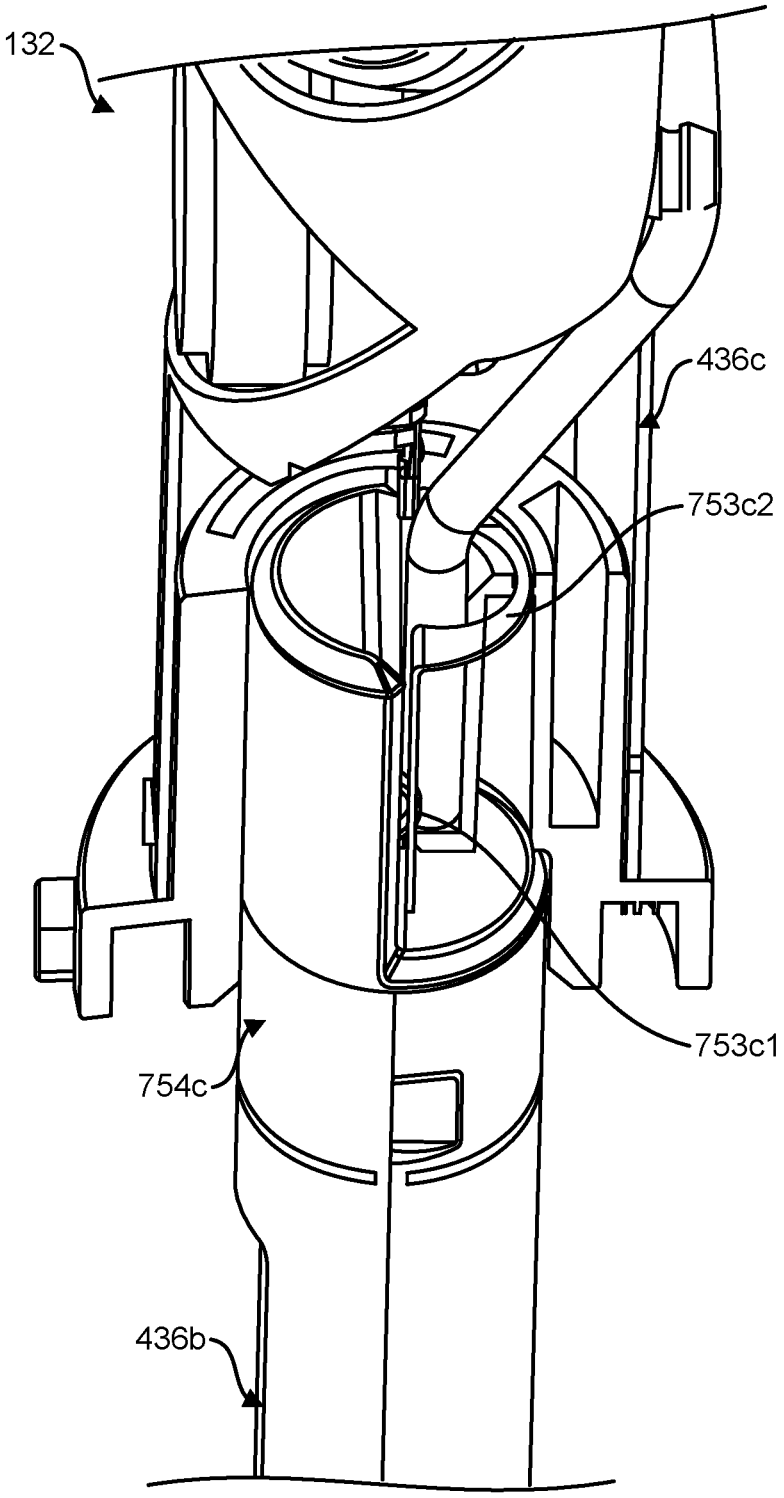

As shown in FIGS. 15A-15B (also seen in 8B-8C, 9-14B), a quick-locking connection is defined between the detonator assembly 436*b* and the charge assembly 436*c*. FIGS. 15A-15B show perforating unit 132 with the detonator assembly 436*b* before and after insertion into the charge assembly 436*c*. For descriptive purposes, portions of the perforating unit 132 have been removed so that engagement of the contacts 753*c*1, c2 may be seen.

When the second connector 754*c* is inserted into the receptacle 444 of the charge assembly 436*c*, the contact surface 757*a* of the second connector 754*c* is positioned adjacent the corresponding contact surface 757*b* of the receptacle 444. The curved arms 762*a* of the detonator contact 753*c*1 extends through the openings 761 for engagement with the charge receptacle 444. The spring force of the curved arms 762*a* urges the detonator contact 753*c*1 into communicative contact with the contact 753*c*2. The spring force may be defined to apply sufficient force to urge contact via the switch assembly 752*d* (FIGS. 13A-13B) to be maintained between the contacts 753*c*1 and 753*c*2.

In operation, a signal is sent from the surface unit 111 (shown in FIG. 1) via the wireline 116 and to the perforating units 132 (shown in FIG. 3). The signal passes through each of the perforation units 132 and to the detonator assemblies 436*b* (shown in FIG. 4B). When an electric communication signal from the surface unit 111 is passed through the downhole tool 118 by communication link 441, the signal is passed to a desired perforating unit 132. The signal identifies the detonator assembly 436*b* for a particular perforating unit 132. Once identified, the switch 753*a* opens enabling power to pass to the detonator 752*b* for that perforating unit 132.

The signal passes through the detonator feedthru 754*d* and the bulkhead 754*b*, and to the switch assembly 752*d* (shown in FIG. 13B). This signal opens the electric switch 753*a*, allowing electrical communication between a surface power supply and the detonator 752*b*. When the power at the surface applies voltage to the detonator 752*b*, the current is drawn and the detonator 752*b* causes the shaped charge to explode. The increased power supply voltage results in a current down the communication link 441. This current initiates a propellant 'within the shaped charge 136, which creates an expanding gas inside. This explosion activates the charge cable 442*a* which causes the shaped charges 136 in the charge tube (shown in FIG. 4B) to explode and creating the perforations 135 (shown in FIG. 1).

Integrated Detonation Assembly

FIGS. 16-22 depict aspects of the perforating units 1632 (with integrated detonation assemblies 1633) usable with the downhole tool 118 of FIGS. 1 and 2. As demonstrated in FIGS. 16-22, the perforating units 1632 may be configured with features to facilitate transport to, and assembly at, any location (e.g., an assembly facility, field locations, and/or a wellsite 100 of FIG. 1). Optionally, parts for the perforating units 1632 may be disposable, thereby eliminating the need to recover parts (and prepare them for reuse) and thereby providing fully disposable components after perforating.

The perforating units 1632 of FIGS. 16-23 may incorporate or be used in combination with features of the perforating units 132 of FIGS. 1-15. The perforating unit 1632 may have similar capabilities as the perforating units 132, and may also have additional capabilities including, but not limited to: transportability assembly at any location, reliable and faster connection, flexible configuration, ability to combine one or more integrated detonator assemblies and/or quick connected detonator assemblies within the downhole tool, automated electrical connection, electrical connection between multiple connected assemblies, disposable parts (i.e., no requirement to reuse parts), multiple contact electrical connectors, orientable connection and/or positioning (e.g., azimuthal orientation), mated connections, locked connections, among other.

Figure 16:
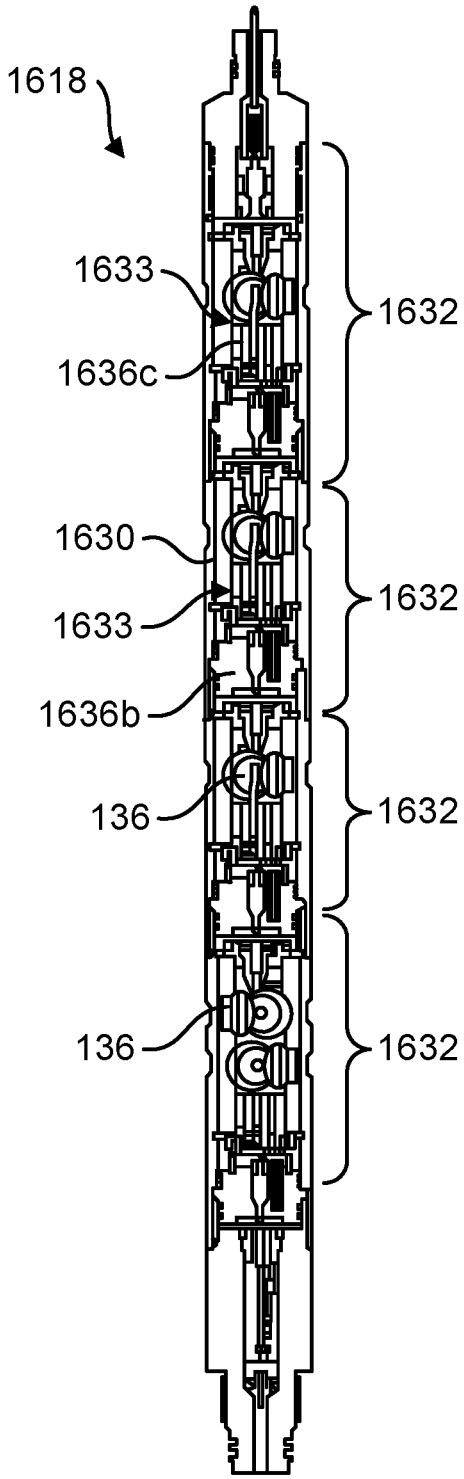
FIG. 16 is a longitudinal, cross-sectional view of a portion of a downhole perforating tool comprising perforating units, each perforating unit comprising an integrated detonation assembly.

FIG. 16 is a longitudinal, cross-sectional view of a portion of the downhole perforating tool 1618 comprising the perforating units 1632. Each of the perforating units 1632 comprise an integrated detonation assembly 1633. The perforating units 1632 are connected end to end in series. Each of the integrated detonation assemblies 1633 includes the detonator assembly 1636*b* and a charge assembly 1636*c* slidably insertable into an outer housing 1630. The integrated detonation assembly 1633 is configured for automatic connection (e.g., mechanical and electrical connection) during assembly as is described further herein.

Figure 17A:
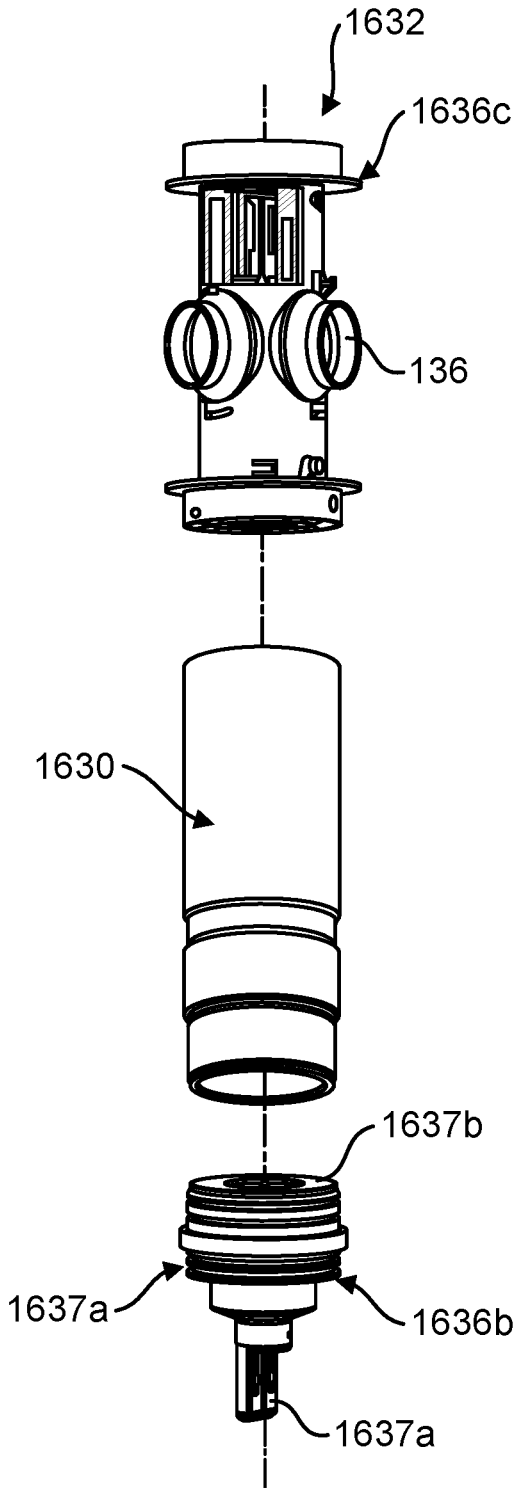
FIGS. 17A and 17B are exploded and partial cross-sectional views of the perforating unit of FIG. 16.
Figure 17B:
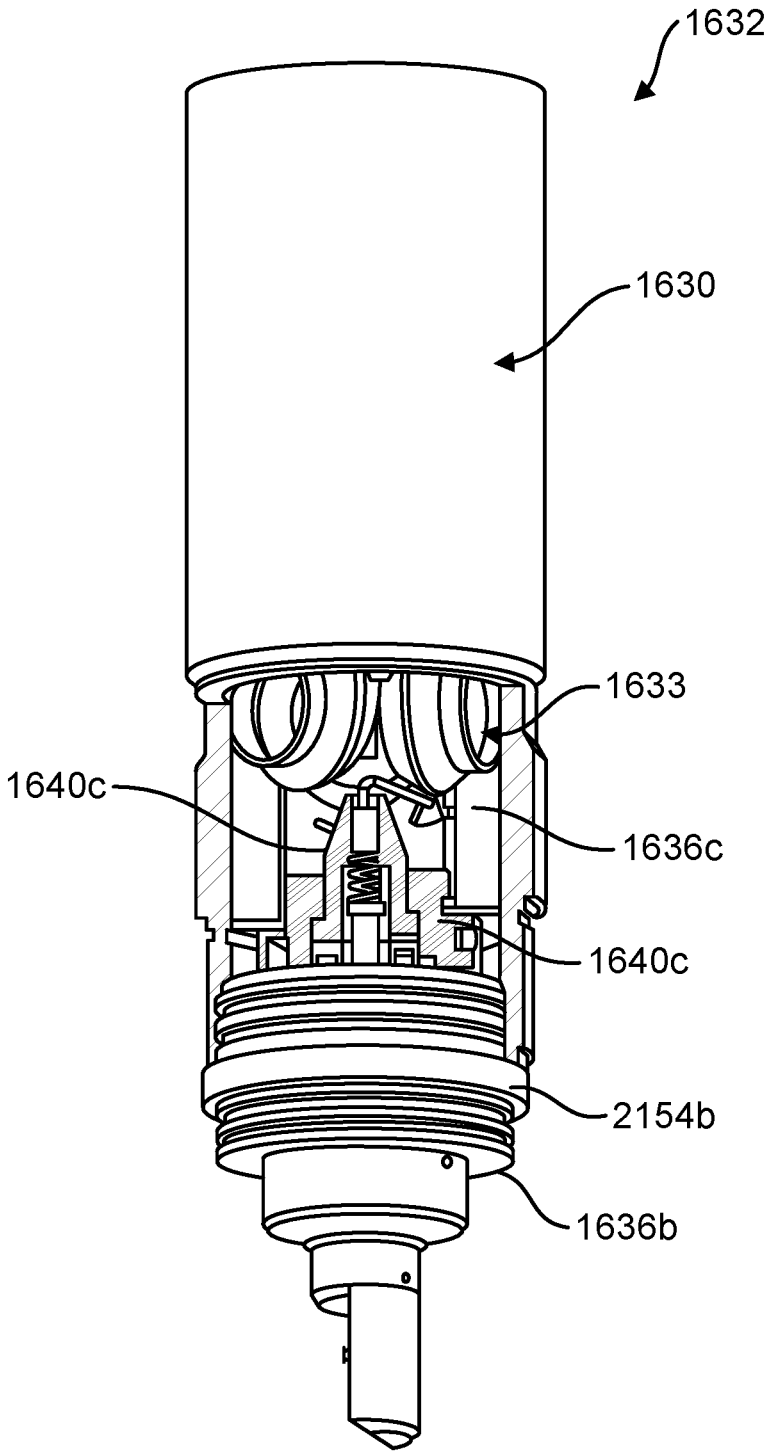
Figure 18A:
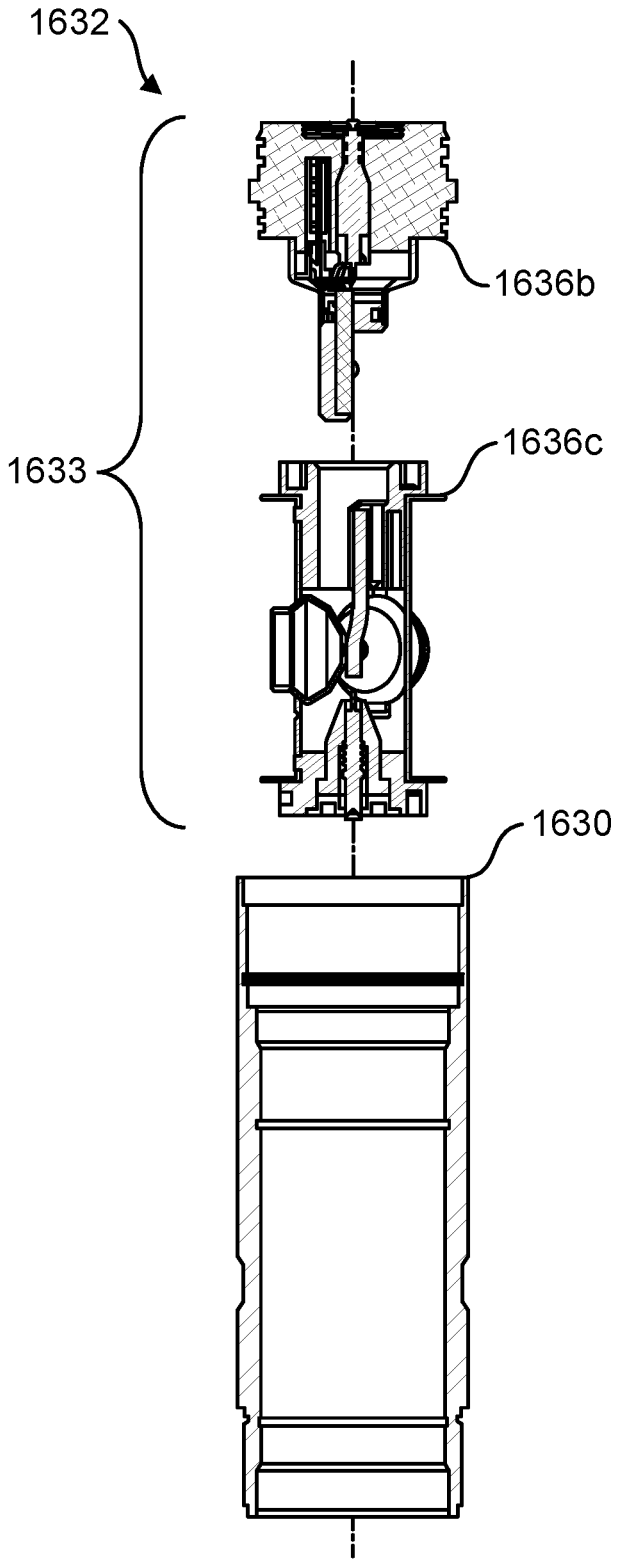
FIGS. 18A-18C are exploded, partially assembled, and longitudinal, cross-sectional views, respectively, of the perforating unit of FIG. 16.
Figure 18B:
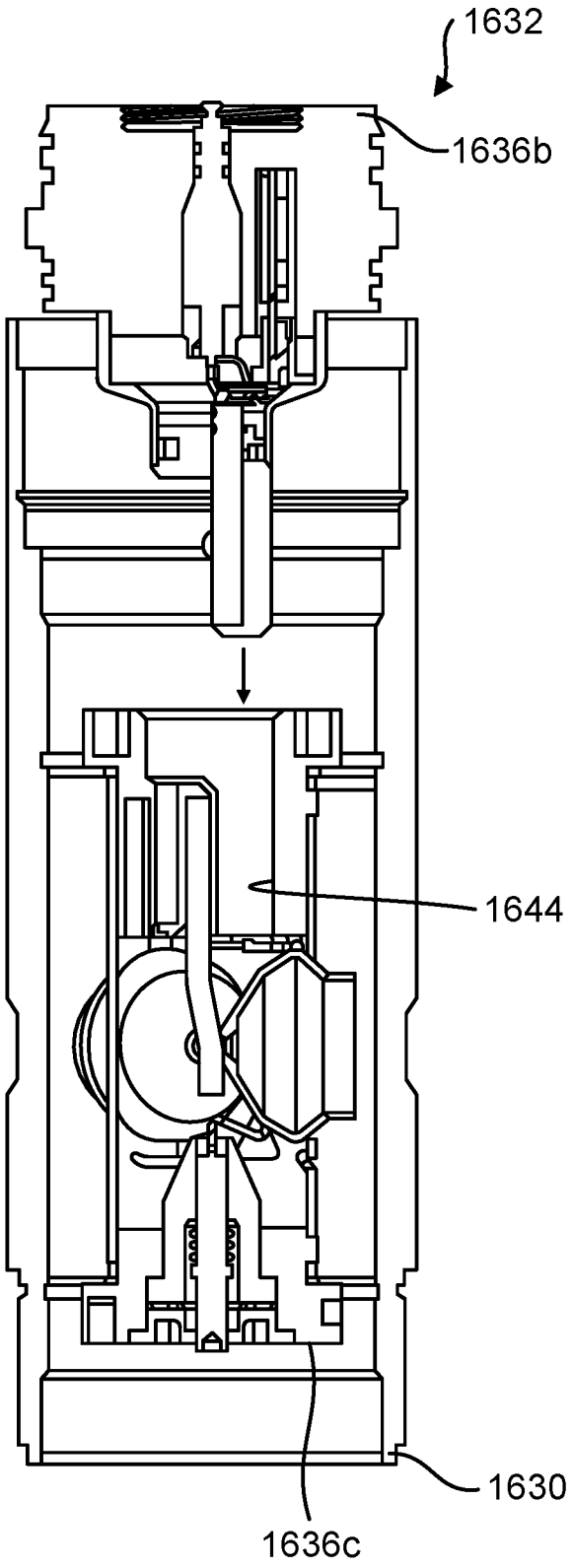
Figure 18C:
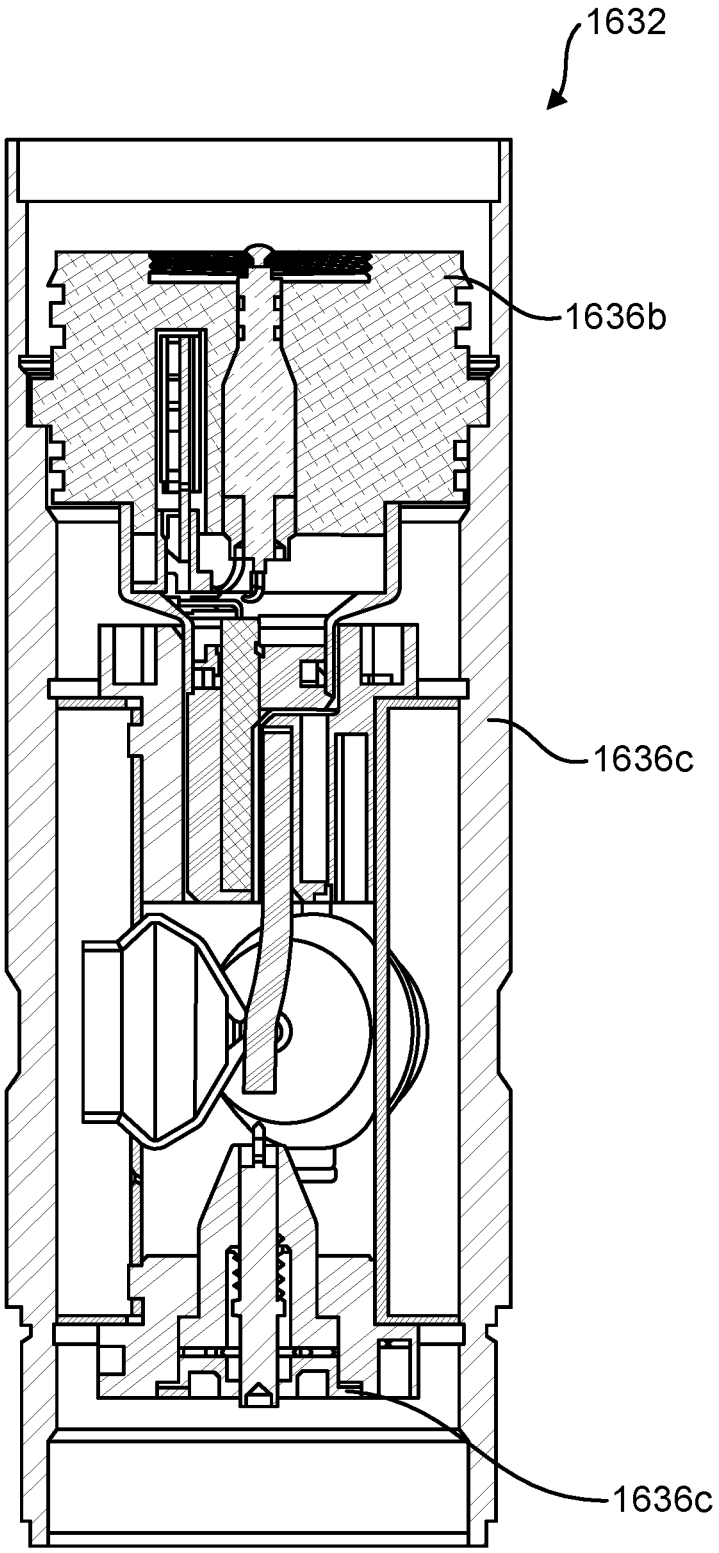
Figure 19A:
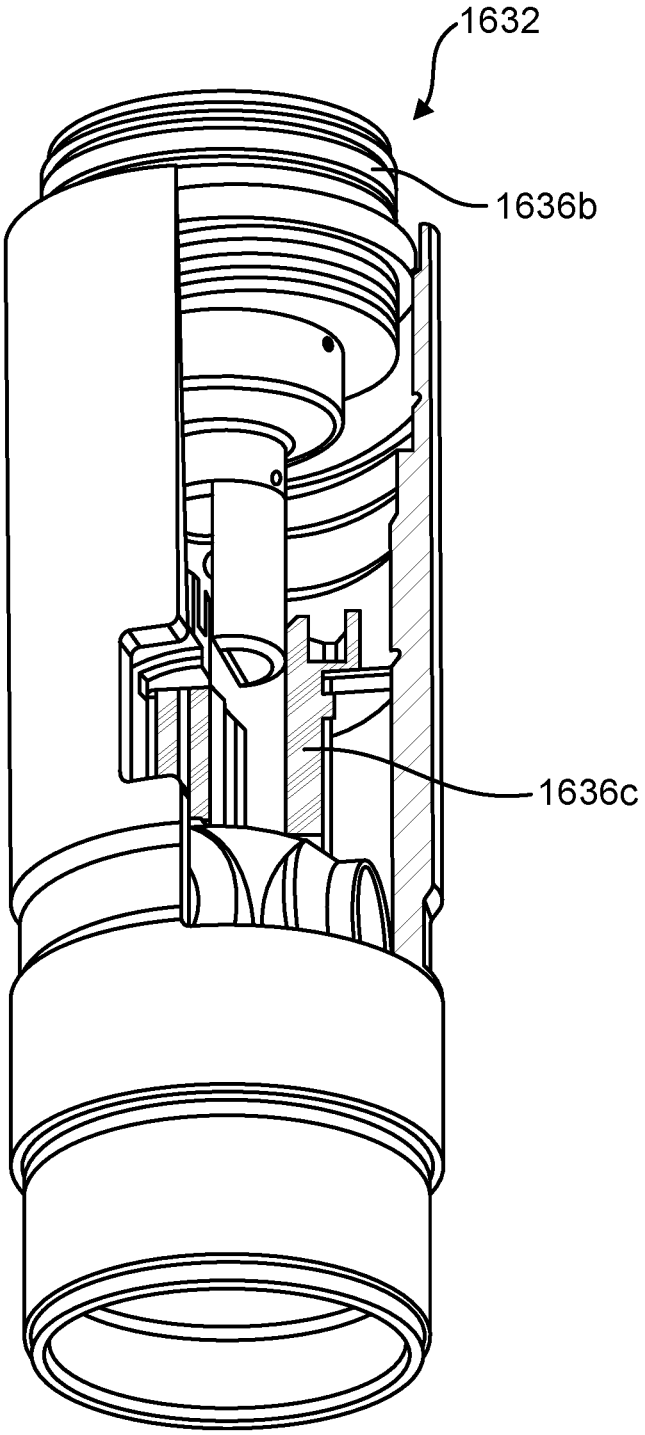
FIGS. 19A-19C are various partial, cross-sectional views of the perforating unit of FIG. 16.
Figure 19B:
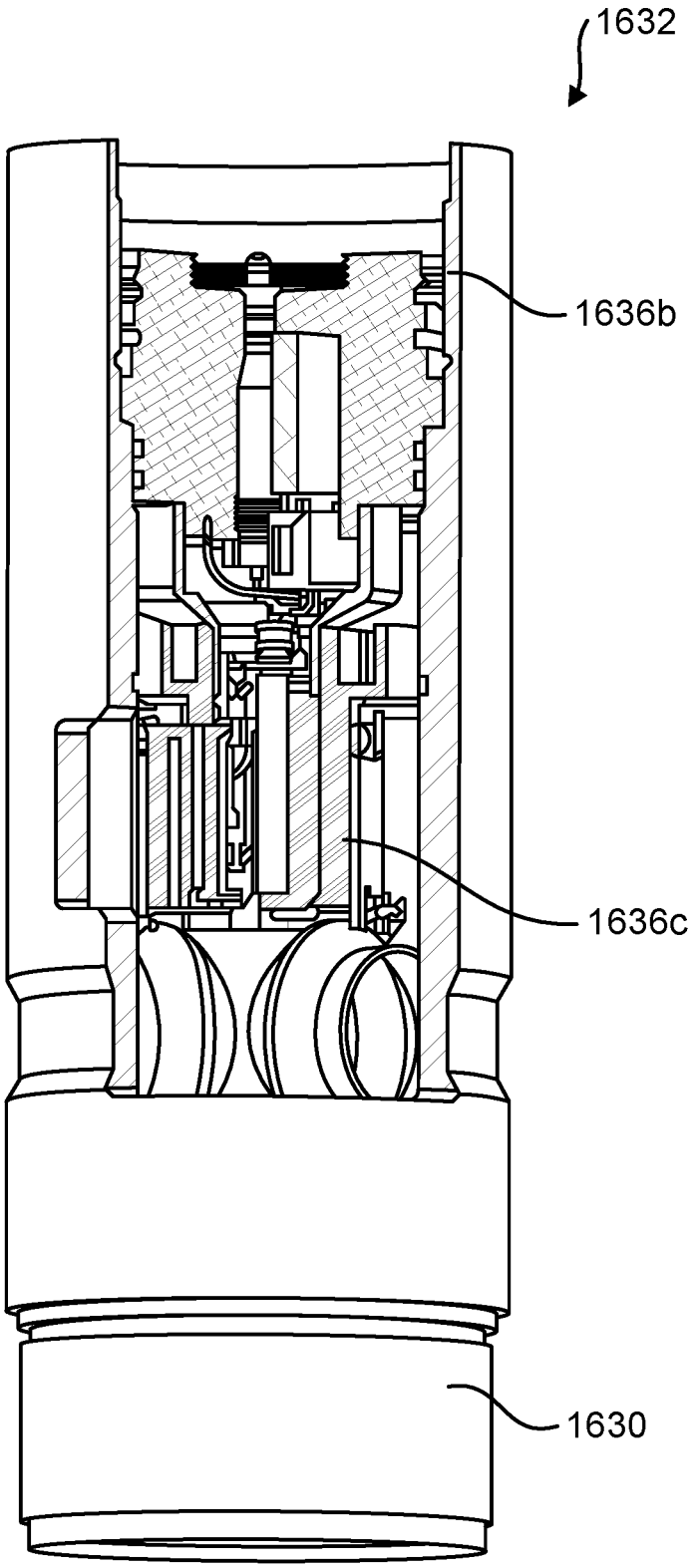
Figure 19C:
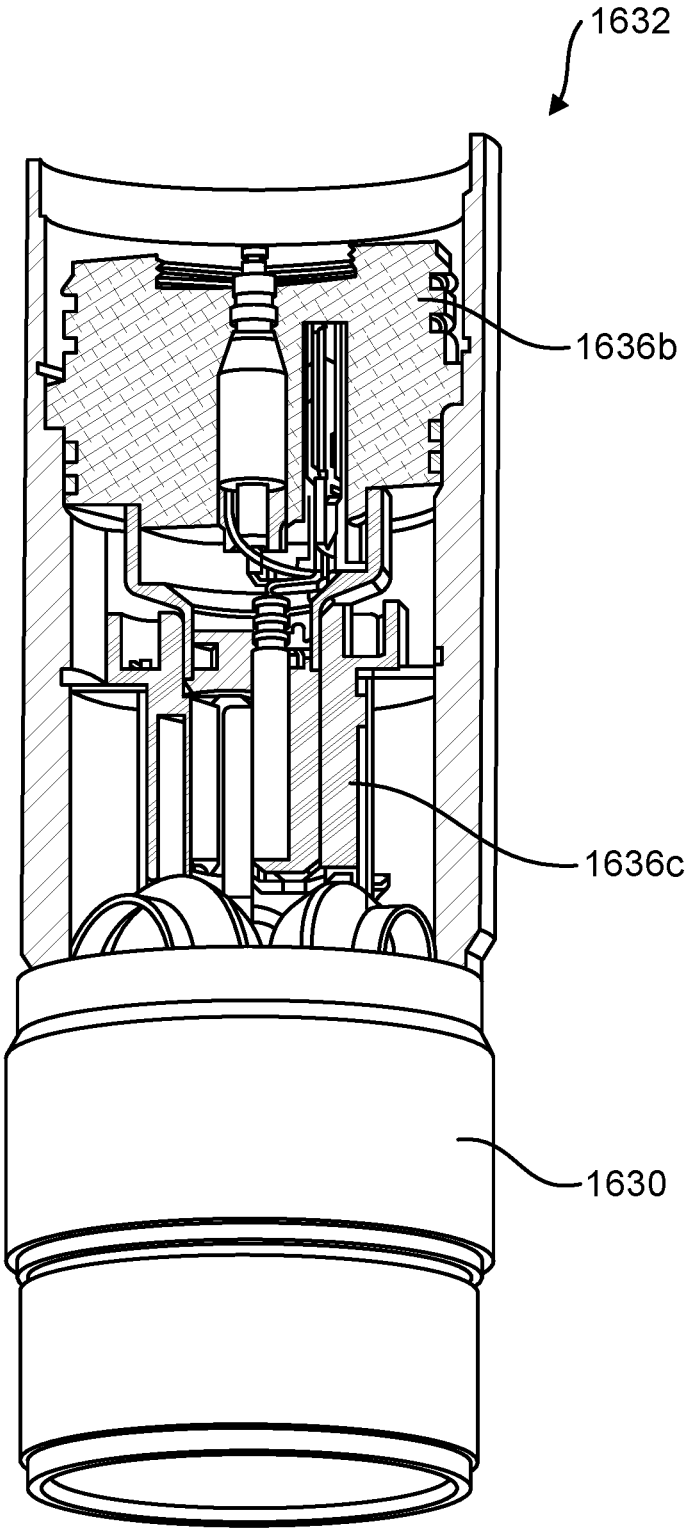

FIGS. 17A-19C show features of one particular embodiment of the perforating units 1632 in greater detail. FIGS. 17A and 17B are exploded and perspective views of the perforating unit 1632 (partially in cross-section). FIGS. 18A-18C are exploded, partially assembled (partially in cross-section), and longitudinal, cross-sectional views, respectively, of the perforating unit 1632. FIGS. 19A-19C are various partial, cross-sectional views of the perforating unit 1632. This version of the perforating unit 1632 is similar to the perforating unit 132 of FIGS. 3-15, except this version has the integrated detonation assembly 1633. The integrated detonation assembly has mated interlocking components secured within the outer housing 1630 in a one-way azimuthal orientation for simplified assembly and reliable connection.

Referring collectively to FIGS. 17A-19C, the perforating unit 1632 may be assembled by inserting the detonator assembly 1636*b* and the charge assembly 1636*c* into the outer housing 1630. During this insertion, the detonator assembly 1636*b* and the charge assembly 1636*c* are positionable for one-way mated connection therebetween to form the integrated detonation assembly 1633. By this connection, the detonator assembly 1636*b* and the charge assembly 1636*c* are orientable within the outer housing 1630 and to each other for communicative connection therebetween.

The outer housing 1630 is a tubular member shaped to receive the integrated detonation assembly 1633 therein. The outer housing 1630 may be provided with connection means (e.g., internal threads) for connection of the outer housing 1630, and to a portion of an adjacent perforating unit 1632. While not shown in this version, additional housings may optionally be provided, such as the outer housing 130 and the outer tube 438*a* of FIGS. 2 and 5. Also, while not shown in FIGS. 16-22, the outer housing 1630 may be provided with openings 443, such as those of FIG. 4A for passing the shaped charges 136 therethrough.

Figure 20A:
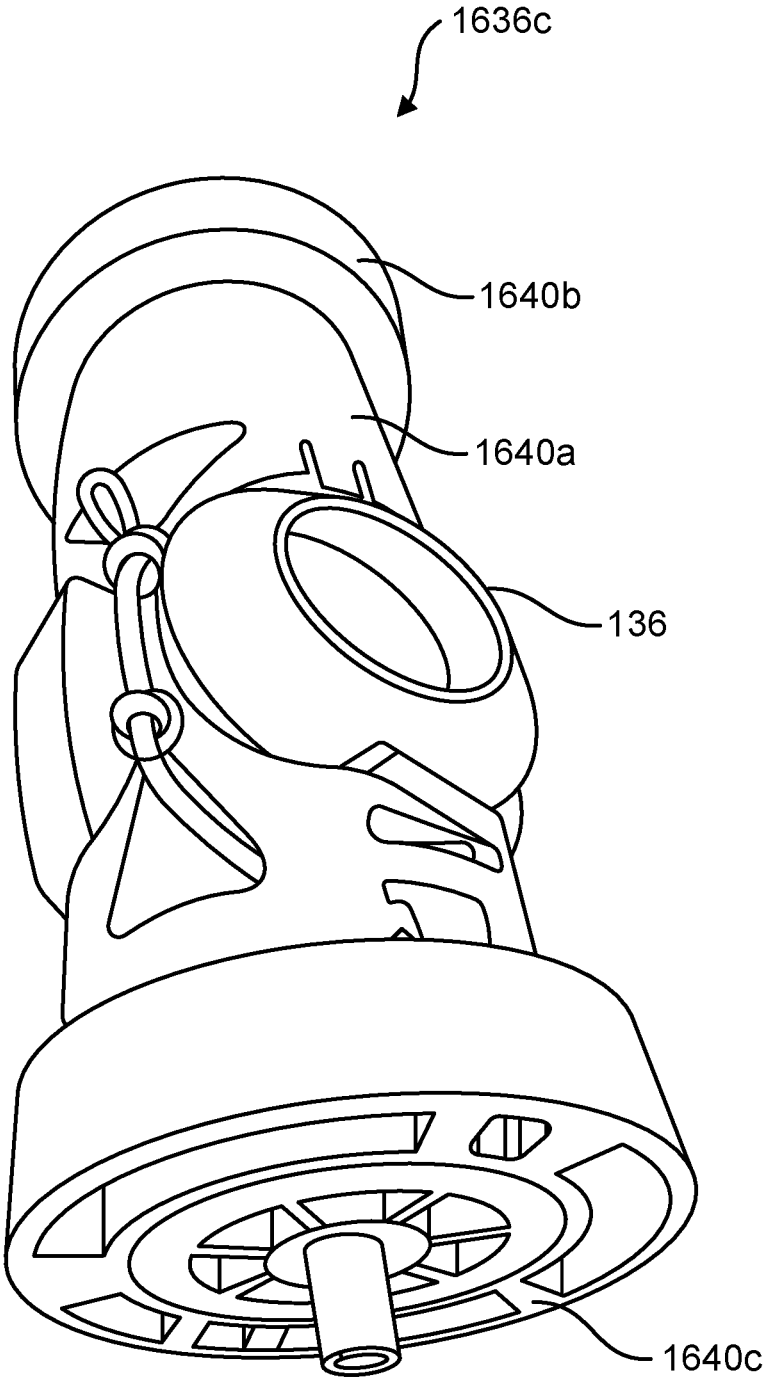
FIGS. 20A-20C are perspective, longitudinal cross-sectional, and exploded views, respectively, of a charge assembly of the perforating unit of FIG. 16.
Figure 20B:
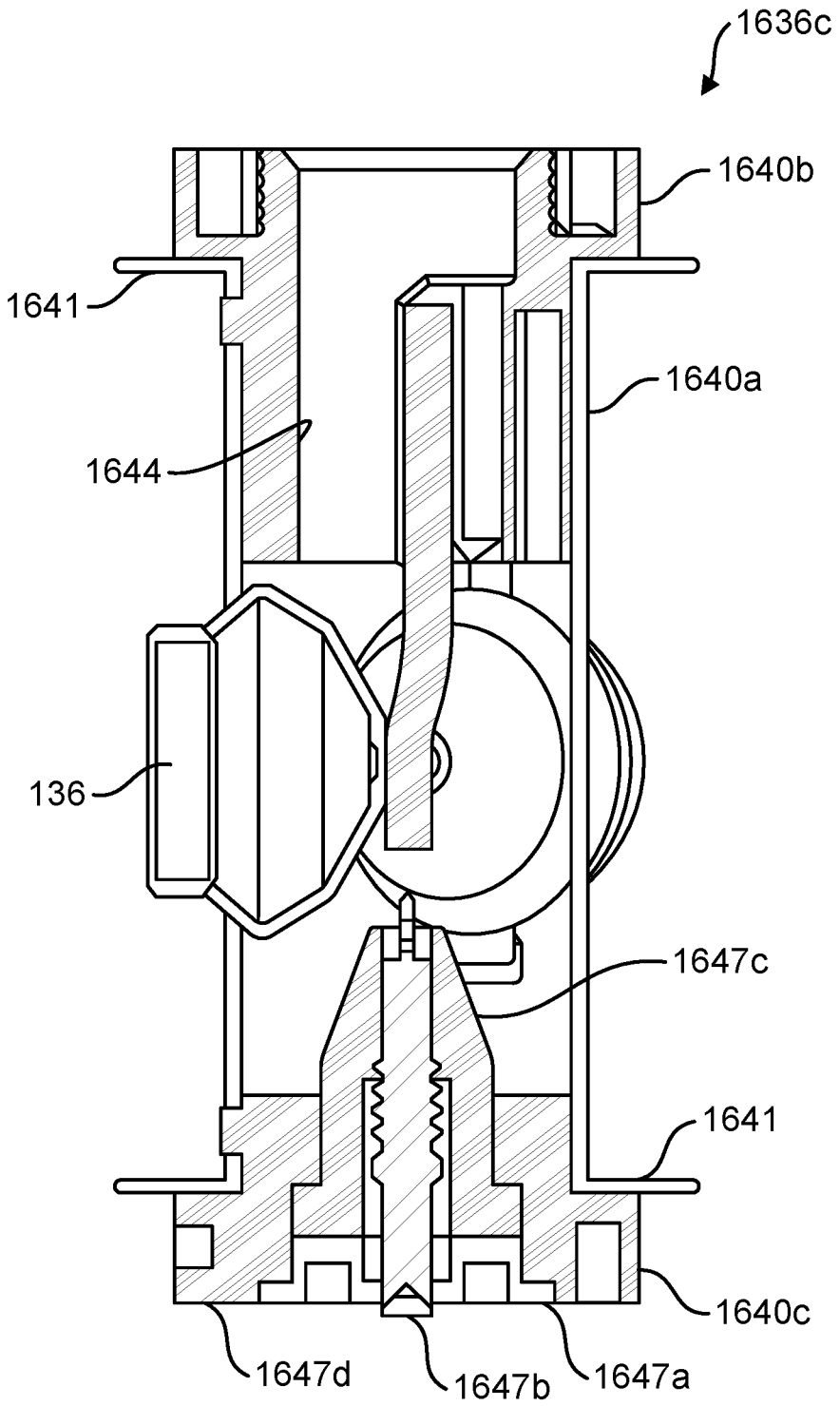
Figure 20C:
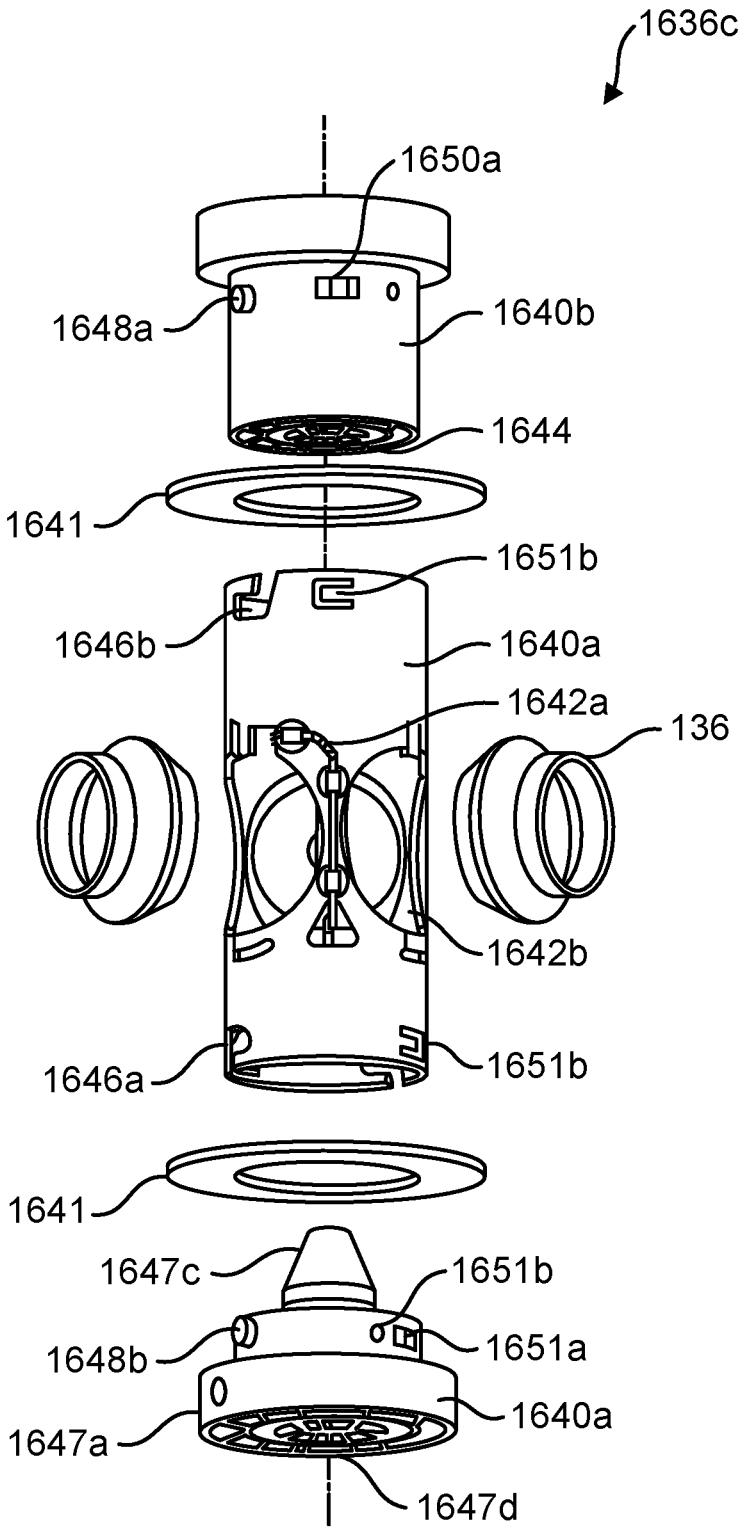

The charge assembly 1636*c* is shown in greater detail in FIGS. 20A-20C. FIGS. 20A-20C are perspective, longitudinal cross-sectional, and exploded views, respectively, of a charge assembly 1636*c* of the perforating unit 1632. The charge assembly 1636*c* may be similar to the charge assembly 436*c* of FIGS. 6A-7. The charge assembly 1636*c* includes a charge tube 1640*a*, a receiver 1640*b*, a charge feedthru 1640*c*, and rings 1641.

The charge tube 1640*a* may be similar to the charge tube 440*a* of FIGS. 6A-6B. In this version, the charge tube 1640*a* is shown as a shorter tube with only three ports 1642*b* therethrough, and with three shaped charges 136 positioned thereabout. However, it will be appreciated that the size and number of ports 1642*b* may vary. The ports 1642*b* extend through the charge tube 1640*a*. The shaped charges 136 are positioned about the ports 1642*b* to fire jets therethrough upon detonation. The shaped charges 136 may be supported about the ports 1642*b* and held in place by bending a tab (not shown). The ports 1642*b* may be alignable with openings in the outer housing 1630 for firing therethrough upon detonation (see, e.g., openings 443 of FIG. 4A).

The receiver 1640*b* and the charge feedthru 1640*c* are insertable into and connected to opposite ends of the charge tube 1640*a*. One of the rings 1641 is positioned between the charge tube 1640*a* and the receiver 1640*b*, and the other ring 1641 is positioned between the charge tube 1640*a* and the receiver 1640*b*. The rings 1641 are supported about the charge tube 1640*a* adjacent to the receiver 1640*b* and the feedthru 1640*c*, and are shaped for sliding insertion into the outer housing 1630 as shown in FIGS. 17A-17C. The rings 1641 may act as a centralizer shaped to support the charge assembly 1636*c* within the outer housing 1630.

As shown in FIG. 20C, the charge tube 1640*a*, the receiver 1640*b*, and the feedthru 1640*c* may have quick-locking features for locking connection and orientation therebetween. In the example shown, the charge tube 1640*a* is provided with guide slots 1646*a,b* at each end shaped to matingly receive keys 1648*a,b* positioned on the receiver 1640*b* and the feedthru 1640*c*, respectively. When inserted into the end of the charge tube 1640*a*, the key 1648*a* of the receiver 1640*b* is slidingly receivable into the guide slot 1646*a*. The receiver 1640*b* may be rotated so that the key 1648*a* passes into the guide slot 1646*a*, thereby positioning the receiver 1640*b* in the desired position while also helping to prevent unintentional retraction of the receiver 1640*b* out of the charge tube 1640*a*. The charge tube 1640*a* may also be provided with locking tabs 1651*a*, fastener holes 1651*b* for receiving the locking tabs 1651*a*, fasteners, and other locking features, such as those described in FIG. 7.

The charge tube 1640*a* also has a charge cable 1642*a* for communication with the shaped charges 136. The charge cable (or detonator cord) 1642*a* may act as a fuse connected to the receiver 1640*b*. The charge cable 1642*a* extends from the receiver 1640*b* through the charge tube 1640*a* and along an outer surface of the charge tube 1640*a*. The charge cable 1642*a* is connected to each of the shaped charges 136 in the charge tube 440*a* for activation thereof. The charge tube 1640*a* is supported within the outer housing 1630 between the two rings (end caps) 1641. The charge tube 1640*a* may be manufactured with clips (not shown) to support the charge cable 1642*a* (and wire 441 of FIG. 4) therethrough. The charge cable 1642*a* may be pushed into the receiver 1640*b* during assembly.

The receiver 1640*b* may have features similar to those of receiver 440*b* of FIGS. 6A-6B. The receiver 1640*b* may be a flange shaped member insertable into an end of the charge tube 1640*a*. The receiver 1640*b* may be shaped to receivingly support the ring 1641 adjacent to the charge tube 1640*a*. The receiver 1640*b* may also be provided with a charge receptacle 1644 therein shaped to receive a portion of the detonator assembly 1636*b* therein for connection and communication with the charge cable 1642.

The charge feedthru 1640*c* may be similar to the charge feedthru described in FIGS. 6A-7. The charge feedthru 1640*c* includes the locking cap 1647*a*, the plunger 1647*b*, the retainer 1647*c*, and the end plate 1647*d* similar to those described in FIG. 7. Optionally, the charge feedthru 1640*c* may also include springs. The charge feedthru 1640*c* may be inserted into and supported about the charge tube 1640*a*. The charge feedthru 1640*c* may also be shaped to receive the ring 1641 for support adjacent to the charge tube 1640*a*. The charge feedthru 1640*c* is shaped for engagement with the detonator assembly 1636*b* for connection and communication therewith. The locking cap 1647*a* may be secured (e.g., bolted to) the detonator assembly 1636*b* of an adjacent integrated detonation assembly 1633 to allow for the connection of a series of integrated detonation assemblies 1633. The plunger 1647*b* is communicatively connected to the detonator assembly 1636*b* of the adjacent integrated detonation assembly 1633 for communication therebetween.

When connected in series, multiple ones of the integrated detonation assemblies 1633 may be communicatively connected to pass signals therethrough for activation of the detonation assembly 1633 to set off the shaped charges 136 as is described further herein. A communication link (e.g., wire 441 of FIG. 4) may extend through the detonation assemblies 1633 of each of the perforating units 1632 (FIG. 16) for selectively activating one or more of the detonator assemblies 1636*b* to fire their respective shaped charges 136. Each integrated detonation assembly 1633 may be provided with connections at each end that are mated to facilitate connection to an adjacent detonation assembly 1633 and to reliably assure communicative connection therebetween or therethrough.

Figure 21A:
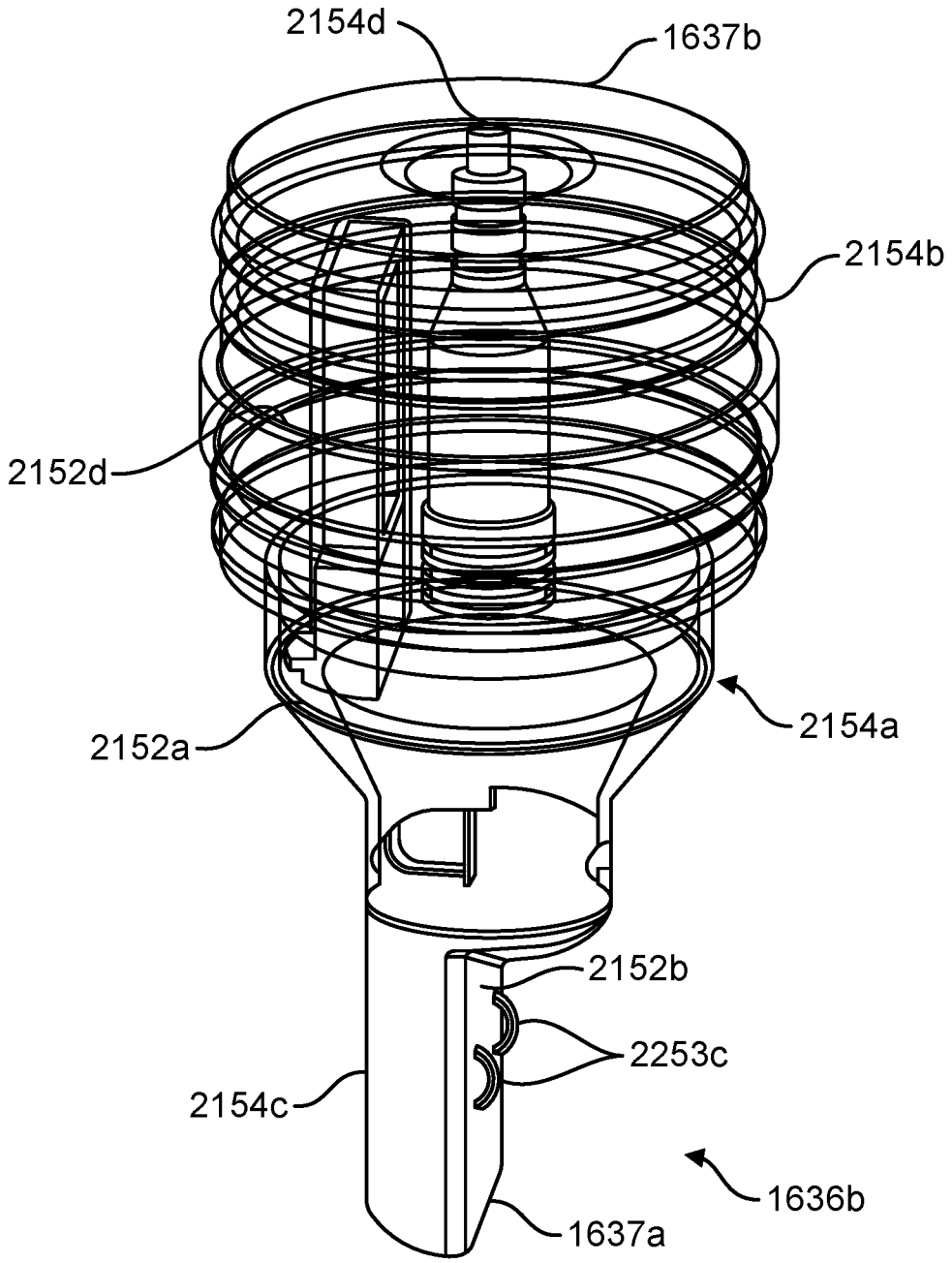
FIGS. 21A-21C are hidden line, perspective view, and end views, respectively, of a detonator assembly of the perforating unit of FIG. 16.
Figure 21B:
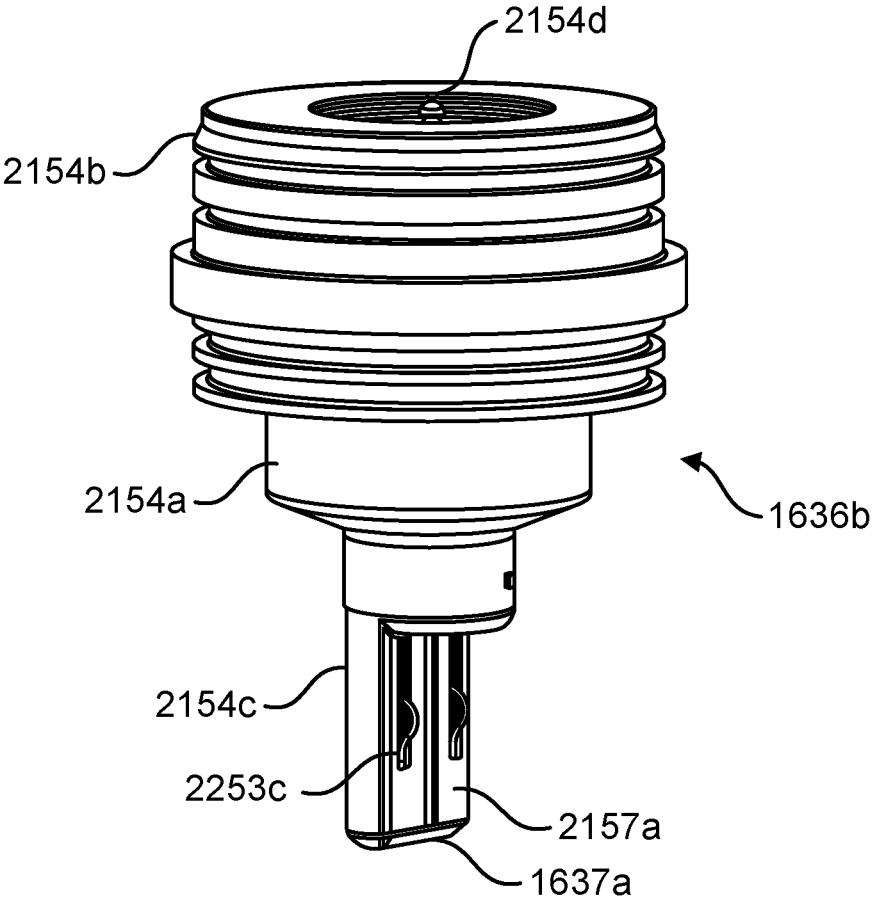
Figure 21C:
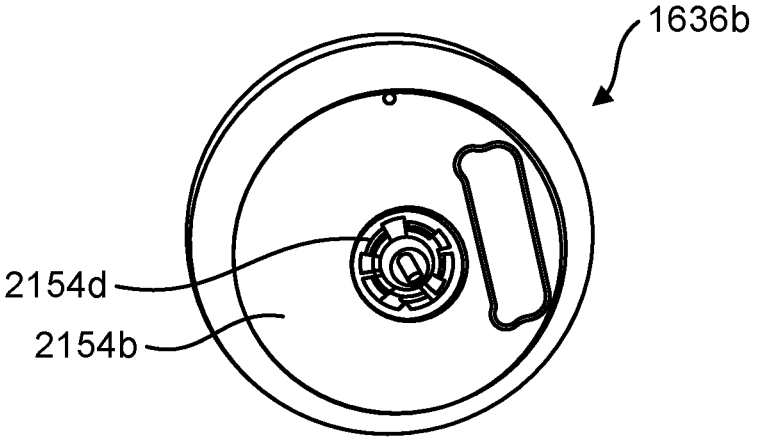
Figure 22:
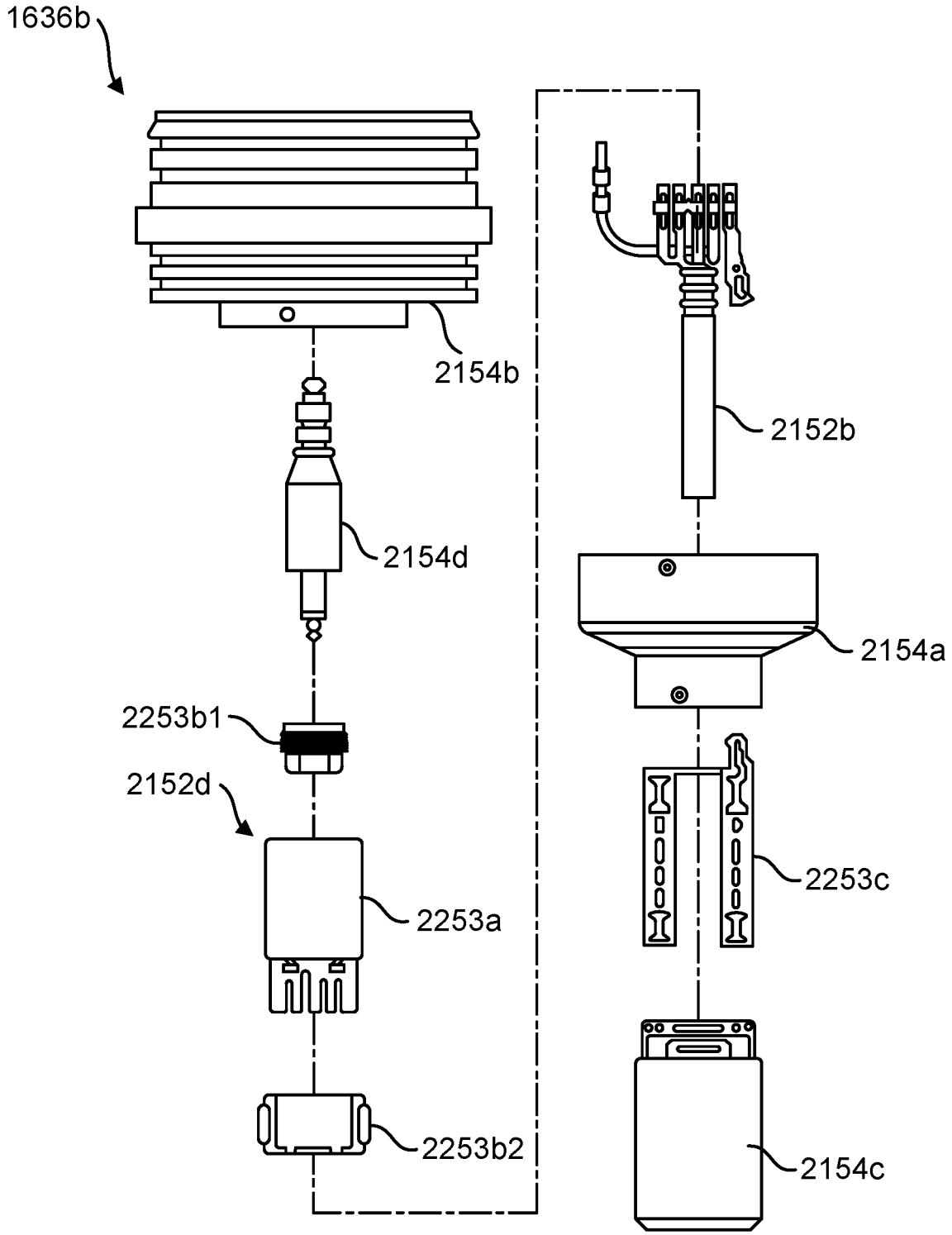
FIG. 22 is an exploded view of the detonator assembly.

Referring collectively to FIGS. 18A-19C and 21B-21C, the detonator assembly 1636*b* is connectable to the outer housing 1630 and shaped for mating and communicative connection to the receiver 1640*b* and the charge feedthru 1640*c*. FIGS. 21A-22 show the detonator assembly 1636*b* in greater detail. FIGS. 21A-21C are hidden line, perspective view, and end views, respectively, of the detonator assembly 1636*b* of the perforating unit 1632. FIG. 22 is an exploded view of the detonator assembly 1636*b*.

As shown in these views, the detonator assembly 1636*b* includes a detonator housing 2154*a*, a bulkhead 2154*b*, a charge (second) connector 2154*c*, a detonator 2152*b*, a switch assembly (or trigger) 2152*d*, and a detonator feedthru 2154*d*. The detonator assembly 1636*b* may be assembled and oriented azimuthally to minimize mechanical shock during the electrical connection therebetween.

The bulkhead 2154*b* is at a charge end 1637*b* of the detonator housing 2152*a* and the charge connector 2154*c* is at the connection end 1637*a* of the detonator housing 2152*a* with the detonator housing 2152*a* therebetween. The detonator feedthru 2154*d* is supported in the bulkhead 2154*b* and the detonator 2152*b* is supported in the charge connector 2154*c* with the switch assembly 2152*d* connected therebetween. The bulkhead 2154*b* acts as a dual contact electrical connector on one side with the centralized detonator feedthru 2154*d* (which acts as an electrical pin) on the other. The bulkhead 2154*b* isolates the gun from pressure created when a shaped charge 136 in a perforating unit 1632 is fired, and maintains contact via the detonator feedthru 2154*d*.

The connection end 1637*a* of the charge connector 2154*c* is insertable into the outer housing 1630 and into the receiver 1640*b* positioned therein (see, e.g., FIG. 18B). The connection end 1637*a* of the charge connector 2154*c* may be shaped for mating insertion into the charge receptacle 1644 of the receiver 1646*b* in a similar manner as the second connector 754*c* of FIG. 12. Upon insertion, the connection end 1637*a* may be threadedly connected to the outer housing 1630. As shown in FIG. 17B, the charge end 1637*b* may be positioned adjacent the charge feedthru 1640*c* and threaded into the outer housing 1630 of an adjacent detonation assembly 1633, thereby connecting two adjacent detonation assemblies 1633. The charge end 1637*b* of the bulkhead 2154*b* is insertable into the outer housing 1630 for engagement with the charge feedthru 1640*c*. As shown in FIG. 21A, the bulkhead 2154*b* supports the detonator feedthru 2154*d* about the charge end 1637*b* of the detonator assembly 1636*b* for communicative connection to the plunger 1647*b* of the charge feedthru 1640*c*.

The detonator feedthru 2154*d* is connected by the switch assembly 2152*d* to the detonator 2152*b*. The switch assembly 2152*d* includes a switch 2253*a*, plugs 2253*b*1, b2, and contact 2253*c*. The plugs 2253*b*1,b2 are seated in the switch 2253*a*. The detonator 2152*b* is connected to the switch 2253*a* by connectors (not shown) for communication thereby, which may have features similar to those of in FIG. 21. At the connection end 1637*a*, the contacts 2253*c* extend through the charge connector 2154*c* for contact and communication with corresponding connectors (not shown) in the receiver 1646*b*. At the charge end 1637*b*, the detonator feedthru 2154*d* extends from the bulkhead 2154*b* for engagement with the plunger 1647*b* of the charge feedthru 1640*c* (FIG. 20B). The switch assembly 2152*d* connects the contacts 2253*c* and the detonator feedthru 2154*d* for communication therebetween.

In operation, a signal is sent from the surface unit 111 (shown in FIG. 1) via the wireline 116 and to the downhole (perforating) tool 118, 1618 (see, FIGS. 3 and 16, respectively).

The signal passes through each of the perforation units 132,1632 and to the detonator assemblies 436*b*, 1636*b* of FIGS. 2-15 and FIGS. 16-22, respectively. When an electric communication signal from the surface unit 111 is passed through the downhole tool 118, 1618 by communication link 441, the signal is passed to a desired perforating unit 132,

1632. The signal identifies the detonator assembly 436*b*, 1636*b* for a particular perforating unit 132, 1632. Once identified, the switch assembly 752*d*, 2252*d* opens enabling power to pass to the detonator 752*b*, 2152*b* for that perforating unit 132, 1632.

The signal passes through the detonator feedthru 754*d*, 2154*d* and the bulkhead 754*b*, 2154*b*, and to the switch assembly 752*d*, 2152*d* (shown in FIG. 13B). This signal opens the electric switch 753*a*, 2253*a*, allowing electrical communication between a surface power supply and the detonator 752*b*, 2152*b*. When the power at the surface applies voltage to the detonator 752*b*, 2152*b*, the current is drawn and the detonator 752*b*, 2152*b* causes the shaped charge 136 to explode. The increased power supply voltage results in a current down the communication link 441. This current initiates a propellant within the shaped charge 136, which creates an expanding gas inside. This explosion activates the charge cable 442*a*, 1642*a* which causes the shaped charges 136 in the charge tube (shown in FIG. 4B, 16) to explode and creating the perforations 135 (shown in FIG. 1).

Figure 23:
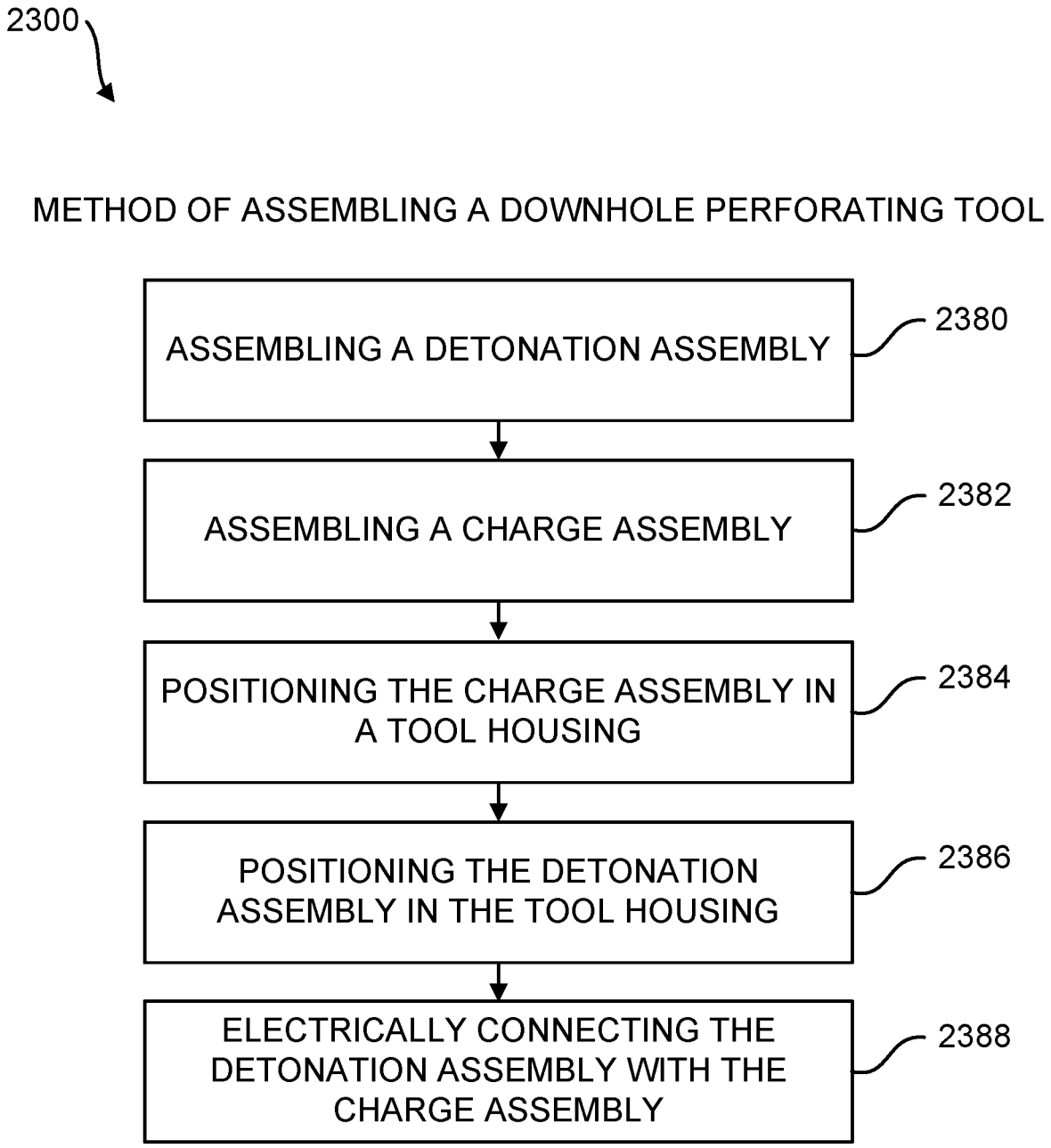
FIG. 23 is a flow chart depicting a method of assembling a downhole perforating tool.

FIG. 23 is a flow chart depicting a method 2300 of assembling a downhole perforating tool, such as those described herein. The method 2300 involves 2380 assembling a detonator assembly; 2382 assembling a charge assembly; 2384 positioning the charge assembly in a tool housing; 2386 positioning the detonator assembly in the tool housing; and 2388 electrically connecting the detonator assembly with the charge assembly.

The method 2300 may involve assembling the detonation assembly by: connecting the bulkhead of the detonator assembly to the outer housing, and connecting the detonator assembly to the charge assembly by inserting the charge assembly in the outer housing while receiving the connection end of the charge connector into the receiver; and then connecting the outer housing to the downhole tool.

Part or all of the assembly may be performed on or offsite from the wellsite.

Portions of the method may be performed in various orders, and part or all may be repeated.

Hybrid Perforating Unit with Shaped Charges and Propellant Charges

This disclosure also relates to a downhole tool and/or downhole perforating unit with propellant charge(s). The downhole tool may include one or more hybrid perforating units for perforating the wellbore (see, e.g., FIG. 1). The downhole tool may also include other perforating units, such as the perforating unit 132 described herein (also referred to herein as the shaped charge perforating unit). The hybrid perforating units may include a charge tube that supports and detonates shaped charges and propellant charges.

The shaped charges and propellant charges may be used to facilitate the flow of fluid from the wellbore and into the formation during injection operations. The shaped charges may be fired from the charge tube and into the formation to form perforations in the wall of the wellbore, thereby creating passageways for injecting fluid to flow through the perforations and into the formation. The propellant charge(s) may be detonated to generate fracture pressure that passes from the downhole tool and into the perforations. This fracture pressure may be sufficient to create micro-fractures in the formation surrounding the perforations, thereby enhancing (e.g., increasing, extending, expanding, etc.) the perforations and further facilitating the flow of injection fluid into the formation.

The propellant charges may have the same or different configuration (e.g., shape, structure, materials, jacket, etc.) as the shaped charges depending on operational needs (e.g., placement in the charge tube, spacing, operation, simplified manufacture, retrofit to shaped charge cavities in charge tubes, etc.). The propellant charges may contain a propellant material having a high volatility (e.g., an aviation or jet fuel) having desired parameters (e.g., timing, speed, etc.) capable of generating the fracture pressure necessary to fracture the perforations.

The shaped charges and propellant charges may be positioned in the downhole tool in a manner that facilitates operations. The shaped charges may be positioned along a horizontal perforating plane, and the propellant charges may be positioned along a horizontal pressure plane that is a distance from the horizontal perforating plane. By separating the perforating plane from the pressure plane, multiple shaped charges may be placed along the same perforating plane for perforation in multiple directions, and larger volume propellant charges may be used in the pressure plane to increase the amount of fracture pressure generated. Multiple perforating and/or pressure planes may be provided within the same charge tube.

The hybrid perforating units, the shaped charges, and the propellant charges are intended to provide one or more of the following capabilities: to facilitate injection capabilities; to enhance perforating operations; to enable flexibility in selecting propellant perforation dimensions; to extend the fractures formed by the propellant perforations; to allow the use of propellant charges and shaped charges in the same charge tube, perforating unit, and/or downhole tool; to allow perforation along multiple planes and/or multiple directions; to facilitate perforating of the wellbore; to facilitate fracturing of the formation; etc.

Figure 24A:
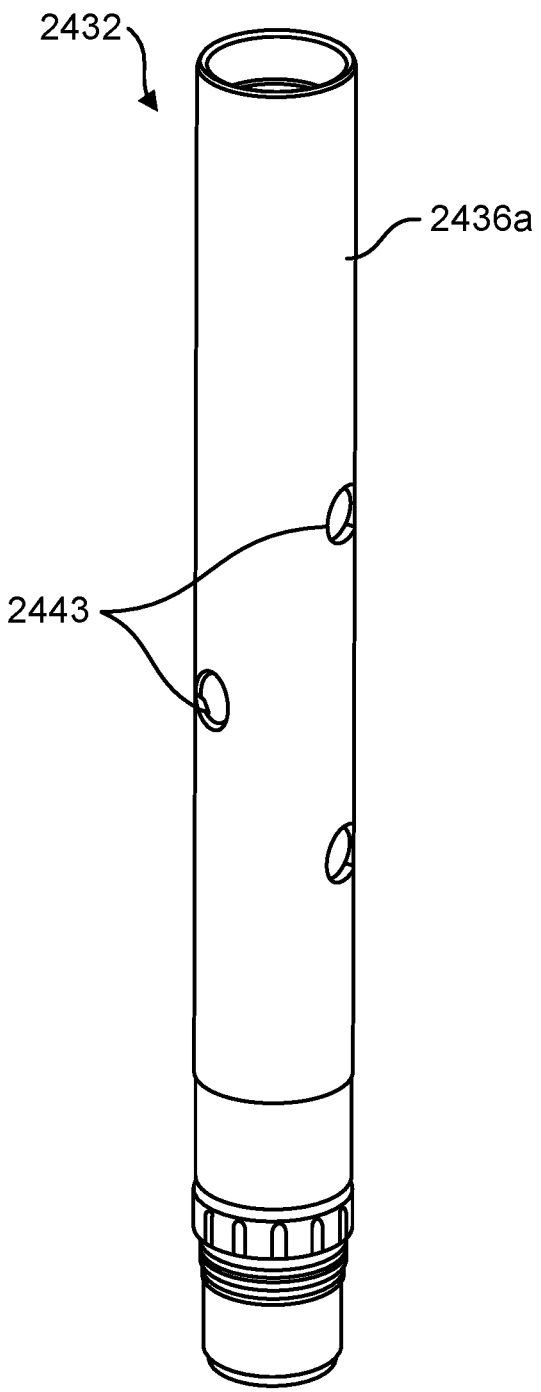
FIGS. 24A-24B are perspective and longitudinal, cross-sectional views, respectively, of a hybrid perforating unit including a hybrid charge assembly with shaped charges and propellant charges.
Figure 24B:
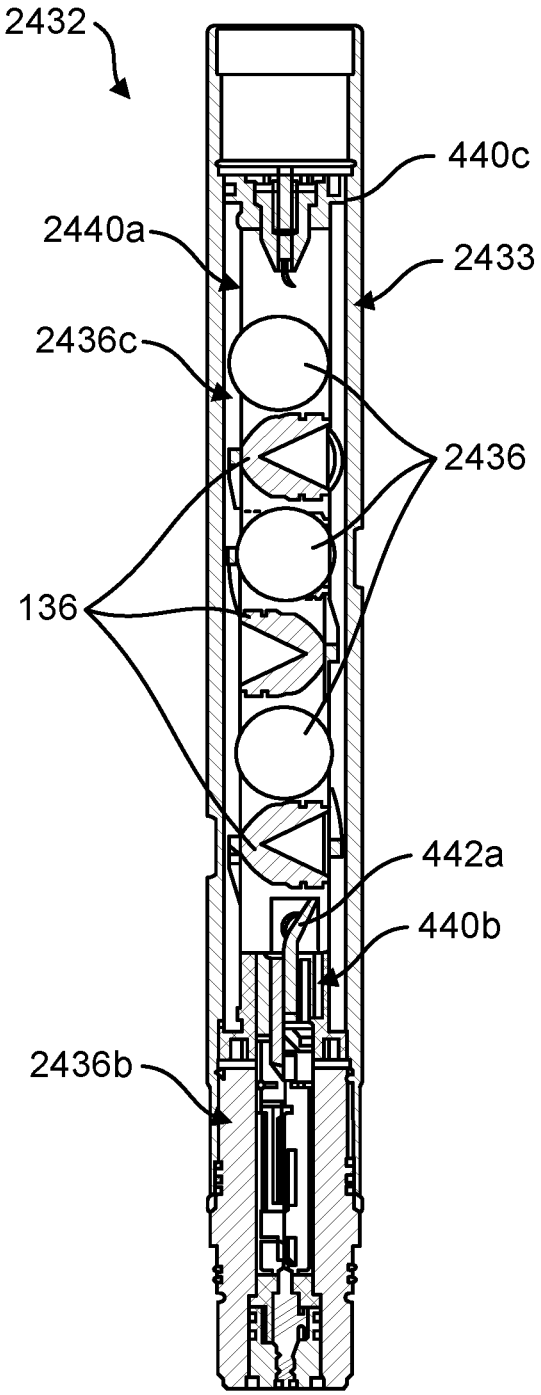

FIGS. 24A-24B are perspective and longitudinal, cross-sectional views of the hybrid perforating unit 2432. The hybrid perforating unit 2432 may incorporate or be used in combination with features of the perforating units 132 of FIGS. 1-15 and/or the perforating units 1632 of FIGS. 16-23. The hybrid perforating unit 2432 may include a hybrid charge assembly 2436*c* with the shaped charges 136 and the propellant charges 2436. The hybrid perforating units 2432 may be configured for perforating using one or more of the shaped charges 136 and one or more of the propellant charges 2436. The hybrid perforating unit(s) 2432 may be used, for example, for forming the perforations 135 the wellbore 104 (FIG. 1) using the shaped charges 136, and generating micro-fractures around the perforations 135 using the propellant charges 2436 as is described further herein.

As shown in FIGS. 24A and 24B, the perforating housing 2436*a* may be, for example, similar to the perforating housing 436*a* of FIGS. 4A and 4B. The perforating housing 2436*a* has housing openings 2443 that may be similar to the openings 443 of FIG. 4A for passing the shaped charges 136 and/or the propellant charges 2436 from the hybrid charge assembly 2436*c*, through the perforating housing 2436*a*, and into the wall of the wellbore 104 (see, e.g., FIG. 1). The openings 2443 may be pre-formed in the perforating housing 2436*a*, or generated as the shaped charges 136 pass through the perforating housing 2436*a*. One or more of the housing openings 2443 may be formed in the perforating housing 2436*a* before or during perforating by the shaped charges 136 as is described further herein.

The perforating housing 2436*a* houses the detonation assembly 2433 therein. The detonation assembly 2433 includes a detonator assembly 2436*b*, and the hybrid charge assembly 2436*c*. The detonator assembly 2436*b* may be, for example, similar to the detonator assembly 436*b* described herein (see, e.g., FIGS. 5 and 12) for detonating the shaped charges 136. The detonator assembly 2436*b* may be coupled to the shaped charges 136 and the propellant charges 2436 by charge cable 442*a* for ignition in a similar manner as is done for the other shaped charges 136 described herein.

In the example shown in FIGS. 24A and 24B, the hybrid charge assembly 2436*c* includes a charge tube 2440*a*, receiver 440*b*, and a charge feedthru 440*c* similar to those described herein (see, e.g., 440*a-c* of FIGS. 4A and 4B). The charge tube 2440*a* houses the shaped charges 136 and the propellant charges 2436 in a vertical arrangement within the hybrid charge assembly 2436*c*. This vertical arrangement shows the shaped charges 136 alternating with the propellant charges 2436 such that a propellant charge 2436 is positioned between each of the shaped charges 136. The shaped charges 136 are shown as being oriented in various radial directions about the hybrid charge assembly 2436*c*.

One or more of the hybrid and/or other perforating units as described herein may be positioned in the downhole tool 118 (FIG. 1). For example, one or more of the hybrid perforating units 2432 may be connected to other hybrid perforating units 2432 and/or to other perforating units, such as the shaped charge perforating units 132 shown in FIG. 3, to form the downhole tool 118. Various configurations of the hybrid charge assembly 2436*c* may also be included as needed.

Figure 25A:
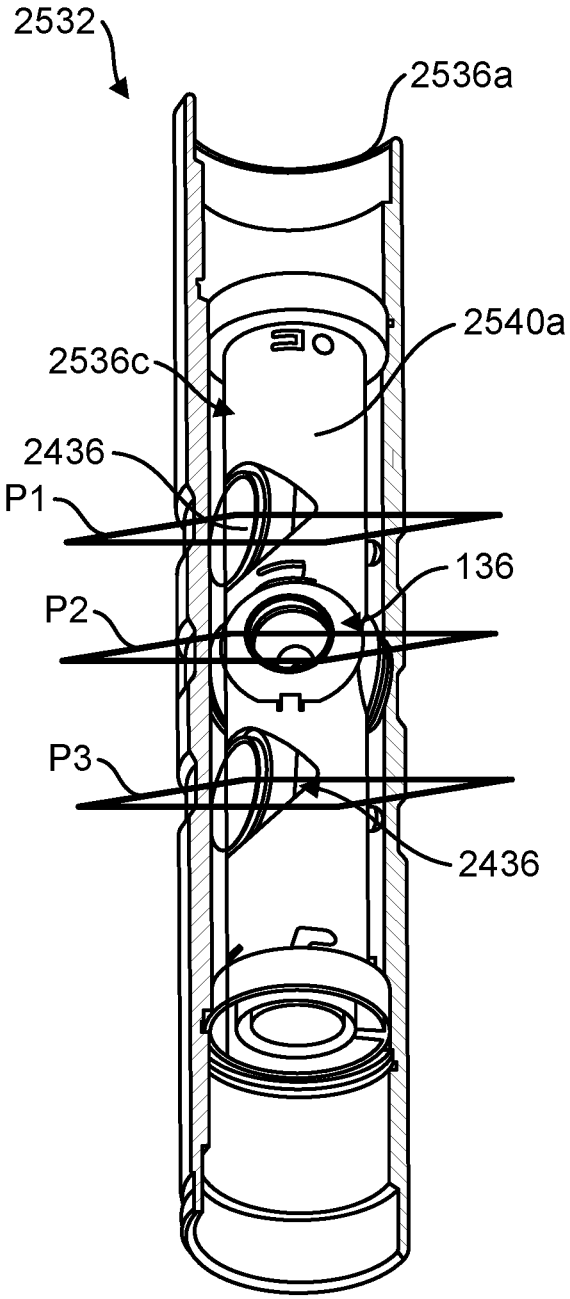
FIGS. 25A-25B are partial, cross-sectional views of the hybrid perforating unit including the hybrid charge assembly with disk propellant charges and pellet propellant charges, respectively.
Figure 25B:
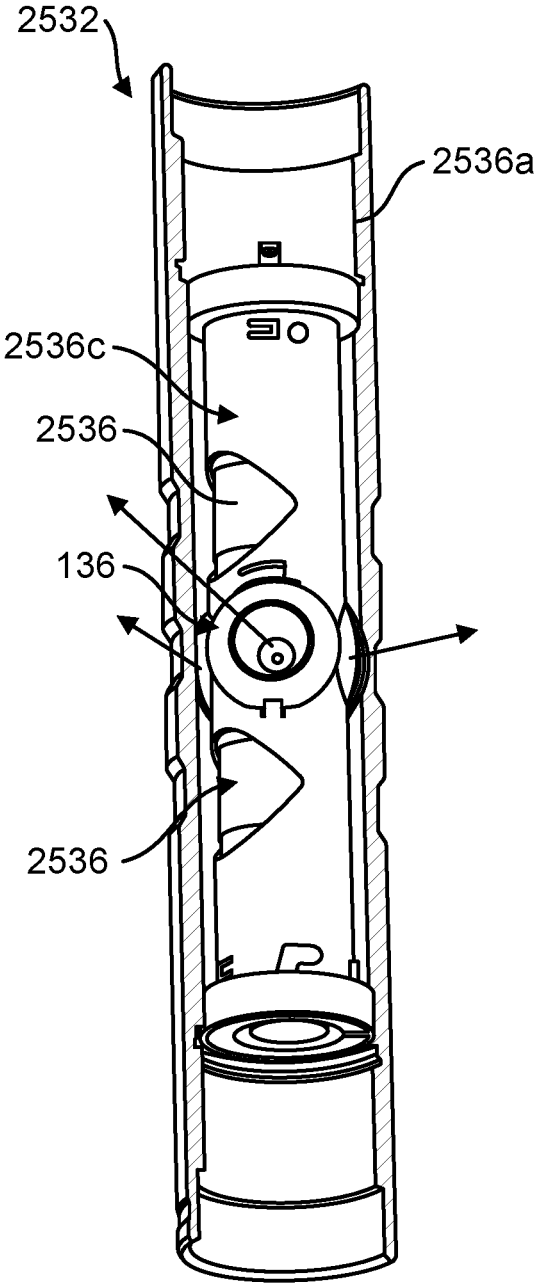

FIGS. 25A-25B are partial, cross-sectional views of a portion of the hybrid perforating unit 2532 including a hybrid charge assembly 2536*c* with disk propellant charges 2436 and pellet propellant charges 2536, respectively. This version of the hybrid charge assembly 2536*c* includes a set of shaped charges 136 positioned between two sets of the propellant charges 2436, 2536. For descriptive purposes and to more fully visualize the hybrid charge assembly 2536*c*, portions of the perforating housing 2536*a* of the hybrid perforating unit 2532 have been removed.

As shown in these views, the perforating housing 2536*a* is shaped to receive and house the hybrid perforating unit 2532. This view also shows an example of the position of the propellant charges 2436, 2536 and the shaped charges 136 within the charge tube 2540*a*. In this example, the propellant charges 2436, 2536 are aligned horizontally along pressure planes P1 and P3, respectively, and the shaped charges 136 are aligned horizontally along a perforating plane P2 between planes P1 and P3. Multiple (e.g., 3) shaped charges 136 are shown in perforating plane P2, with each shaped charge 136 pointed radially in a different direction as indicated by the arrows. One propellant charge is shown in each perforating plane P1, P3. In this position, the shaped charges 136 perforate in three radial directions about the wellbore from plane P2, and the propellant charges 2436 along horizontal planes P1 and P3 generate pressure uphole and downhole, respectively, from the shaped charges 136 to generate pressure in the perforations as is described further herein.

The horizontal pressure planes P2, P3 are located a distance from the perforating plane P1. The placement of the perforating plane(s) may be selected to allow multiple shaped charges 136 to be placed in the same perforating plane for perforation in multiple directions. The placement of the pressure plane(s) may be selected to increase the size of the propellant charge, thereby increasing an amount of fracture pressure generated. Various numbers of shaped charges 136, perforating planes P1, propellant charges 2436, and pressure planes P2, P3 may be provided.

As also shown in FIGS. 25A-25B, the hybrid charge assembly 2536*c* may include various types of charges, such as the shaped charge 136, the disk propellant charges 2436, the pellet propellant charges 2536, as well as other types of charges (not shown). Examples of charges that may be used as the shaped charge, the disk propellant charge, and the pellet propellant charge are described in one or more of the patents previously incorporated by reference herein. Additional examples of the disk propellant charge 2436 are described further herein with respect to FIGS. 27A-27D. While a specific number and arrangement of various types of the shaped charges 136 and the propellant charges 2436, 2536 are shown and are positioned in specific planes P1-P3, various numbers, types, and arrangements may be provided.

Figure 26A:
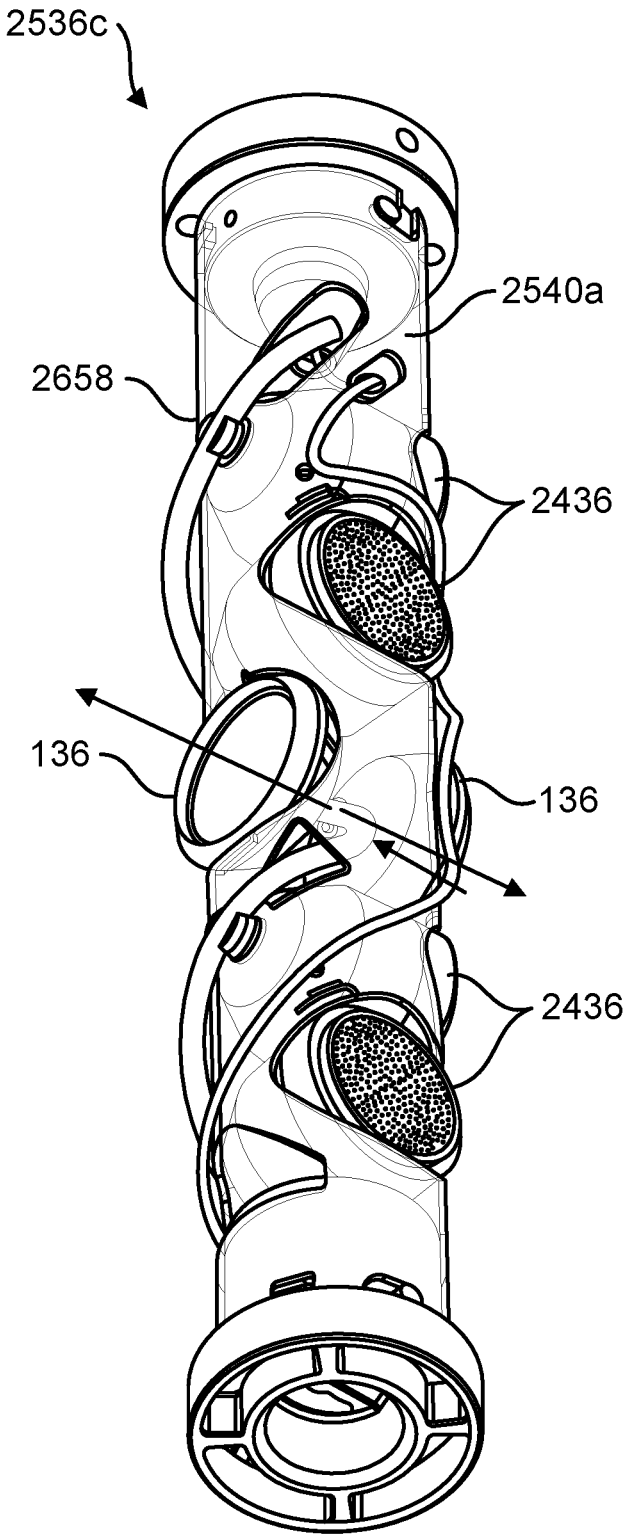
FIGS. 26A and 26B are hidden and exploded views, respectively, of the hybrid charge assembly.
Figure 26B:
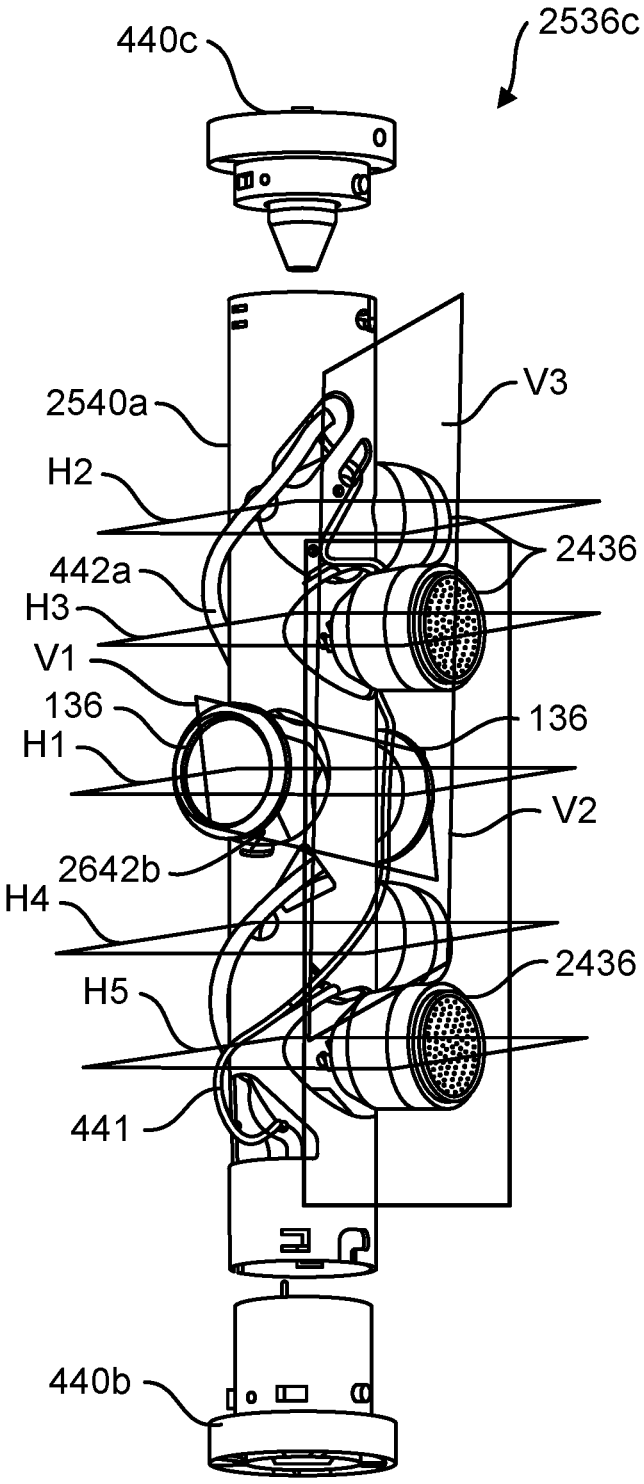
Figure 27A:
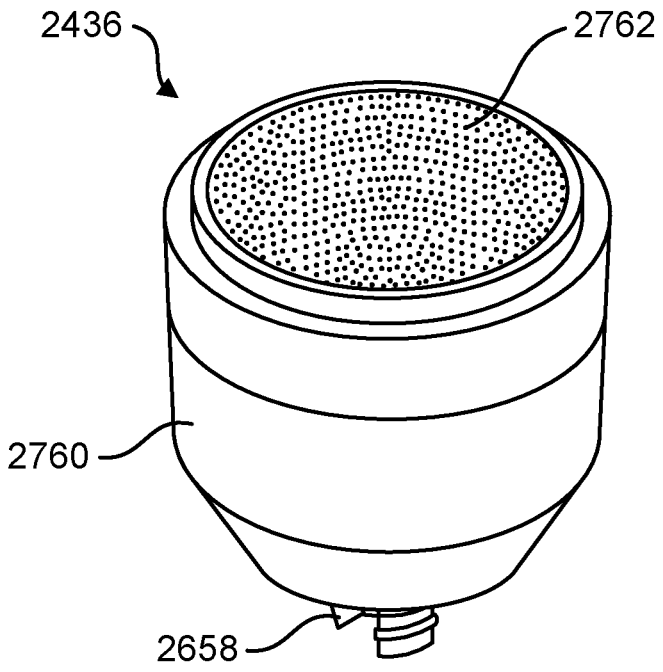
FIGS. 27A-27D are perspective, end, cross-sectional, and side views, respectively, of the disk propellant charge.
Figure 27B:
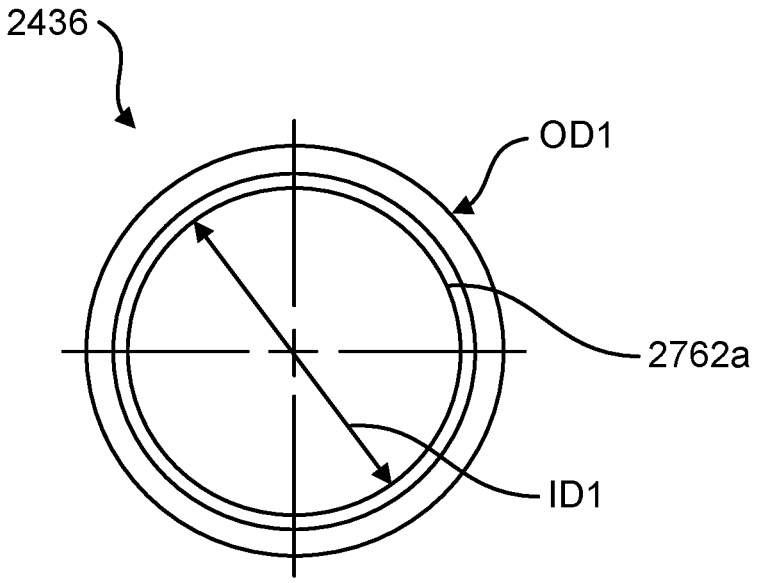
Figure 27C:
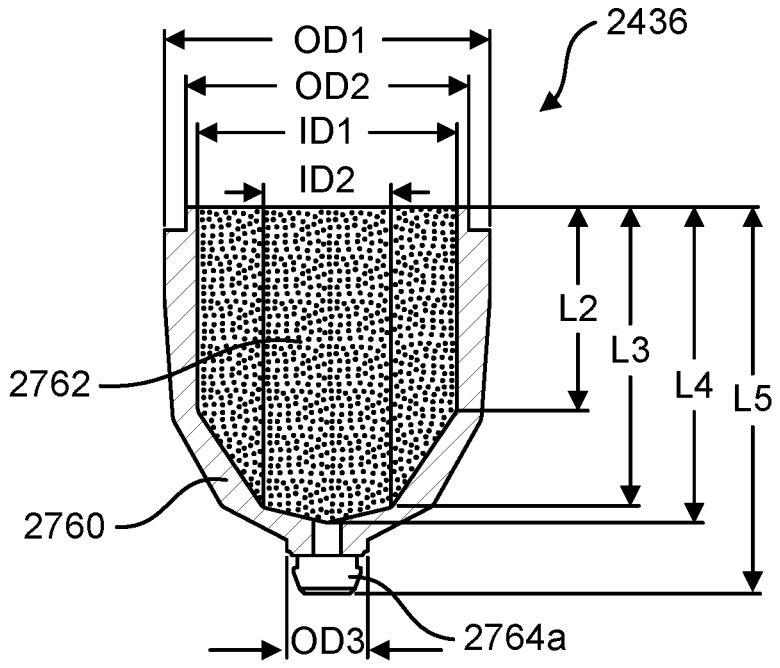
Figure 27D:
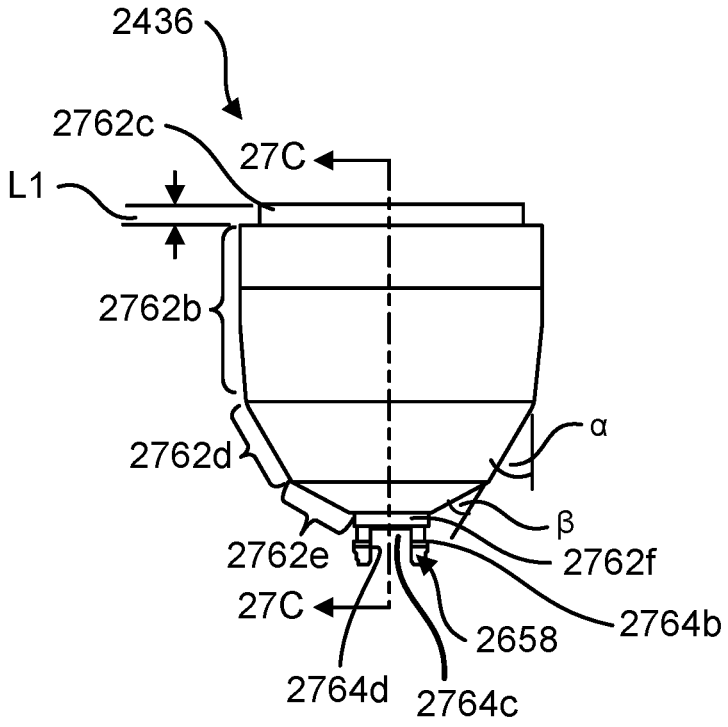

FIGS. 26A and 26B are hidden and exploded views, respectively, of a hybrid charge assembly 2536*c*. The hybrid charge assembly 2536*c* includes a charge tube 2540*a*, the receiver 440*b* at one end of the charge tube 2540*a*, and the charge feedthru 440*c* at an opposite end of the charge tube 2440*a*.

The charge tube 2540*a* also has the wire 441 and the charge cable 442*a* as described with respect to FIGS. 6A and 6B. The wire 441 and the charge cable 442*a* extend through the charge tube 2540*a* for communication via the charge feedthru 440*c*, and for connection through the receiver 440*b* with the detonator assembly 2436*b* (FIG. 24B). The wire 441 may extend through the charge tube 2540*a* and the hybrid charge assembly 2536*c* for coupling to the detonator assembly 2436*b* and the charge feedthru 440*c* for selectively activating the hybrid charge assembly 2536*c* in a similar manner as described herein with respect to the perforating units 132 and 1632. The wire 441 may provide a communication link that extends through one or more of the hybrid charge assemblies 2536*c* and/or other charge assemblies. This wire 441 may also pass through and/or be coupled to one or more other downhole components, such as portions of the downhole tool 118, the downhole equipment 102*b*, and/or the surface equipment 102*a*.

The charge tube 2540*a* has the shaped charges 136 and the propellant charges 2436 supported therein. The propellant charges 2436 may include one or more of the disk propellant charges 2436 and/or the pellet propellant charges 2536 as described in FIGS. 25A and 25B. The shaped charges 136 and the propellant charges 2436, 2536 may be connected to the charge cable 442*a* by cord clips 2658 for activation by the detonator assembly 2436*b* (FIG. 24B).

The shaped charges 136 and the propellant charges 2436 may be positioned about ports 2642*b* in the charge tube 2540*a*. The ports 2642*b* may be aligned with the housing openings 2443 in the perforating housing 2436*a* (FIG. 24A). The shaped charges 136 and the propellant charges 2436 may be positioned about the ports 2642*b*, and the ports 2642*b* may be alignable with housing openings 2443 (if present) in the perforating housing 2436*a* for firing therethrough upon detonation. The shaped charges 136, the propellant charges 2436, and the corresponding ports 2642*b* and the housing openings 2443 are positioned to facilitate firing of the hybrid perforating unit 2532 as is described further herein.

As also shown by the example in FIGS. 26A and 26B, the shaped charges 136 and the propellant charges 2436 are in a specific arrangement to facilitate perforating. In this example, two of the shaped charges 136 are positioned along the same horizontal plane H1. The two shaped charges 136 are also positioned to fire in opposite directions about a vertical plane V1 as indicated by the opposing arrows. This example also shows four of the propellant charges in four different horizontal planes H2-H5, and in two different vertical planes V2-V3. In this position, the shaped charges 136 perforate in opposite radial directions about the wellbore and the propellant charges 2436 along horizontal planes H2, H3 and H4, H5 to generate pressure uphole and downhole, respectively, from the shaped charges 136 to generate pressure in the perforations as is described further herein.

FIGS. 27A-27D show a detailed view of an example disk propellant charge 2436 that may be used with one or more of the perforating units described herein. FIGS. 27A-27D are perspective, end, side, and cross-sectional views, respectively, of the disk propellant charge 2436. The disk propellant charge 2436 may be configured for use with the hybrid perforating units and the charge tubes described herein.

The propellant charge 2436 includes a propellant jacket (or charge case) 2760 and propellant material 2762. The propellant charge 2436 may be configured to provide sufficient force to break the formation. The propellant material 2762 may be a chemical mixture of a flammable material, such as rocket, aviation, or other fuel, ignitable by the charge cable 442*a* (FIG. 26*a*). The propellant material 2762 may be, for example, a high volatility fuel capable of generating a fast burst of high pressure capable of passing through the downhole tool and into the perforations in the formation to create fractures as is described further herein. The propellant material 2762 may be in the form of a solid material packed into the propellant jacket 2760.

The propellant material 2762 used to generate the fracture pressure $P_{Frac}$ may be different from the charge material in the shaped charge 136 used to generate force for perforation. The propellant material 2762 may have a predefined timing and energy generated from ignition that is different from the charge material. For example, the shaped charge 136 with the charge material may detonate in micro-seconds (e.g., greater than 1 micro-second), and the propellant charge 2436 with the propellant material 2762 may detonate in milliseconds (e.g., less than one micro-second). In another example, the propellant material 2762 may be more volatile (e.g., aviation fuel) in order to generate the fracture pressure $P_{Frac}$, which may be different from the explosive charge material (e.g., HMX (octogen), TNT, etc.) in the shaped charge 136 used to punch through the housing 2536*a* and perforate the formation. Examples of shaped charges that may be used are commercially available from WELLMATICS™ at https://www.wellmatics.com/solutions/energetics/shaped-charges.

The propellant jacket 2760 may be shaped to fit within the space provided within the selected perforating unit to facilitate operation, ignition, pressurization, manufacture, reloading, retrofitting with existing equipment, etc. For example, the propellant jacket 2760 may be provided with, for example, a shape to support a maximum volume of the propellant material 2762. An increased volume may be provided to increase burn rate, pressure, etc. In another example, the propellant jacket 2760 may be provided with a shape similar to the shape of the shaped charge 136. The same shape may enable the use of the same manufacturing equipment and/or facilitate installation and operation within the same perforating unit as the shaped charge.

The propellant jacket 2760 may be made of a plastic material, such as PEEK, or a metal, such as steel or metal alloy, that may be shaped to support the propellant material 2762 therein. The propellant jacket 2760 may be shaped to facilitate storage, detonation, firing, and/or pressure generation of the propellant material 2762. In the example shown, the propellant jacket 2760 is a cup-shaped member with a charge opening 2762*a* at one end and the cord clip 2658 at an opposite end. The charge opening 2762*a* has a circular shaped for receiving and storing the propellant material 2762 therein.

The propellant jacket 2760 has a tubular upper portion 2762*b* with a raised lip 2762*c* about the charge opening 2762*a*. A mid tapered portion 2762*d* extends from the upper portion 2762*b*, and a bottom tapered portion 2762*e* extends from the mid tapered portion 2762*d* toward the clip 2658. A clip receptacle 2762*f* extends from the bottom tapered portion 2762*e* and is shaped to receive the clip 2658 therein.

The clip 2658 extends from the clip receptacle 2762*f*. The clip 2658 may be formed as part of the propellant jacket 2760, or may be formed separately for insertion into the clip receptacle 2764*f*. The clip 2658 has a circular body 2764*a* with a pair of prongs 2764*b* and a plug 2764*c* extending therefrom. The plug 2764*c* is receivable in the clip receptacle 2762*f*. The prongs 2764*b* define a cable receptacle 2764*d* therebetween for grippingly engaging the charge cable 442*a*. The clip 2658 may be used to support the propellant charge 2436 in the charge tube 2540*a* (FIGS. 26A-26B), and to pass the detonation signal from the charge cable 442*a* to the propellant material 2762 for activation thereof.

The propellant charge 2436 may also be configured to generate sufficient pressure in the wellbore 104 (FIG. 1). The propellant jacket 2760 may have dimensions optimized for use in the hybrid charge tube 2540*a* and/or the hybrid perforating unit 2532, and/or for optimizing perforation of the wellbore. Chart 1 below lists example dimensions that may be used with the disk propellant charge 2436.

CHART 1

Propellant Charge Dimensions

| DIMENSION | ENGLISH UNITS | METRIC UNITS |
|---|---|---|
| Jacket Inner Diameter - ID1 | 1.400 (+/−0.05) inches | 3.556 (+/−0.127) cm |
| Jacket Outer Diameter - OD1 | 1.743 (+/−0.05) inches | 4.427 (+/−0.127) cm |
| Lip Outer Diameter - OD2 | 1.520 (+/−0.05) inches | 3.861 (+/−0.127) cm |
| Clip Outer Diameter - OD3 | 0.431 (+/−0.05) inches | 1.095 (+/−0.127) cm |
| Taper Inner Diameter ID2 | 0.700 (+/−0.05) inches | 1.778 (+/−0.127) cm |
| Lip Height - L1 | 0.118 (+/−0.05) inches | 0.300 (+/−0.127) cm |
| Upper Portion Height - L2 | 1.089 (+/−0.05) inches | 2.766 (+/−0.127) cm |
| Taper Height - L3 | 1.600 (+/−0.05) inches | 4.064 (+/−0.127) cm |
| Jacket Inner Height - L4 | 1.689 (+/−0.05) inches | 4.290 (+/−0.127) cm |
| Jacket Outer Height - L5 | 2.064 (+/−0.05) inches | 5.243 (+/−0.127) cm |
| Mid Taper Angle - α | 45 degrees (+/−1 degree) | 45 degrees (+/−1 degree) |
| Bottom Taper Angle - β | 30 degrees (+/−1 degree) | 30 degrees (+/−1 degree) |

The desired shape and materials used may be modeled or empirically selected to provide the optimum fracture pressure $P_{Frac}$. The configuration may be selected to enable the formation to generate fractures without damaging the downhole tool 118. Parameters that may be considered for optimizing the operation and/or fracturing may include, for example, wellsite parameters (e.g., wellbore geometry, formation or rock strength, wellbore fluid, casing thickness, etc.), propellant parameters (e.g., quantity, type, volume, burn rate, etc.), shape parameters (e.g., puncture size, perforating dimensions, etc.), tool parameters (e.g., volume inside tool, position of propellant and shaped charges, etc.), etc.

Figure 28:
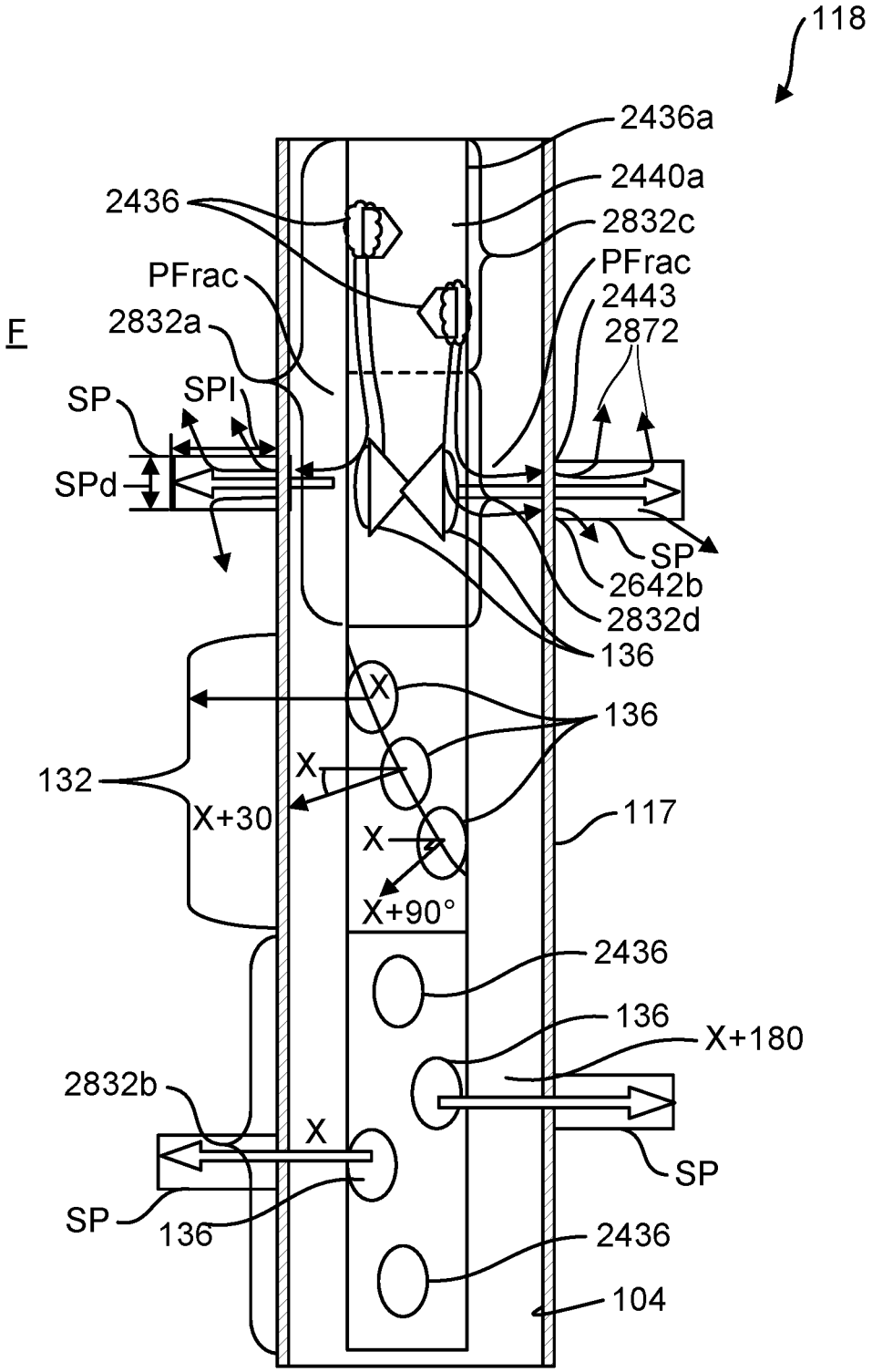
FIG. 28 is a schematic diagram depicting the downhole tool with various perforating units.

FIG. 28 is a schematic diagram depicting the downhole tool 118 with multiple perforating units 132 and 2832*a-d*. As shown in this figure, one or more perforating units 132, 2832*a-d* may be combined in a single downhole tool 118. The downhole tool 118 includes a first hybrid perforating unit 2832*a* at an uphole end of the downhole tool 118, a second hybrid perforating unit 2832*b* at a downhole end of the downhole tool 118, and a shaped charge perforating unit 132 therebetween. The perforating units 2832*a-d* may be similar to the hybrid perforating units 2432, 2532 described herein.

The first hybrid perforating unit 2832*a* is shown forming shaped perforations SP in the wall of the wellbore 104 using the shaped charges 136. The shaped charges 136 may have explosives that explode upon detonation to form the shaped perforations SP. The shaped charge 136 may form a tunnel shaped perforation by piercing through the housing 2436*a* and the casing 117. A perforating force of, for example, about 100 psi (689.50 KPa) may be generated by the shaped charges 136. The explosion of the shaped charges 136 pass through the ports 2642*b* in the charge tube 2440*a*, and into the formation to form the shaped perforation SP in the wall of the wellbore 104. The shaped perforation SP has a length SPI and a diameter SPd. The explosive material of the shaped charge 136 explodes in a manner that generates an explosive force against the wall of the wellbore 104 as indicated by the arrows, thereby extending into the shaped perforation SP.

The propellant charge 2436 may ignite upon detonation to generate a pressure $P_{Frac}$ in the hybrid perforating unit 2832*a*. This ignition of the propellant charges 2436 passes through the hybrid perforating unit 2832*a*, through the ports 2642*b*, and out through the perforation(s) SP. During ignition, the propellant material 2762 (FIG. 27) of the propellant charge 2436 undergoes a transition from a solid material to a gas phase that expands at high pressure against the formation surrounding the shaped perforation SP. The propellant material 2762 may be ignited in the propellant charge 2436 to create a pressure of about 20 k psi (137,895.15 KPa) in the charge tube 2440*a* and through the perforation SP. This extra pressure in the existing tunnel is sufficient to create micro-fractures in the formation surrounding the perforation SP.

As indicated by the arrows, the detonation of the propellant charge 2436 generates the fracture force $P_{Frac}$ along the shaped perforation SP and forms micro-fractures 2872 therein. These micro-fractures 2872 crack open (or fracture) the formation F surrounding the shaped perforation SP to further extend the perforation SP. The micro-fractures 2872 may be used to facilitate flow of an injection fluid through the shaped perforation SP and into the surrounding formation F, and/or to facilitate production of fluid from the formation F into the wellbore 104.

Referring next to the perforating unit 132 downhole from the hybrid perforating unit 2832*a*, this perforating unit 132 has the shaped charges 136 in a helical arrangement for forming the shaped perforations SP. The perforating unit 132 may be similar to that of FIGS. 4A and 4B for forming perforations helically arranged about the perforating unit 132. This helical arrangement may be used to form perforations at different angles about the wellbore 104. In this example, the first shaped charge 136 is positioned along an axis X, the second shaped charge 136 is positioned at X+30 degrees, and the third shaped charge 136 is positioned at X+90 degrees. Each of the shaped charges 136 are at different depths (or horizontal planes) along the wellbore 104. In this configuration, the shaped charges 136 will form the perforations SP helically along the wall of the wellbore 104.

Referring next to the perforating unit 2832*b* downhole from the perforating unit 132, like the hybrid perforating unit 2832*a*, this hybrid perforating unit 2832*b* has the shaped charges 136 positioned in separate planes from the propellant charges 2436. The shaped charges 136 may be positioned in different horizontal planes from each other and/or from the propellant charges 2436. The shaped charges 136 may also be oriented for perforating at a desired radial angle as indicated by the arrows (e.g., at x+180), and multiple (e.g., 2) of the propellant charges 2436 may be positioned above and below the shaped charge 136. After perforation of the shaped charge 136, one or more of the propellant charges 2436 may be triggered to generate fracture pressure $P_{Frac}$ to fracture the perforation(s) SP.

While FIG. 28 may show specific configurations of perforating units 132 and 2832*a,b*, various combinations of one or more perforating units 132 may be provided. For example, the hybrid perforating unit 2832*a* as shown includes a combination of the shaped charges 136 and the propellant charges 2436 integrated into a single charge tube 2440*a*. This integrated hybrid perforating unit 2832*a* may provide a unitary structure for compactly and conveniently housing both propellant charges 2436 and shaped charges 136 in the same unit. This integrated hybrid perforating unit 2832*a* may also allow the fracture pressure from the propellant charge 2436 to pass through the same charge tube 2440*a*, and into the perforation SP.

In another example, a separate shape perforating unit 2832*c* and a separate perforating unit 2832*d* may optionally be provided. In this separate configuration, the shaped charges 136 and the propellant charges 2436 are positioned in separate perforating units 2832*c,d* as schematically indicated by the dashed line. The separate configuration may enable individual transport, replacement, configuration, and installation of the separate perforating units 2832*c,d*. The separated propellant perforating unit 2832*c* may also allow the fracture pressure $P_{Frac}$ to pass directly from the propellant perforating unit 2832*c* to the wellbore and into the perforation SP. The separated perforating units 2832*c,d* may also be fluidly connected to permit the fracture pressure $P_{Frac}$ generated by the propellant charges 2436 to pass through the perforating unit 2832*d* as shown by the curved arrows.

Figures 29A, 29B, 29C:
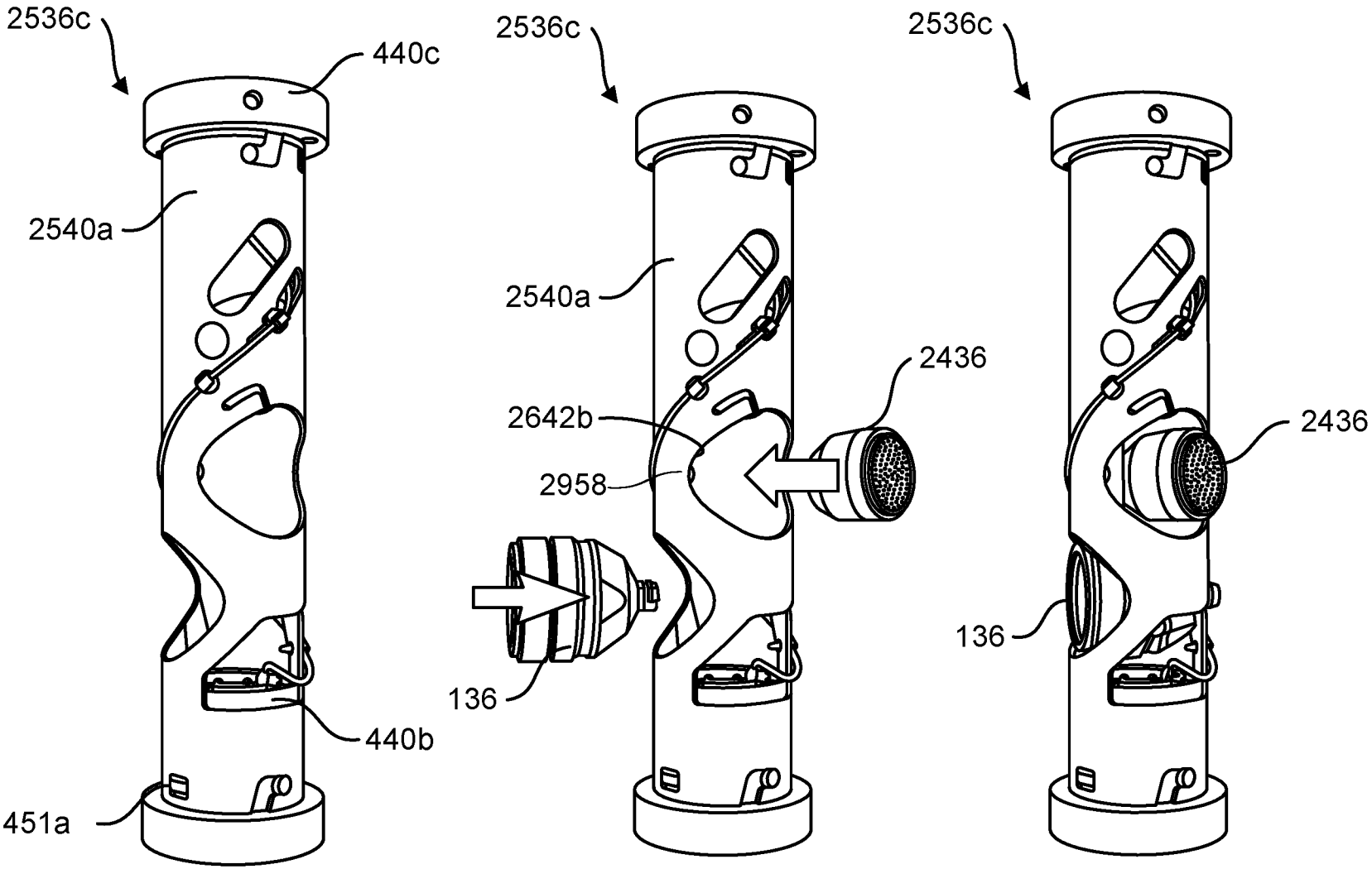
FIGS. 29A-29I are schematic diagrams depicting assembly of the hybrid charge assembly.

FIGS. 29A-29I are schematic diagrams depicting assembly of the hybrid charge assembly 2536*c* of the hybrid perforating unit 2532 (FIG. 25A). As shown in FIG. 29A, this assembly may begin by connecting the charge tube 2540*a* to the receiver 440*b* and the feedthru 440*c* (see also FIG. 26B). The charge cable 442*a* and the wire 441 may be connected to the feedthru 440*c*, and passed through the charge tube 2540*a* and the receiver 440*b* for connection to the detonator assembly 2436*b*. The receiver 440*b* may be secured in place by the locking tabs 451*a*.

As shown in FIG. 29B, one or more charges may be positioned in the charge tube 2540*a*. Clips 2658 are positioned on the charge cable 442*a* to support the charges. The shaped charges 136 may be inserted into the ports 2642*b* in the charge tube 2540*a*. As shown in FIG. 29C, the shaped charges 136 and the propellant charges 2436 may be secured into the port 2642*b* in contact with the charge cable 442*a*.

Figure 29F:
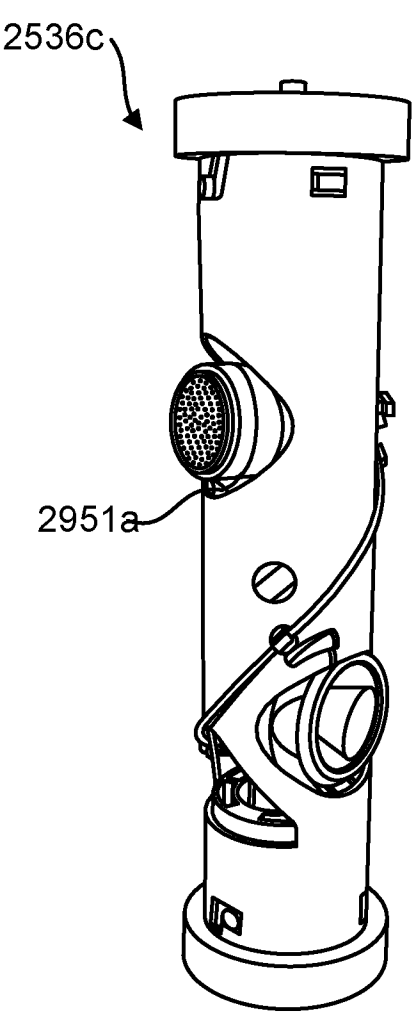
Figure 29E:
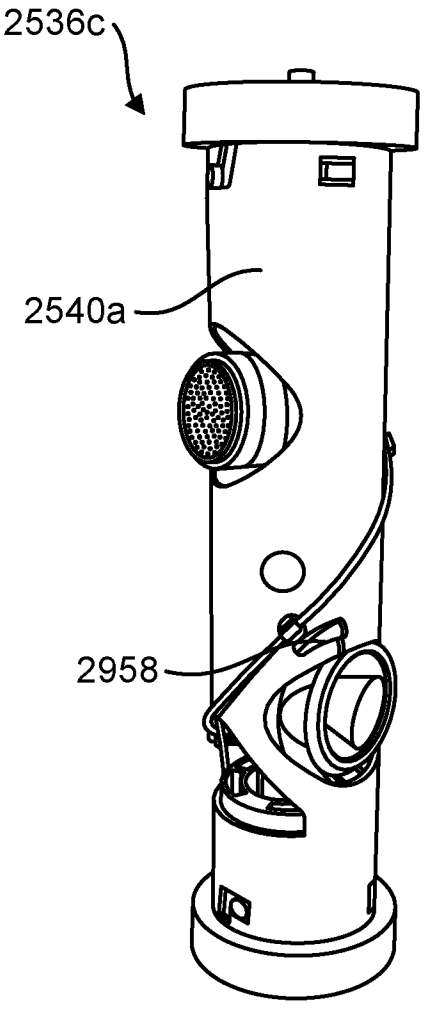
Figure 29D:
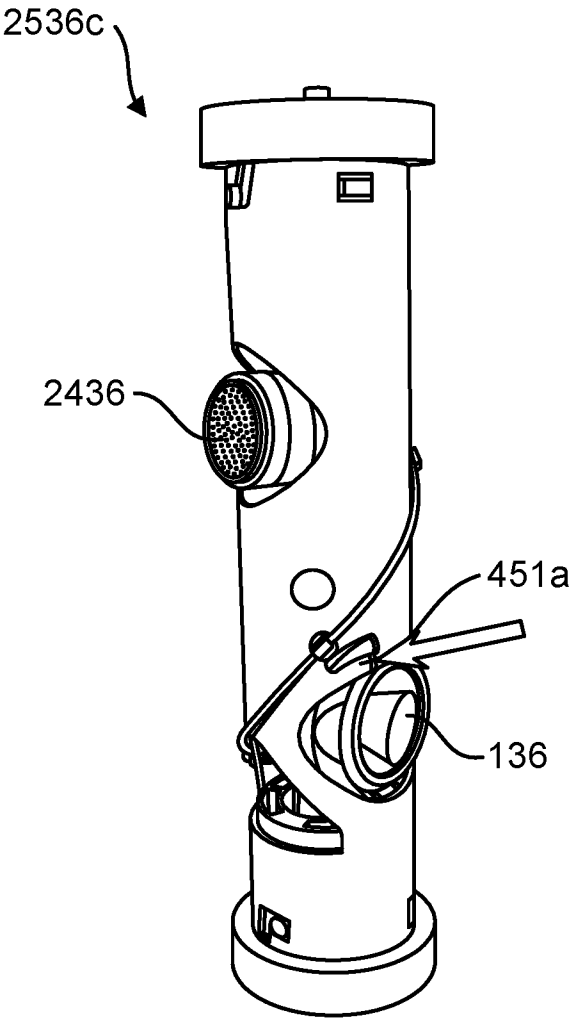
Figures 29G, 29H, 29I:
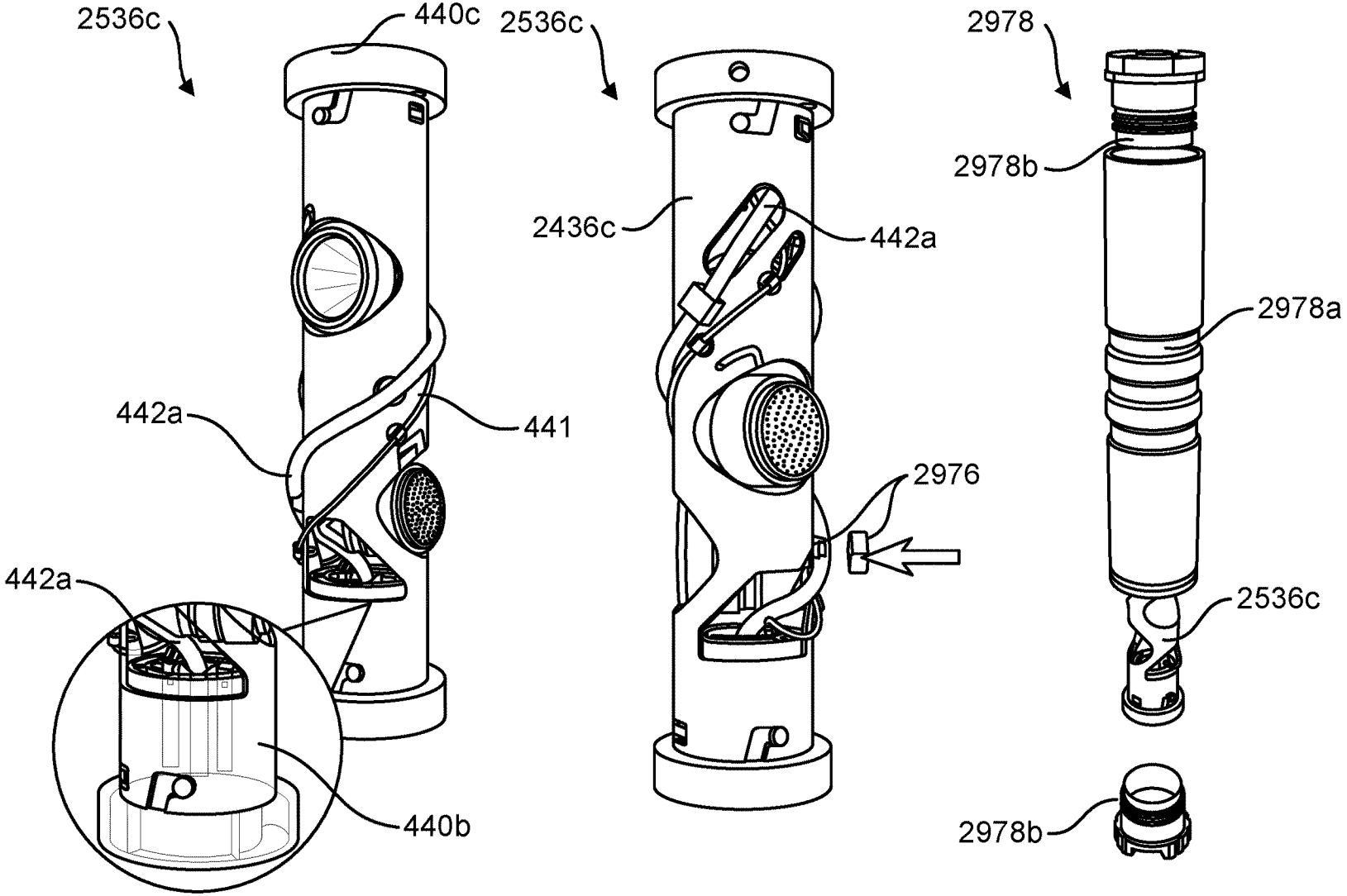

As shown in FIGS. 29D and 29E, the shaped charges 136 and the propellant charges 2436 may be secured in place by bending clip 2958 against the shaped charge 136. As shown in FIG. 29F, the process may be repeated for each of the shaped charges 136. As shown in FIG. 29G, the charge cable (detonating cord) 442*a* is inserted into the receiver 440*b*. The charge cable 442*a* may be secured in the receiver 440*b* with the clip 2958. As shown in FIG. 29H, the charge cable 442*a* may be wrapped around the charge tube 2540*a* until it is locked in each of the cord clips 2958 around the charge tube 2540*a* and secured by retainer clips 2976.

As shown in FIG. 29I, the hybrid charge assembly 2536*c* may be inserted into a travel container 2978. The travel container 2978 may include a travel tube 2978*a* and removable travel ends 2978*b*. The removable travel ends 2978*b* may be secured at each end of the travel tube 2978*a*, thereby enclosing the hybrid charge assembly 2536*c* therein to protect the charge tube 2540*a*, the shaped charges 136, and/or the propellant charges 2436 therein during, for example, transport and/or storage.

Figure 30A:
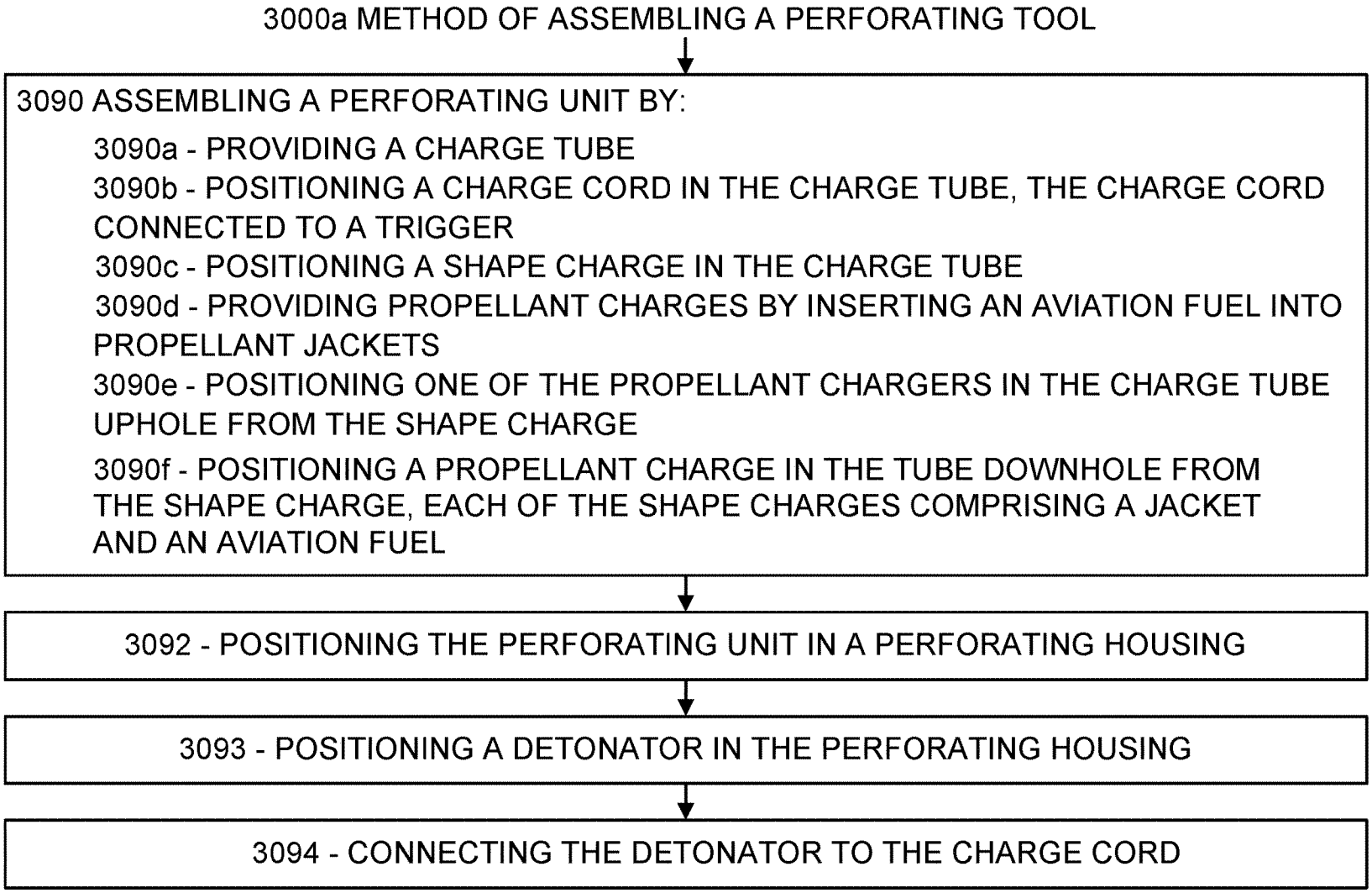
FIGS. 30A-30B are flowcharts depicting a method of assembling a downhole perforating tool and a method of perforating, respectively.
Figure 30B:
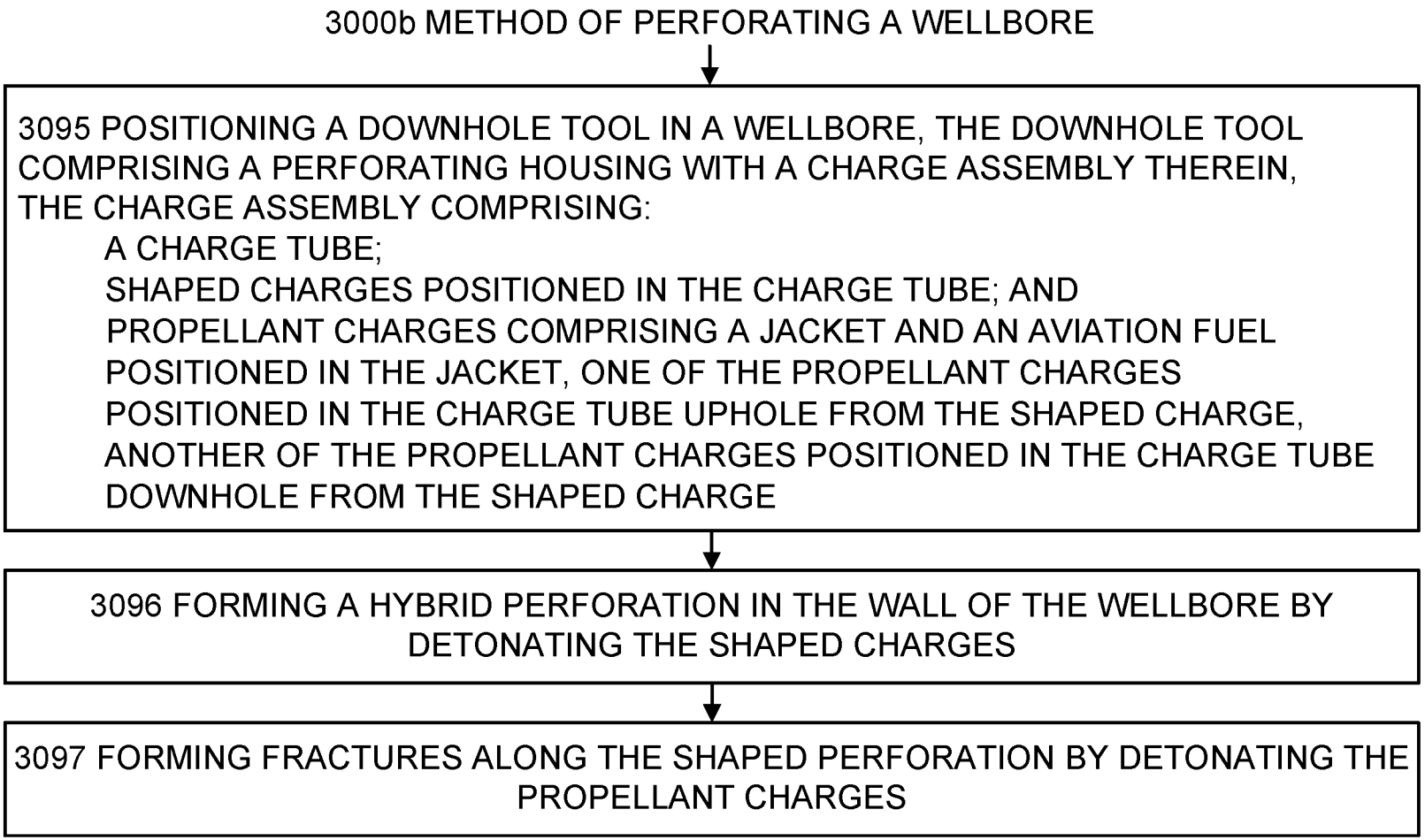

FIGS. 30A-30B are flowcharts depicting a method 3000*a* of assembling a perforating tool and a method 3000*b* of perforating a wellbore, respectively. The method 3000*a* involves 3090 assembling a perforating unit by: 3090*a* providing a charge tube; 3090*b*-positioning a charge cord in the charge tube, the charge cord connected to a trigger, 3090*c*-positioning a shaped charge in the charge tube, 3090*d*-providing propellant charges by inserting an aviation fuel into propellant jackets, 3090*e*-positioning one of the propellant charges in the charge tube uphole from the shaped charge, 3090*f*-positioning a propellant charge in the charge tube downhole from the shaped charge, each of the shaped charges comprising a jacket and an aviation fuel. The method 3000*a* also involves 3092 positioning the perforating unit in a perforating housing; 3093 positioning a detonator in the perforating housing; and 3094 connecting the detonator to the charge cord. Part or all of the assembly may be performed on or offsite from the wellsite.

The method 3000*b* involves 3095 positioning a downhole tool in a wellbore, the downhole tool comprising a perforating housing with a charge assembly therein. The charge assembly comprises a charge tube; a shaped charge positioned in the charge tube; and propellant charges comprising a jacket and an aviation fuel positioned in the jacket, one of the propellant charges positioned in the charge tube uphole from the shaped charge, another of the propellant charges positioned in the charge tube downhole from the shaped charge. The method 3000*b* continues with 3096 forming a hybrid perforation in the wall of the wellbore by detonating the shaped charges, and 3097 forming fractures along the shaped perforation by detonating the propellant charges.

Portions of the method may be performed in various orders, and part or all may be repeated.

While the embodiments are described with reference to various implementations and exploitations, it will be understood that these embodiments are illustrative and that the scope of the inventive subject matter is not limited to them. Many variations, modifications, additions and improvements are possible. For example, various combinations of one or more of the features and/or methods provided herein may be used.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter. For example, while certain connectors are provided herein, it will be appreciated that various forms of connection may be provided. While the figures herein depict a specific configuration or orientation, these may vary. First and second are not intended to limit the number or order.

Insofar as the description above and the accompanying drawings disclose any additional subject matter that is not within the scope of the claim(s) herein, the inventions are not dedicated to the public and the right to file one or more applications to claim such additional invention is reserved. Although a very narrow claim may be presented herein, it should be recognized the scope of this invention is much broader than presented by the claim(s). Broader claims may be submitted in an application that claims the benefit of priority from this application.

What is claimed is:

1. A charge assembly of a downhole perforating tool positionable in a wellbore penetrating a subterranean formation, the charge assembly comprising:

a charge tube positionable in the downhole perforating tool;

shaped charges receivably supported in the charge tube, each of the shaped charges comprising a charge jacket and a charge material positioned in the charge jacket, the charge material comprising an explosive generating a shaped fracture pressure; and propellant charges receivably supported in the charge tube, each of the propellant charges comprising a propellant jacket and a propellant material positioned in the propellant jacket, the propellant charges comprising a fuel generating a propellant fracture pressure different from the shaped fracture pressure;

wherein an uphole portion of the propellant charges are positioned uphole from the shaped charges and a downhole portion of the propellant charges are positioned downhole from the shaped charges, the shaped charges positioned between the uphole portion and the downhole portion; and wherein the shaped charges and the propellant charges are electrically connectable to a detonator for activation thereby.

2. The charge assembly of claim 1, wherein the shaped charges are positioned along a horizontal plane, each of the shaped charges oriented in a different radial direction.

3. The charge assembly of claim 1, wherein the shaped charges are aligned along a charge vertical plane, and the propellant charges aligned along a propellant vertical plane.

4. The charge assembly of claim 3, wherein the propellant vertical plane comprises a first propellant vertical plane and a second propellant vertical plane, a portion of the shaped charges are aligned along the first propellant vertical plane and another portion of the shaped charges are aligned along the second propellant vertical plan.

5. The charge assembly of claim 1, wherein the propellant jacket comprises a cup-shaped body, the cup-shaped body comprises a tubular upper portion at an opening end, a bottom tapered portion at a clip end terminating at a clip receptacle, and a mid tapered portion between the tubular upper portion and the bottom tapered portion.

6. The charge assembly of claim 1, wherein the propellant jacket comprises a lip about an opening end and a cord clip about a bottom end of the propellant jacket.

7. The charge assembly of claim 1, wherein the propellant charges comprise one of a disk propellant charge and a pellet propellant charge.

8. The charge assembly of claim 1, further comprising a charge bulkhead at a first end of the charge tube and a charge feed thru at an opposite end of the charge feed thru.

9. The charge assembly of claim 1, wherein the shaped charges and the propellant charges are integrated in the same charge tube.

10. The charge assembly of claim 1, wherein the charge tube comprises a plurality of charge tubes, the shaped charges positioned in a first of the plurality of charge tubes, at least a portion of the propellant charges in another of the plurality of charge tubes.

11. The charge assembly of claim 1, wherein the shaped fracture pressure generates a shaped perforating force of 100 psi (689.50 KPa) of pressure and wherein the propellant fracture pressure generates a propellant perforating force of 20k psi (137,895.15 KPa) of pressure.

12. A downhole perforating tool for perforating a wellbore penetrating a subterranean formation, the downhole perforating tool comprising:

the charge assembly as in claim 1; and a detonator assembly comprising a detonator housing positionable in the downhole perforating tool, the detonator positioned in the detonator housing.

13. The downhole perforating tool of claim 12, further comprising another charge assembly, the another charge assembly comprising another charge tube, additional shaped charges, and additional propellant charges.

14. The downhole perforating tool of claim 12, wherein the detonator assembly further comprises:

a detonator feedthru positioned at a first end of the detonator housing;

a bulkhead at a second end of the detonator housing; and a trigger positioned in the detonator housing, the trigger communicatively coupled, when in use, between a remote actuator and the detonator.

15. The downhole perforating tool of claim 14, wherein the detonator feedthru has an end with an offset shape matably connectable to a matingly shaped receiver in the charge assembly.

16. The downhole perforating tool of claim 15, wherein the trigger is positioned in the detonator housing, the trigger comprising:

a switch; and a contact positioned in the detonator feedthru, the contact electrically connected with the receiver of the charge assembly when the detonator feedthru is matably connected with the receiver of the charge assembly.

17. A method of perforating a wellbore, the method comprising:

positioning a downhole perforating tool with a charge assembly as in claim 1 in the wellbore;

forming perforations by detonating the shaped charges; and forming fractures along the perforations by detonating the propellant charges.

18. A method of assembling a perforating tool, the method comprising:

providing shaped charges, propellant charges, a charge tube, and a detonator, the shaped charges being different from the propellant charges;

assembling a charge assembly by:

receivably positioning the shaped charges in the charge tube;

receivably positioning an uphole portion of the propellant charges in the charge tube a distance uphole from the shaped charges; and receivably positioning a downhole portion of the propellant charges in the charge tube a distance downhole from the shaped charges;

inserting the charge assembly into a perforating housing; and operatively connecting the charge assembly to the detonator.

19. The method of claim 18, further comprising:

assembling a detonator assembly by:

positioning the detonator and a trigger in a detonator housing and positioning the detonator housing in the perforating housing.

20. The method of claim 19, further comprising matingly connecting an offset end of the detonator assembly to a mated receptacle end of the charge assembly.

* * * * *